US005247881A

United States Patent [19]

Rosser et al.

[11] Patent Number: 5,247,881

[45] Date of Patent: Sep. 28, 1993

[54] HORIZONTAL BALING APPARATUS

[75] Inventors: Fulton F. Rosser; Johnny B. Outen; Donald L. Barnes; Walter H. Raines, all of Cordele, Ga.

[73] Assignee: Harris Waste Management Group, Inc., Peachtree City, Ga.

[21] Appl. No.: 683,560

[22] Filed: Apr. 10, 1991

[51] Int. Cl.[5] ..... B30B 15/16

[52] U.S. Cl. ..... 100/48; 100/98 R; 100/215; 100/218; 100/232; 100/245

[58] Field of Search ..... 100/43, 48, 94, 98 R, 100/215, 218, 232, 242, 245

[56] References Cited

U.S. PATENT DOCUMENTS

| | | | |
|---|---|---|---|
| 3,003,411 | 10/1961 | Judd | 100/98 R |
| 3,065,586 | 11/1962 | Ghiringhelli | 100/232 X |
| 3,438,320 | 4/1969 | Raab | 100/43 X |
| 3,501,890 | 3/1970 | Hunt | 100/48 X |
| 3,576,161 | 4/1971 | Wright | 100/232 X |
| 3,613,556 | 10/1971 | Wright et al. | 100/98 R X |
| 3,693,541 | 9/1972 | Lombard et al. | 100/98 R X |
| 3,762,311 | 10/1973 | Friedman et al. | 100/232 X |
| 4,108,063 | 8/1978 | Randolph | 100/232 X |
| 4,121,515 | 10/1978 | Tea | 100/232 X |
| 4,184,424 | 1/1980 | Yeager et al. | 100/229 A X |
| 4,337,694 | 7/1982 | Brown | 100/94 X |
| 4,417,510 | 11/1983 | Sharp | 100/98 R |
| 4,658,719 | 4/1987 | Jackson et al. | 100/98 R X |
| 4,729,301 | 3/1988 | Smith et al. | 100/43 |

*Primary Examiner*—Stephen F. Gerrity
*Attorney, Agent, or Firm*—Hugh D. Jaeger

[57] ABSTRACT

A baler for recyclable materials and any other materials. The baler includes a power unit which engages to the rear of the gatherer desk. An operator stands on the gatherer deck between the rear of the hopper, which provides for visual observation, and forward of the power unit. Material is fed into the hopper. A compression chamber of bale chamber is at the forward end of the system for baling of the materials and subsequent discharge by an ejection ram for later disposition. The system provides for adjustment of the hold-down assembly for the ram and the charging box section, as well as for adjustment of the knife between the ram and the knife on the shear beam. The baler provides for adjustability for proper movement of the ram through the charging box, and for proper shearing of most materials which may be above the ram prior to entering the bale compression chamber area. The baler can bale such materials as corrugated cardboard, news print, magazines, computer paper, flattened cans, round cans, plastic bottles, scrap aluminum, scrap copper, aluminum radiators, as well as any other miscellaneous materials required for baling on a real time basis.

8 Claims, 84 Drawing Sheets

Microfiche Appendix Included
(91 Microfiche, 2 Pages)

-X- INDICATES SOLENOIDS ARE ENERGIZED

| | | 30 | | | | 31 | | | | 33 | | 254,256,258 | | | | 58 | |
|---|---|---|---|---|---|---|---|---|---|---|---|---|---|---|---|---|---|
| | | GATH. CYL. REAR | | GATH. CYL. FRONT | | EJECT. CYL. FRONT | | EJECT. CYL. REAR | | INTENS -IFIER | | GPM OIL SUPPLIES | | | | BALE RELEASE | |
| | | P | T | P | T | P | T | P | T | P | T | 69 | 100 | 100 | 69 | UP | DWN |
| | BALER FUNCTION | S1 | S2 | S3 | S4 | S5 | S6 | S7 | S8 | S9 | S10 | 306a | 304 | 308 | 306b | SBRU | SBRD |
| | IDLE CONDITION | | | | | | | | | | | | | | | | |
| | GATH. FWD. STRAIGHT | X | | | X | | | | | | X | X | X | X | | | |
| 30 | GATH. FWD. DIFFERENTIAL | X | | | X | | | | | | X | X | X | X | | | |
| | GATH. FWD. INTENSIFIED | | | | X | | | | | X | | | | X | | | |
| | GATH. RETRACT NORMAL | | X | X | | | | | | | X | X | X | X | | | |
| 30 | GATH. RETRACT POSITION | | X | X | | | | | | | | X | | | | | |
| | | | | | | | | | | | | | | | | | |
| | EJECTOR FORWARD | | | | | | X | X | | | | X | | X | | | |
| 31 | EJECTOR RETRACT | | | | | X | | | X | | | X | X | X | | | |
| | | | | | | | | | | | | | | | | | |
| | BALE RELEASE UP | | | | | X | | | X | | | | | | X | X | |
| 58 | BALE RELEASE DOWN | | | | | X | | | X | | | | | | X | | X |
| | NORMAL OPERATION WITH SYSTEM PRESSURE @ | | | | | | | | | | | | | | | | |
| | 0-1300 PSI | | | | | | | | | | | X | X | X | | | |
| | 1300-1800 PSI | | | | | | | | | | | | X | X | | | |
| | 1800-3050 PSI | | | | | | | | | | | | | X | | | |

FIG. 13A

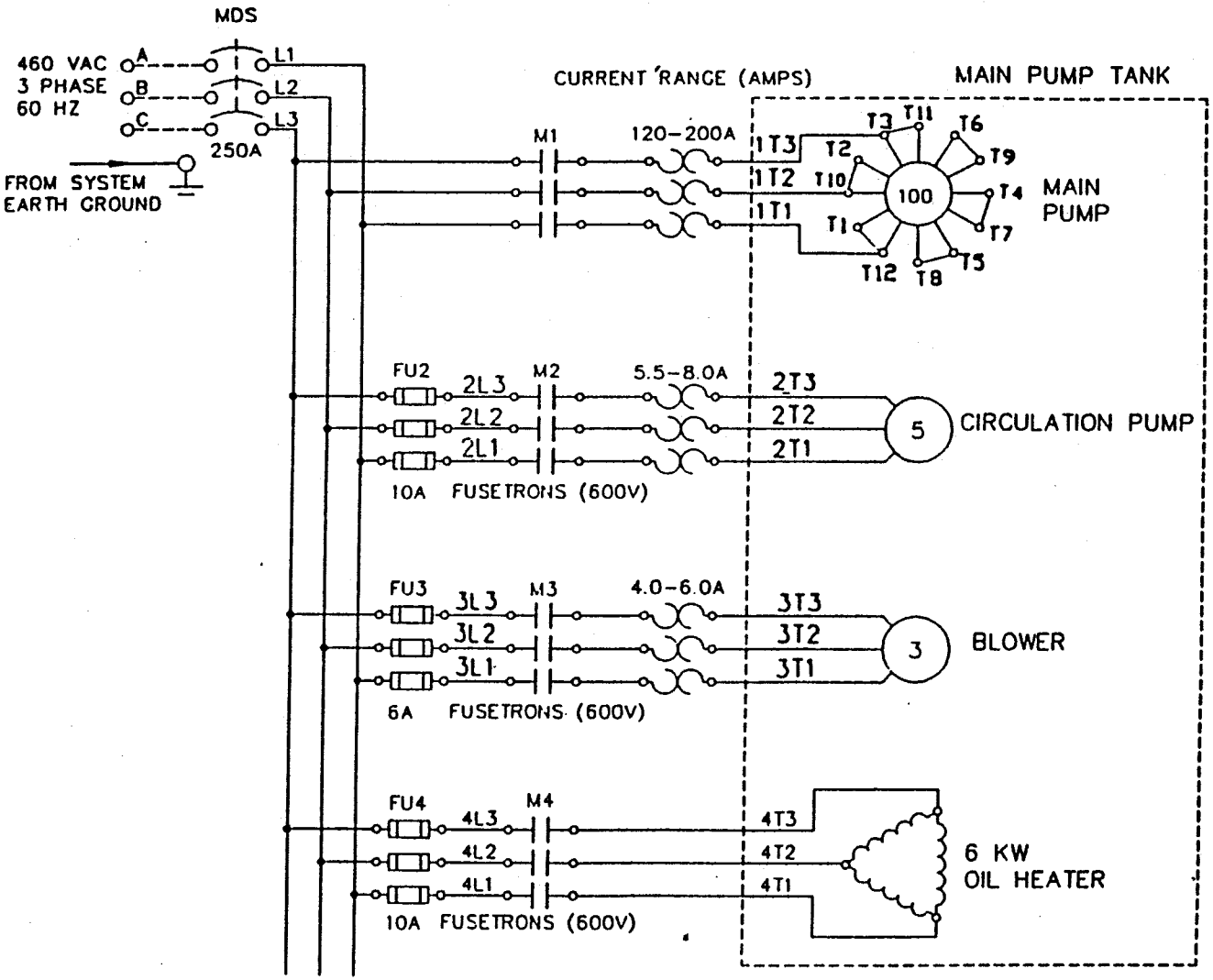
FIG. 14A1

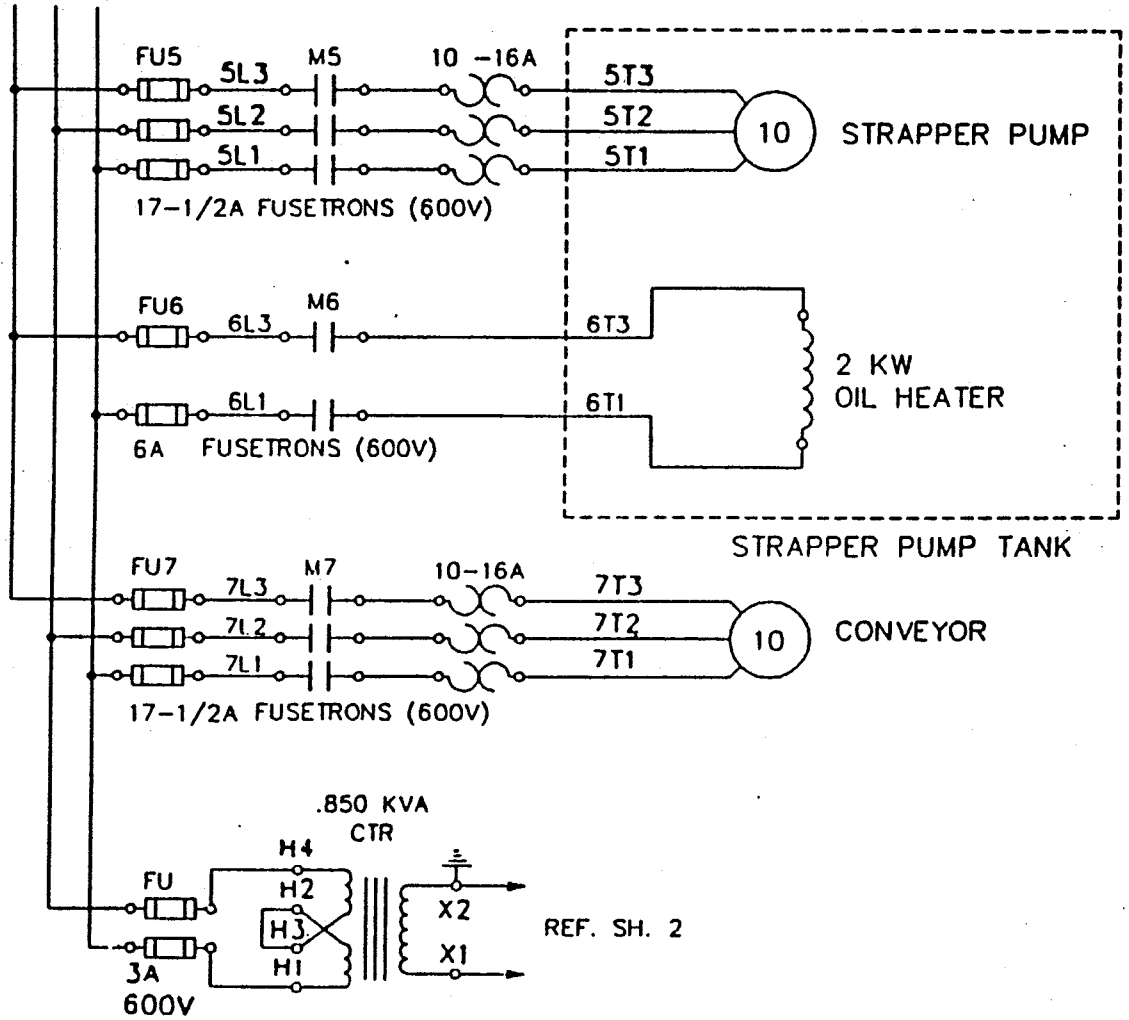
FIG. 14A2

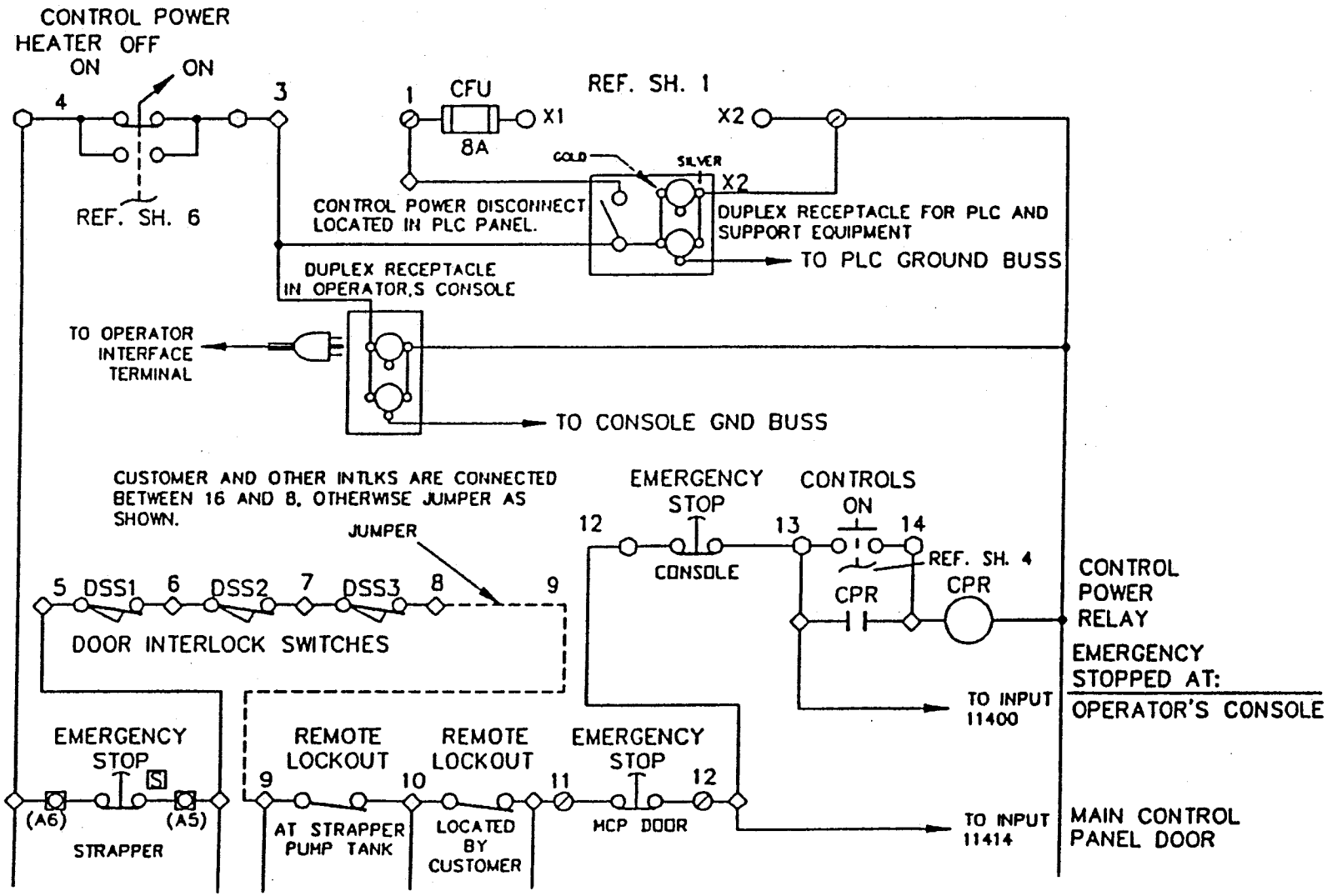
FIG. 14B1

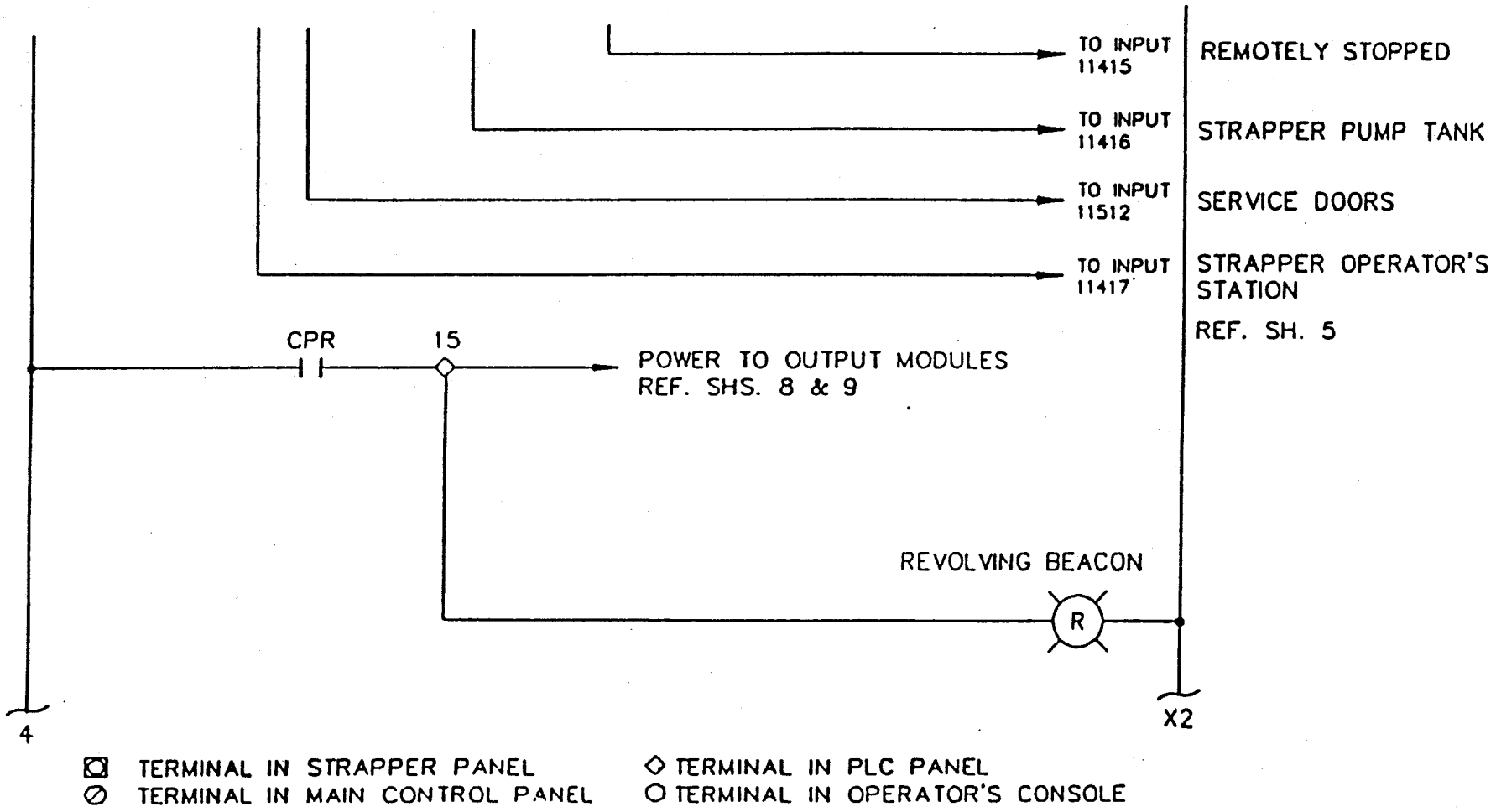
FIG. 14B2

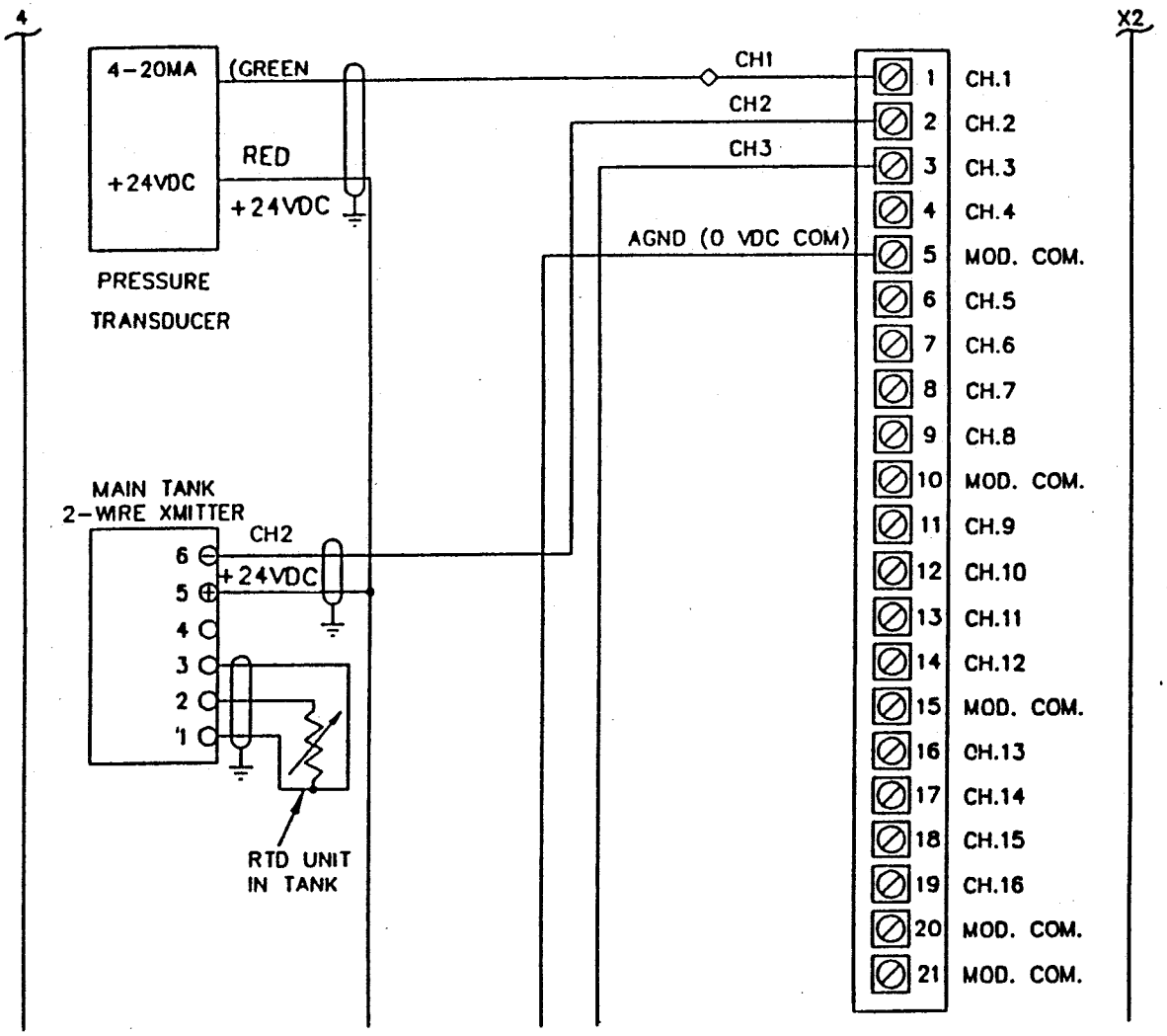
FIG. 14C1

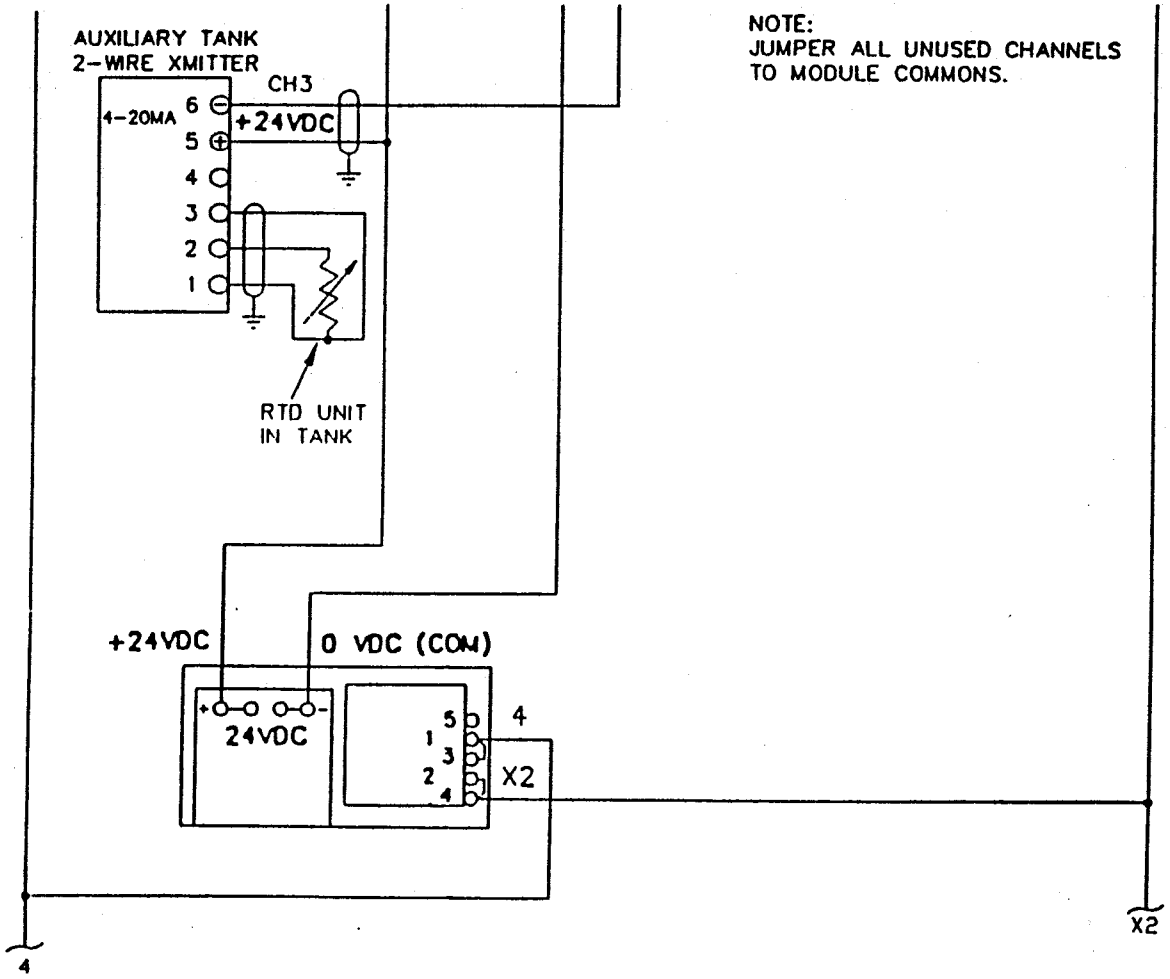
FIG. 14C2

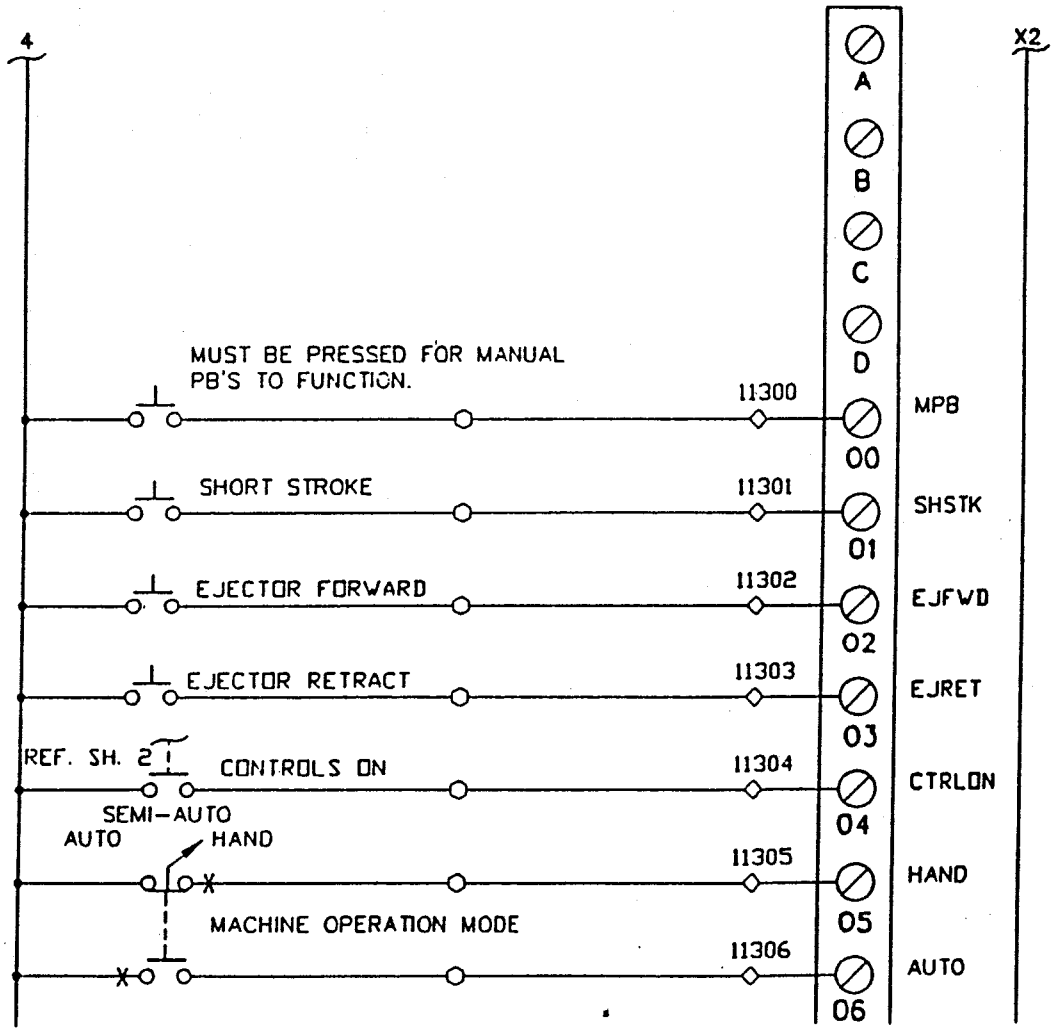
FIG. 14D1

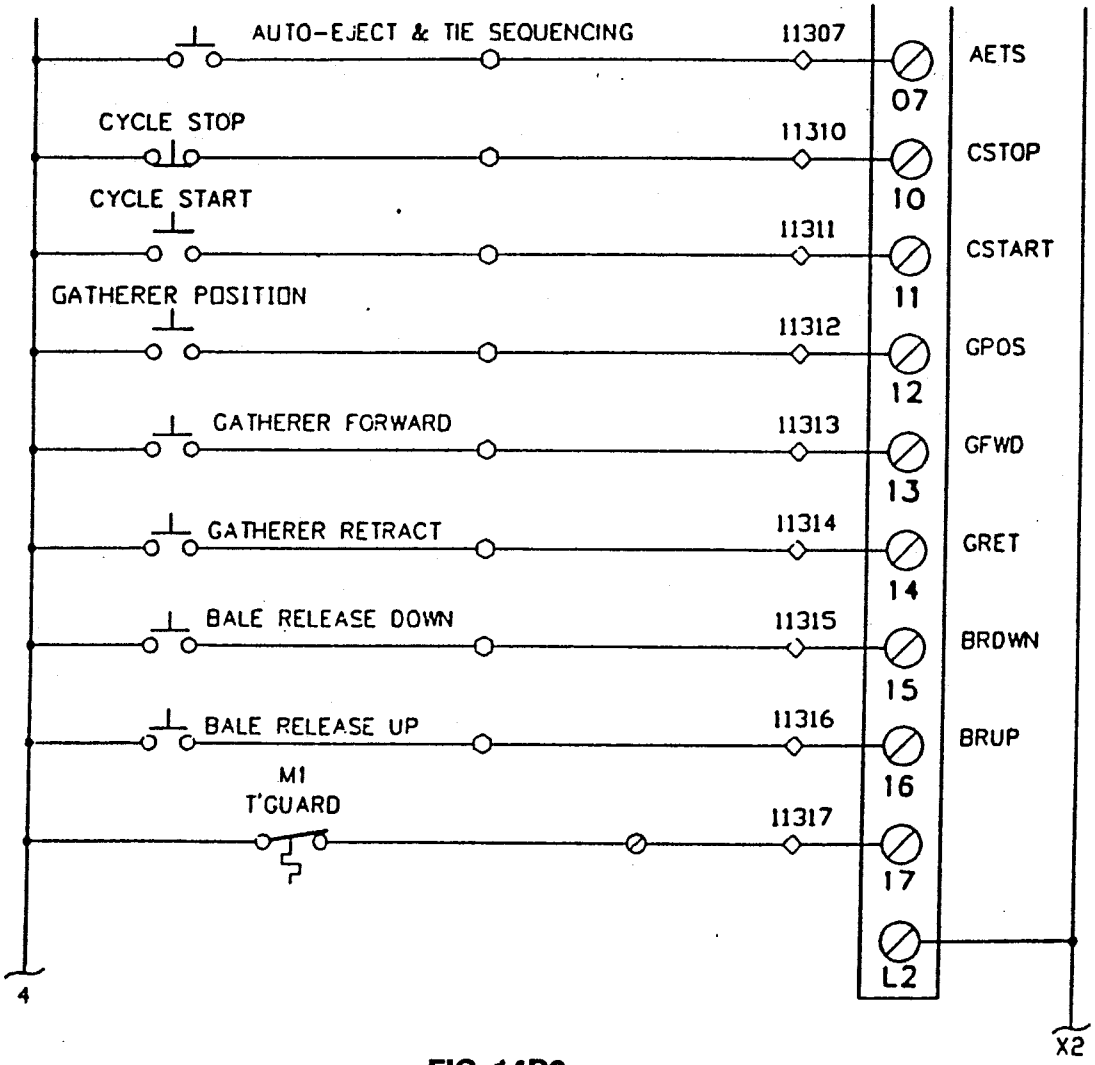
FIG. 14D2

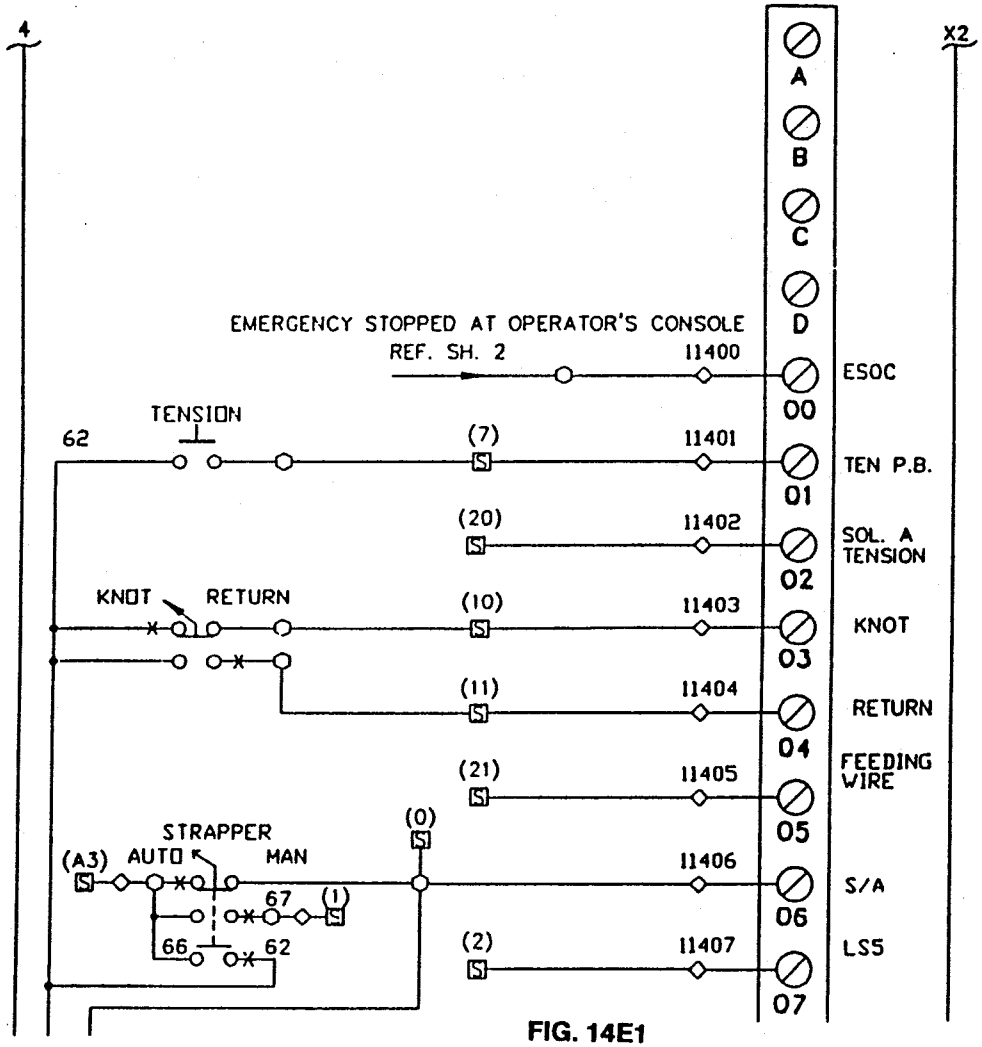
FIG. 14E1

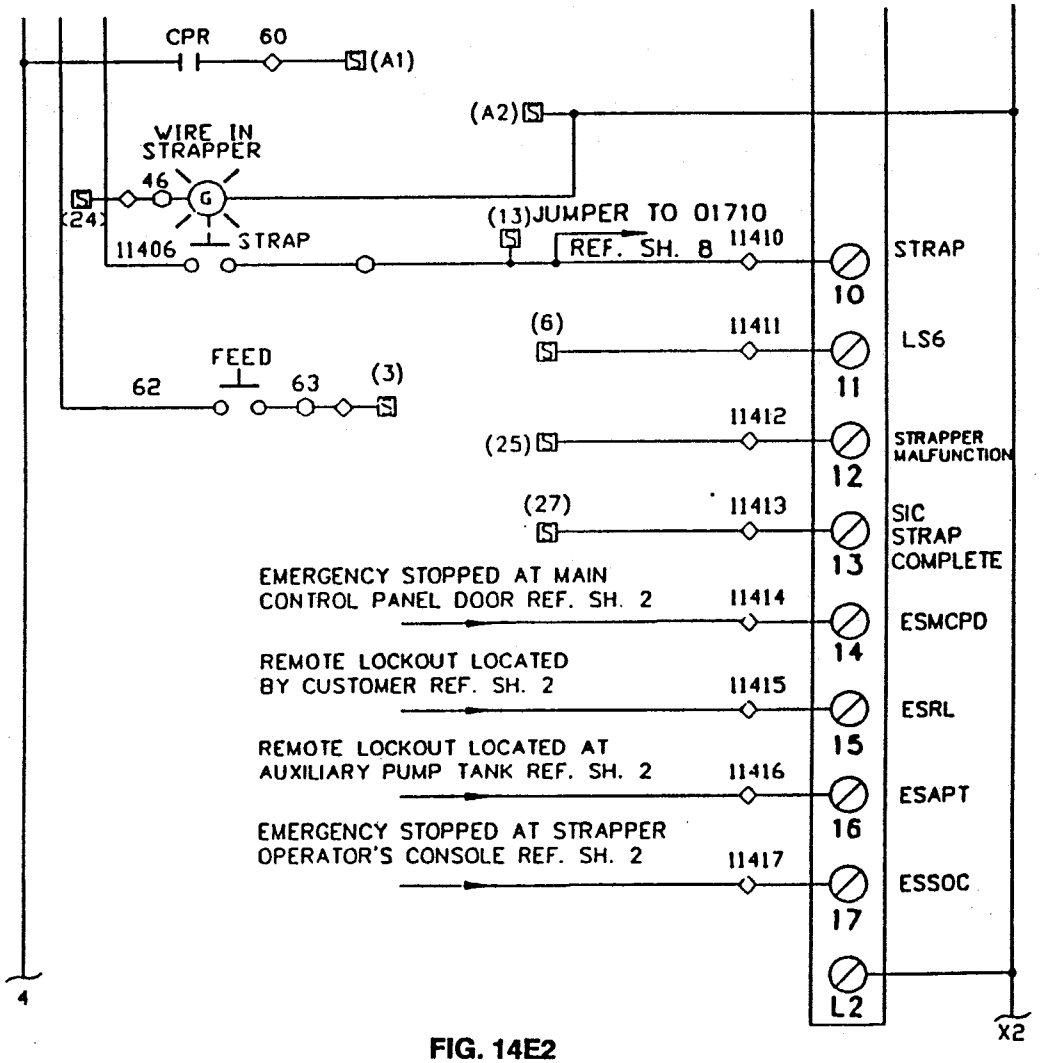
FIG. 14E2

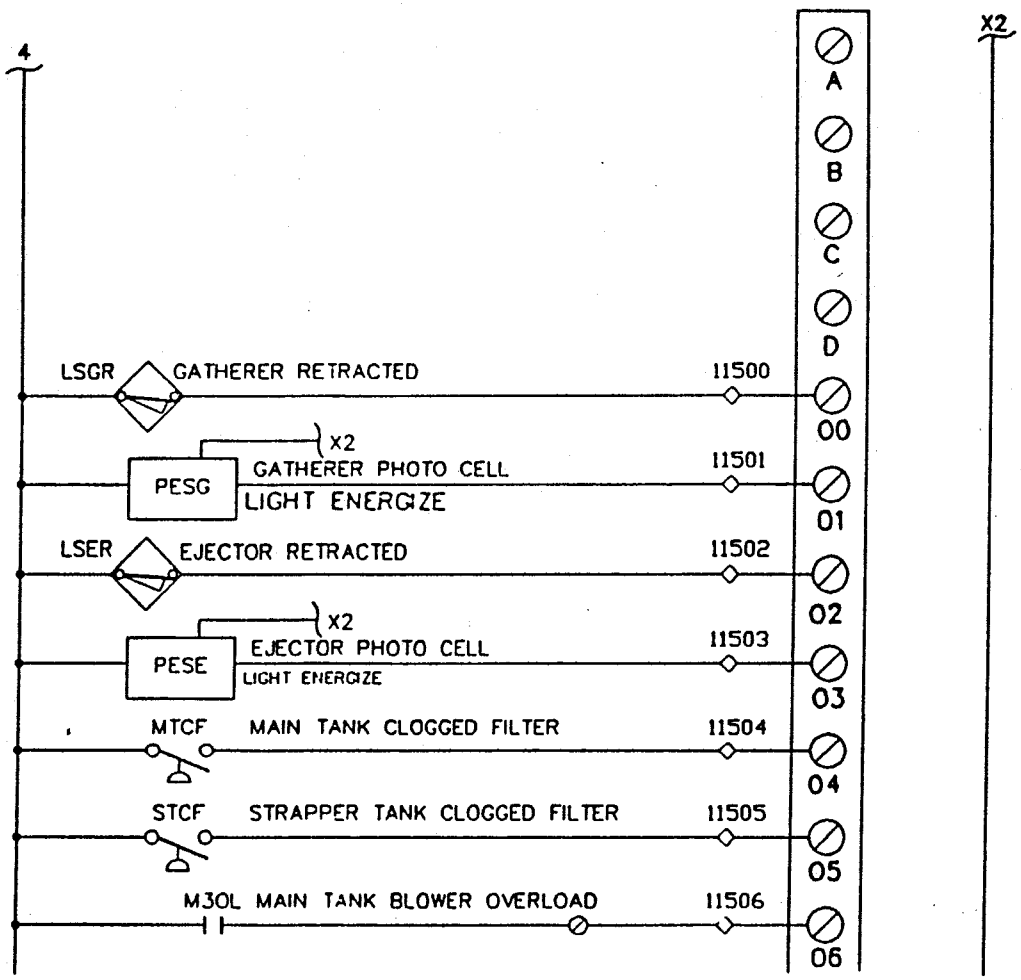
FIG. 14F1

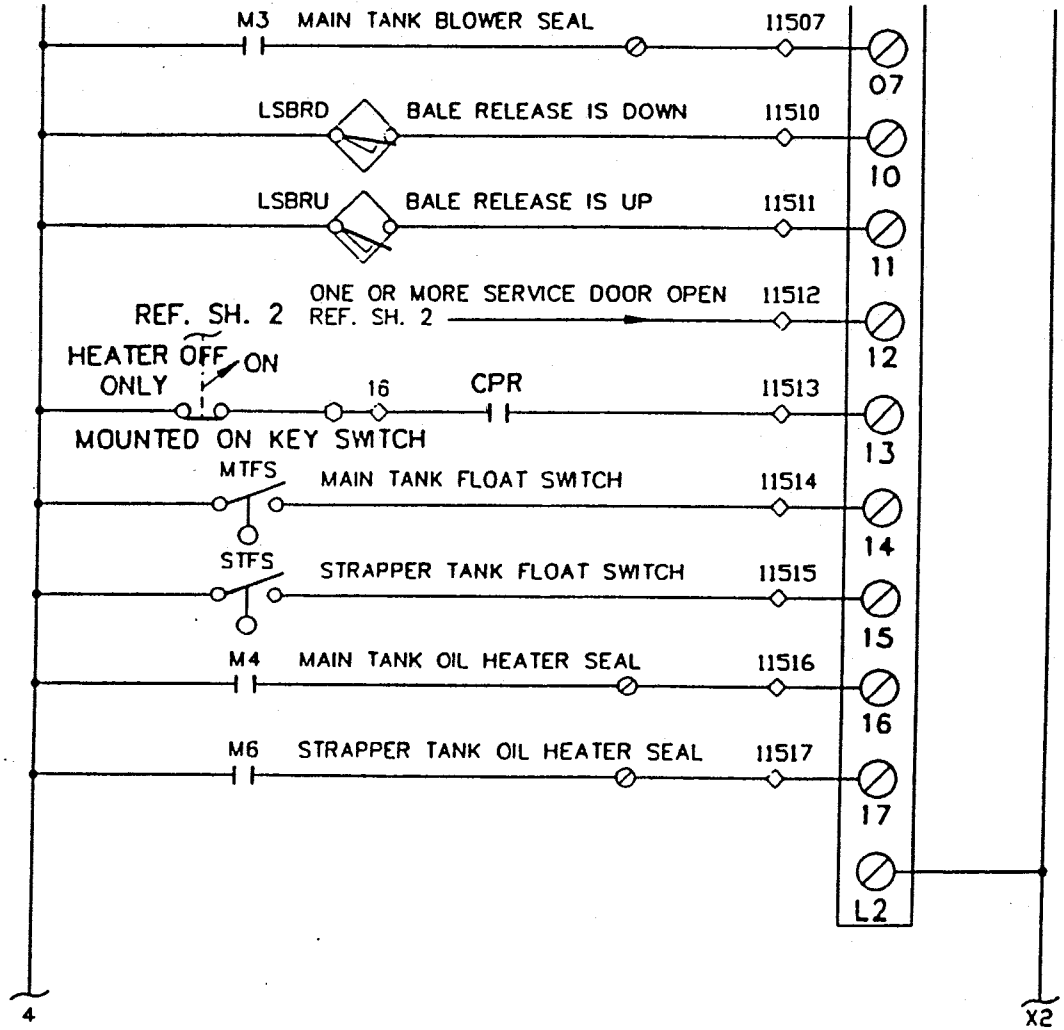
FIG. 14F2

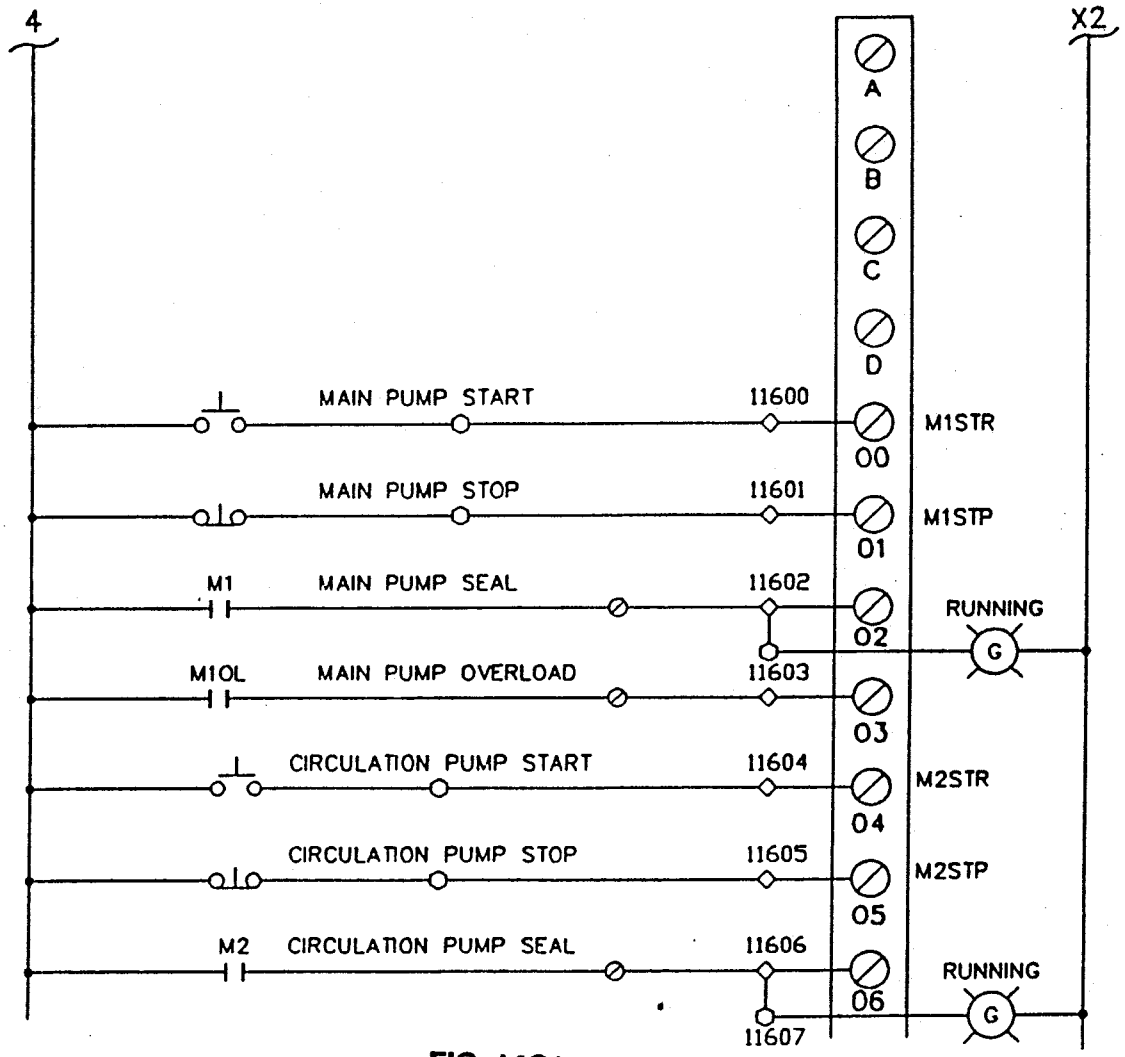
FIG. 14G1

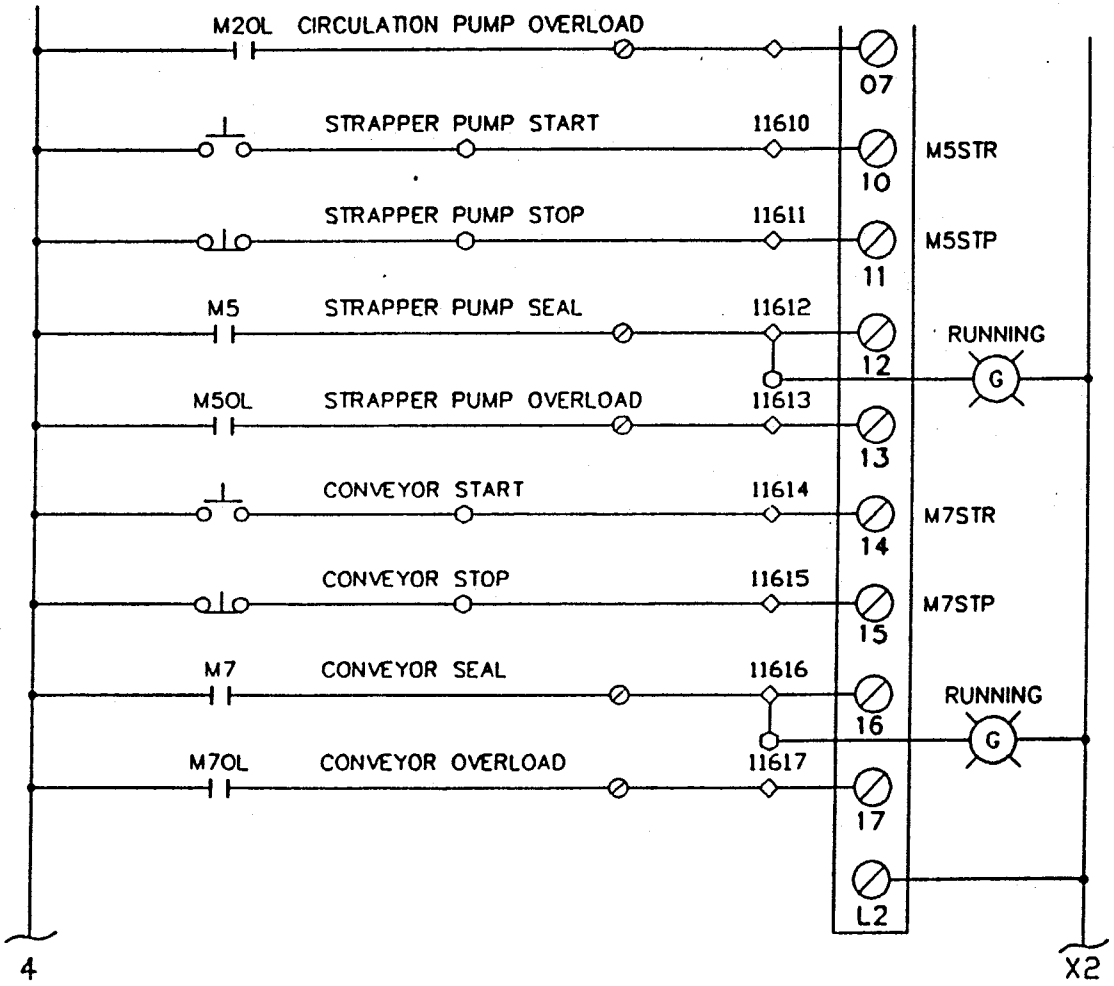
FIG. 14G2

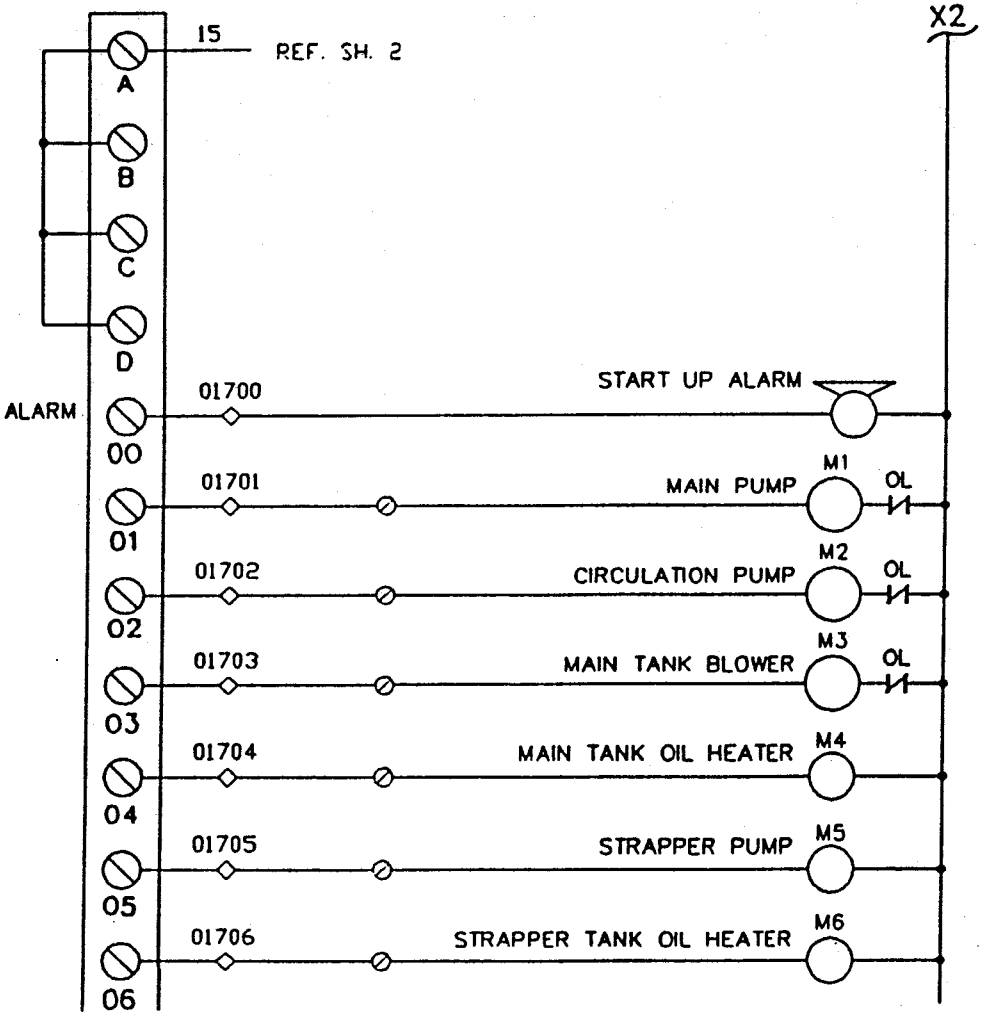
FIG. 14H1

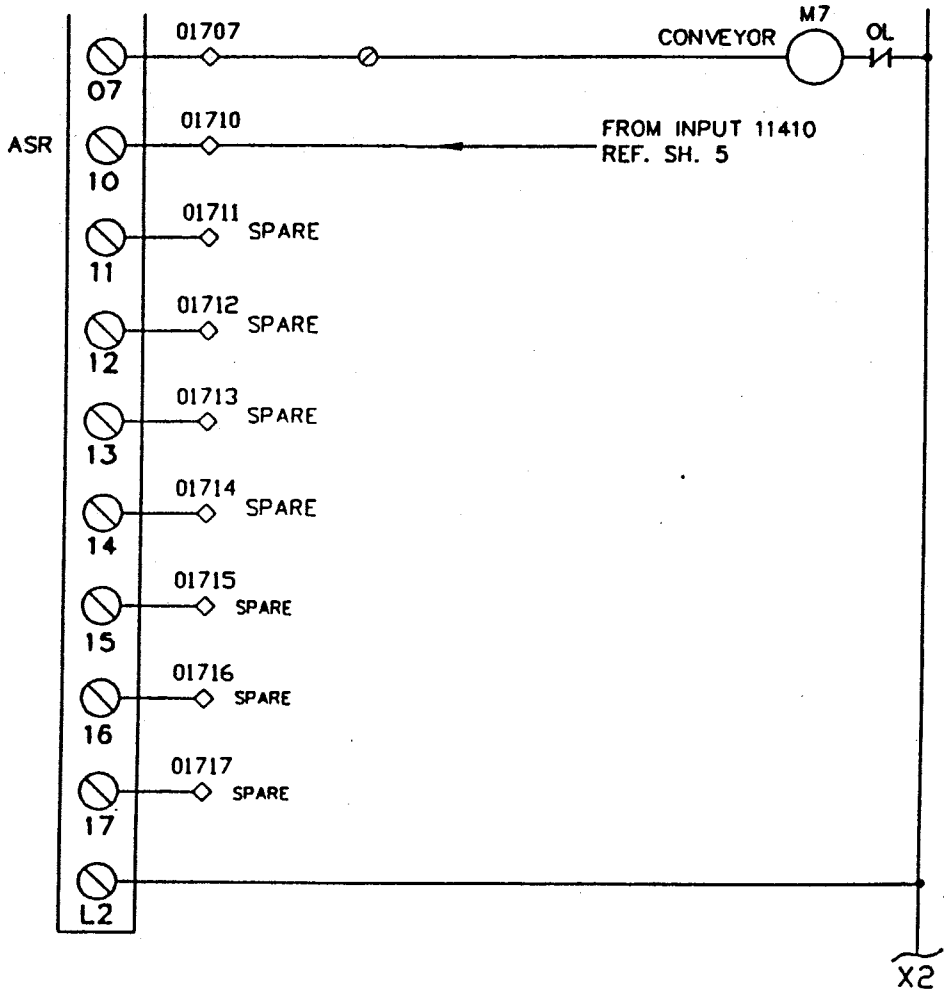
FIG. 14H2

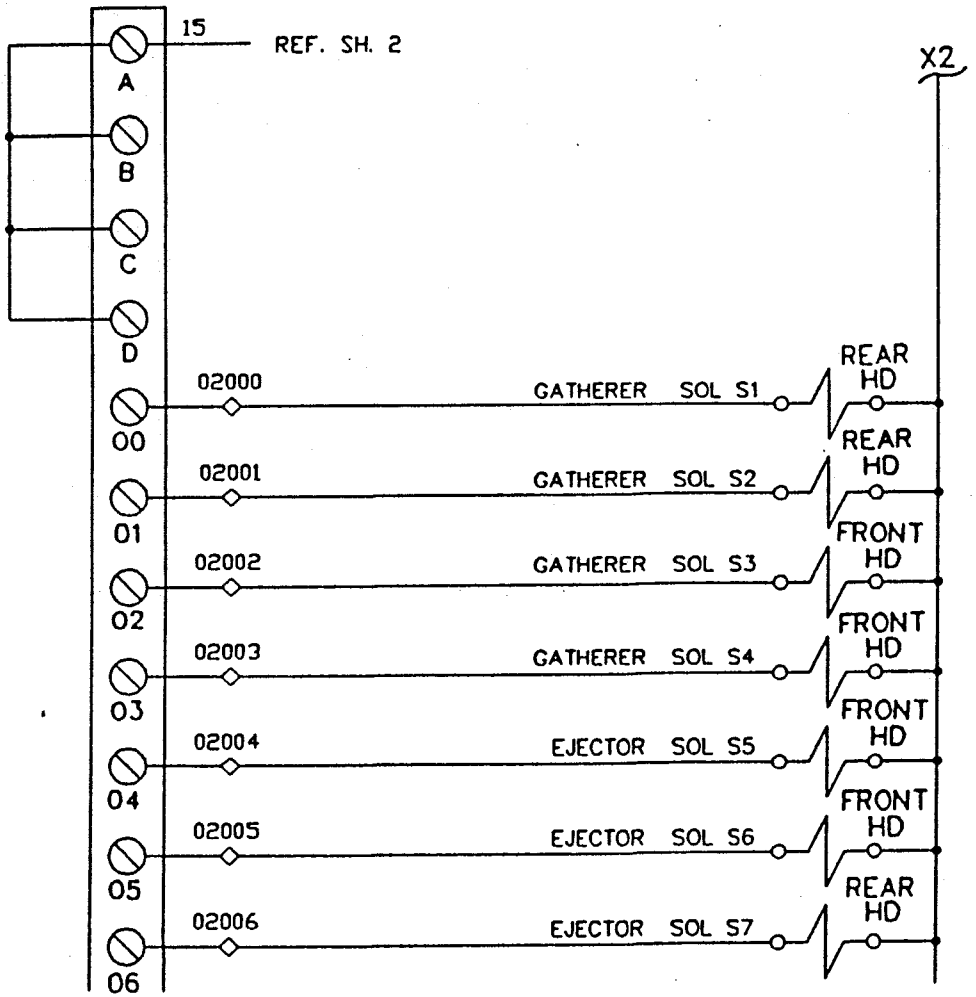
FIG. 14I1

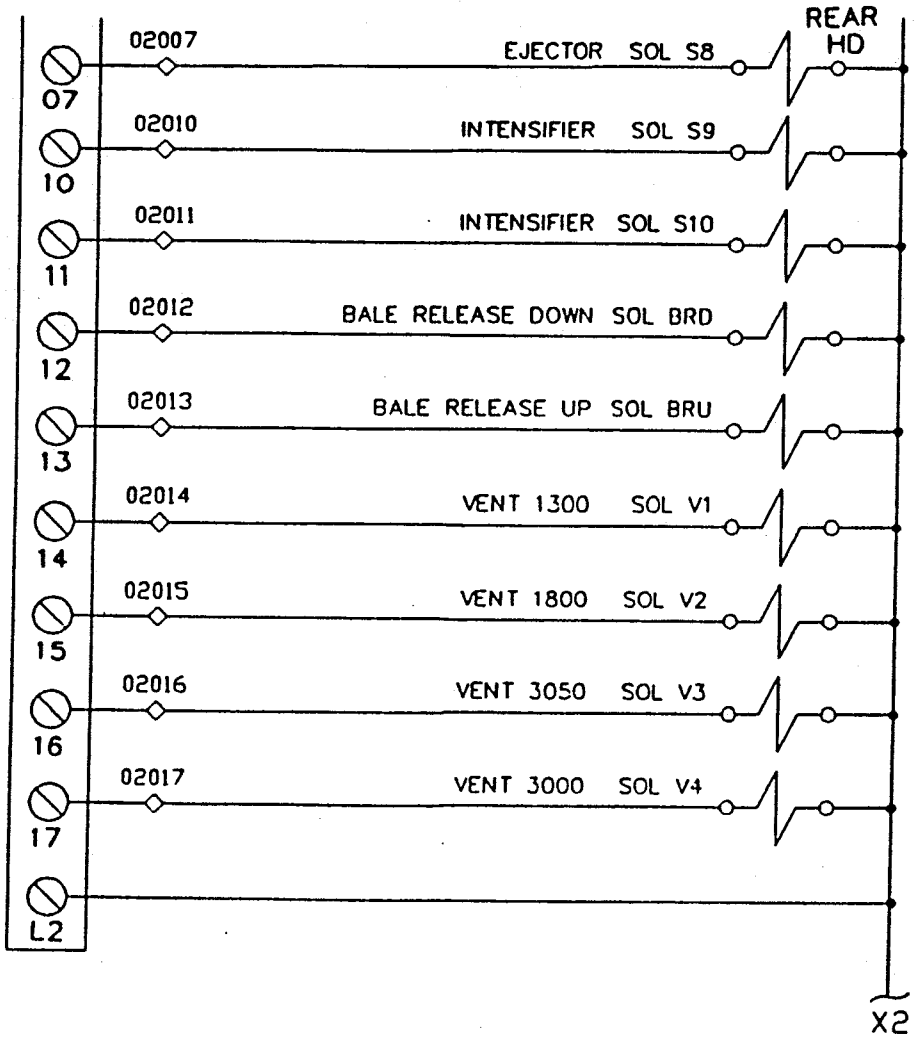
FIG. 14I2

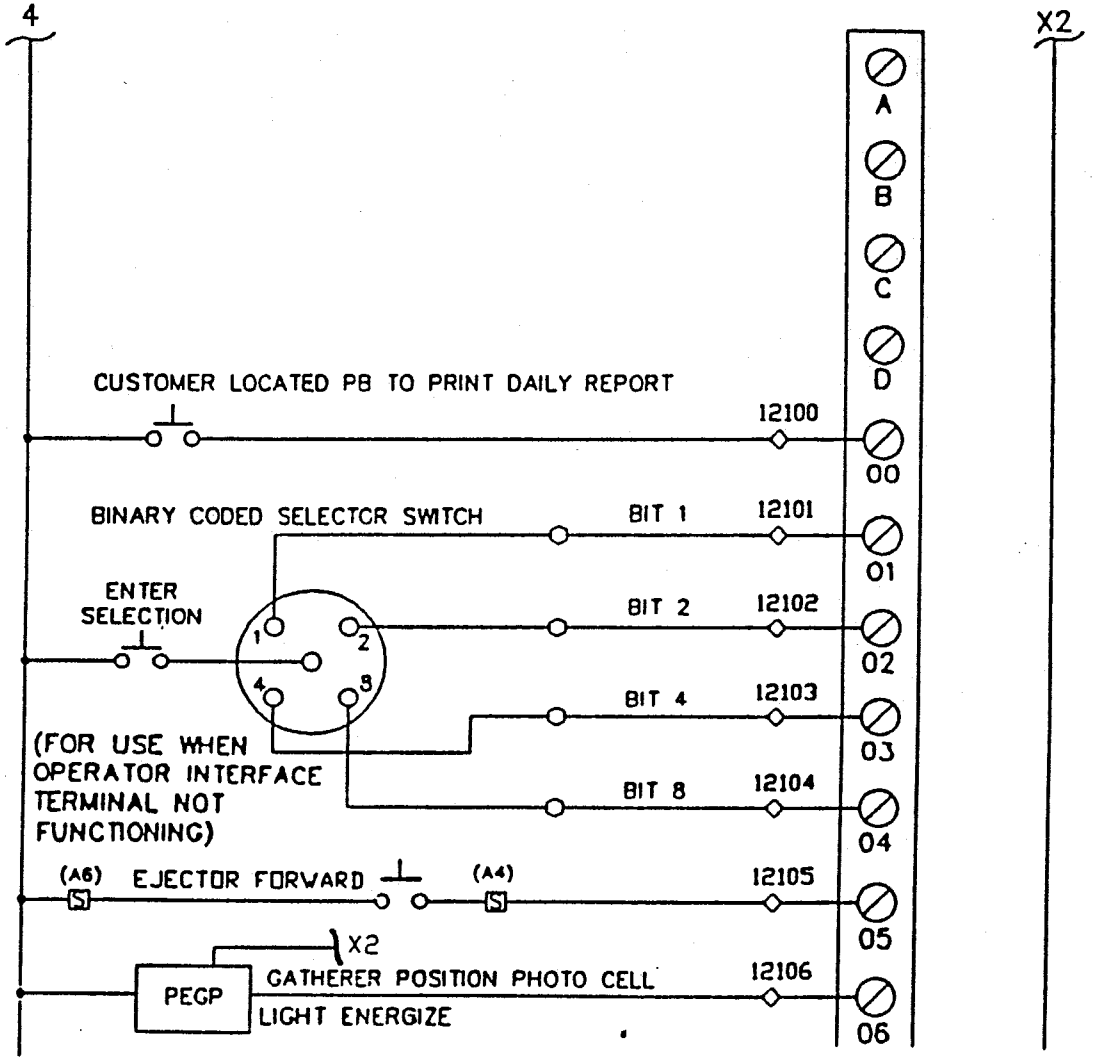
FIG. 14J1

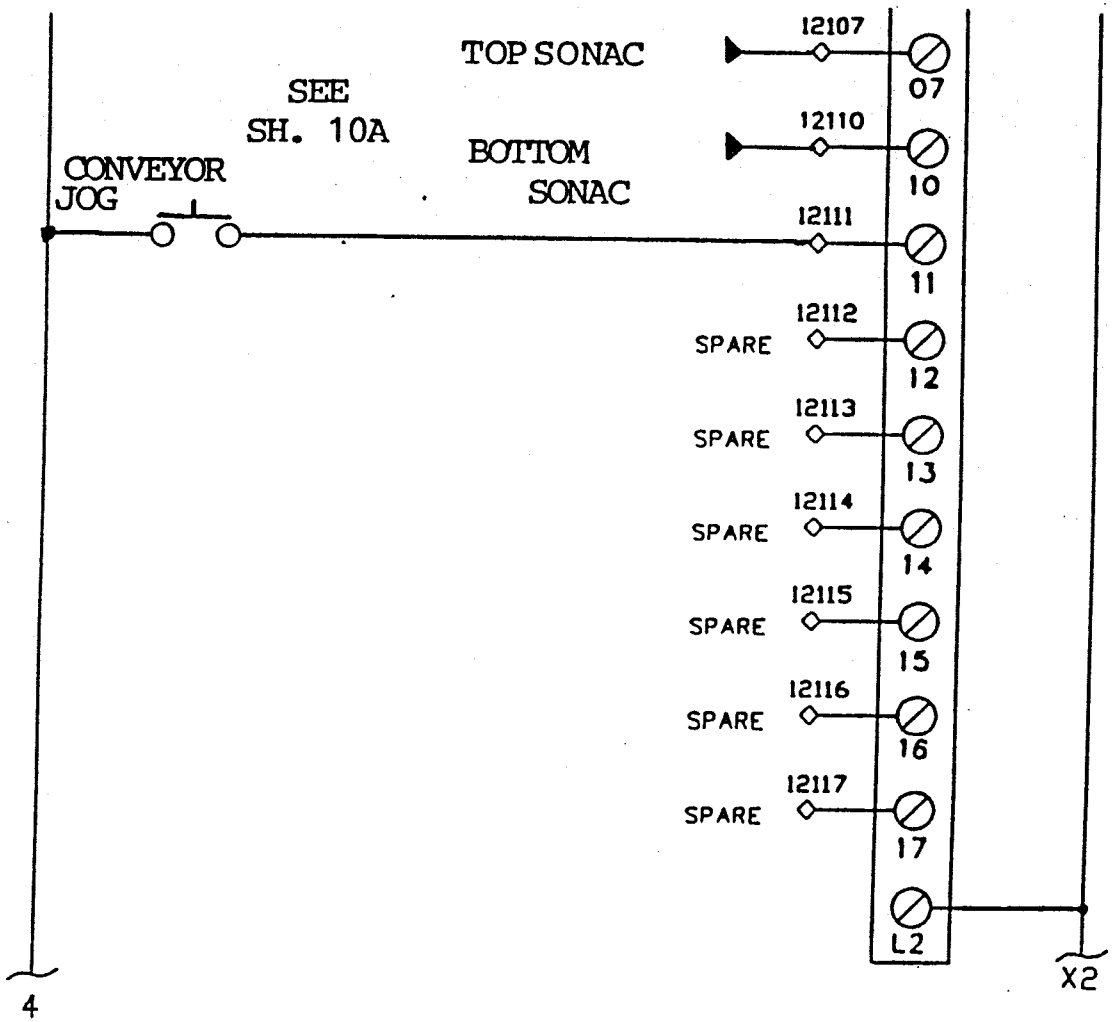
FIG. 14J2

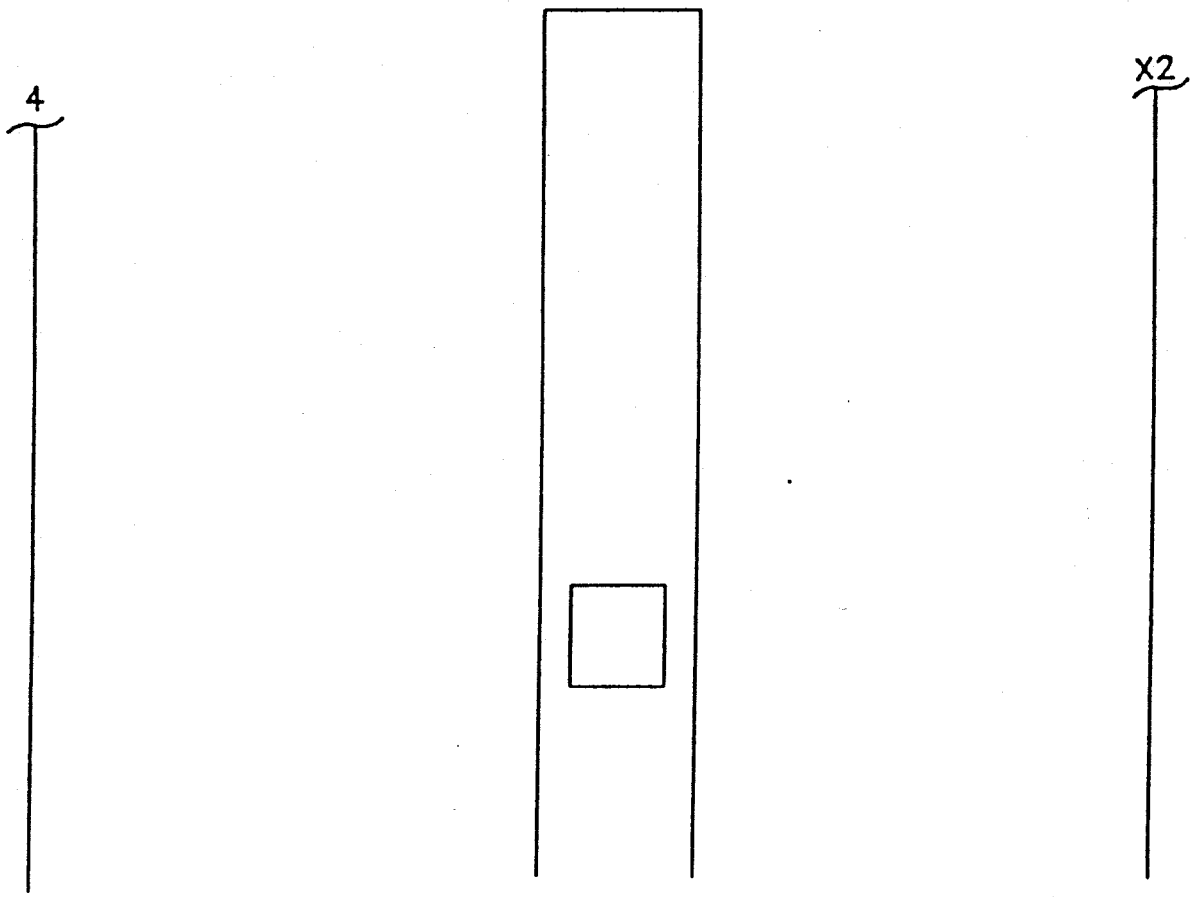
FIG. 14L1

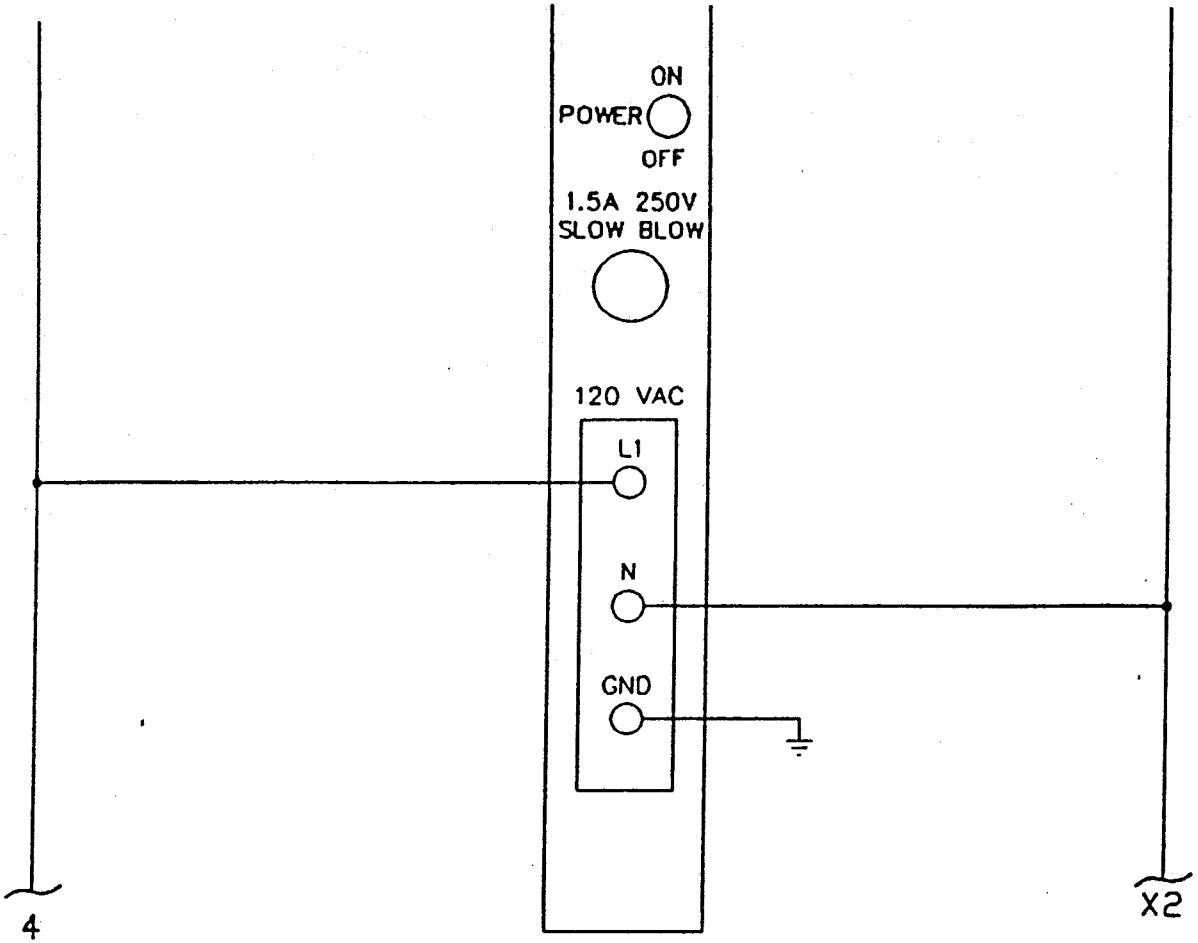
FIG. 14L2

BILL OF MATERIAL

| ITEM | QTY | ***MANUFACTURER AND CATALOGUE NO.*** | |
|---|---|---|---|
| 1 | 1 | WIEGMANN ENCLOSURE---------- | WA-366012-WF |
| | 1 | " PANEL---------- | NPDD-6036 |
| 2 | 1 | WEST. MOLDED CASE BREAKER---------- | KD3400F |
| | 1 | " TRIP UNIT---------- | KT3250T |
| | 6 | " LUGS---------- | T300K |
| | 1 | " VARI-DEPTH MECHANISM---------- | 509A62G01 |
| | 1 | " SHAFT---------- | 47A4446G37 |
| | 1 | " HANDLE---------- | 504C323G03 |
| 3 | 1 | HEVI-DUTY CONTROL TRANSFORMER---------- | E850 |
| 4 | 6 | BUSSMANN 30A 600V 3 POLE FUSE HOLDERS--- | JP60030-3CR |
| | 2 | " 3A FUSES CONTROL TX PRIMARY--- | LPJ-3 |
| | 3 | " 6A FUSES (BLOWER)---------- | LPJ-6 |
| | 3 | " 6A FUSES (2 KW OIL HEATER)---- | LPJ-6 |
| | 3 | " 10A FUSES (CIRCULATION PUMP)--- | LPJ-10 |
| | 3 | " 10A FUSES (6 KW OIL HEATER)---- | LPJ-10 |
| | 3 | " 17-1/2A FUSES (CONVEYOR)------- | LPJ-17-1/2 |
| 5 | 1 | " 60A 600V 3 POLE FUSE HOLDER---- | J60060-3CR |
| | 3 | " 45A FUSES---------- | JHC-45 |
| 6 | 1 | MARATHON POWER DISTRIBUTION BLOCK------- | 1423570 |
| 7 | 1 | ALLEN BRADLEY CO. IEC CONTACTOR (MAIN)-- | 100-B180ND3 |
| | 1 | " " " " OVERLOAD --------- | 193-DPD200 |
| 8 | 1 | " " " " CONTACTOR (STRAP)- | 100-A18ND3 |
| | 1 | " " " " OVERLOAD---------- | 193-BSC15 |
| 9 | 1 | " " " " CONTACTOR (BLOWER) | 100-A09ND3 |
| | 1 | " " " " OVERLOAD---------- | 193-BSB60 |
| 10 | 1 | " " " " CONTACTOR (CIRC.)- | 100-A09ND3 |
| | 1 | " " " " OVERLOAD---------- | 193-BSB80 |
| 11 | 1 | " " " " CONTACTOR (CONV.)- | 100-A18ND3 |
| | 1 | " " " " OVERLOAD---------- | 193-BSC15 |
| 12 | 2 | " " " " CONTACTORS (HTRS)- | 100-A09ND3 |
| 13 | 1 | " " " RED MUSHROOM PB------- | 800T-FX6A1 |
| 14 | LOT | BUCHANAN 600V TERMINAL BLOCKS---------- | 0714 |
| | 1 | " 600V FUSED TERMINAL BLOCK------ | 0352 |
| | 1 | " END SECTION---------- | 0330 |
| | | ***ITEMS SHIPPED LOOSE*** | |
| | 2 | CROUSE HINDS FS BOX---------- | FS-1019 |
| | 2 | CROUSE HINDS COVER---------- | DS185 |
| | 2 | HUBBLE 3 WAY TOGGLE SWITCH---------- | 1453 |
| | 1 | PRACTICAL PERIPHERALS MODEM---------- | 1200SA MINI |
| | | W/10 FOOT COMMUNICATION CABLE | |
| | 1 | ALLEN BRADLEY CO. RED ILLUM. PUSH/PULL-- | 800T-FX6A1 |

FIG. 14M

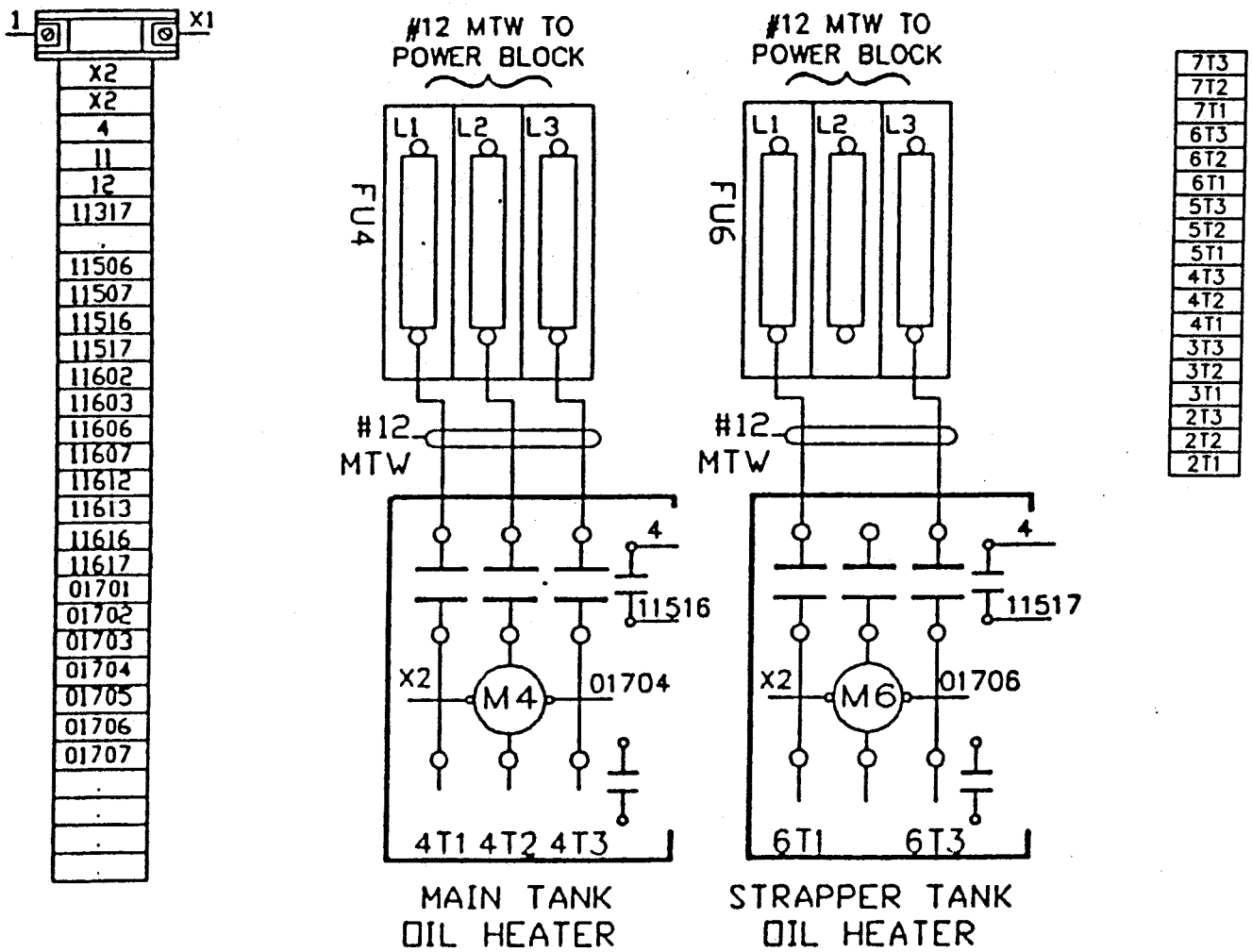
FIG. 14O1

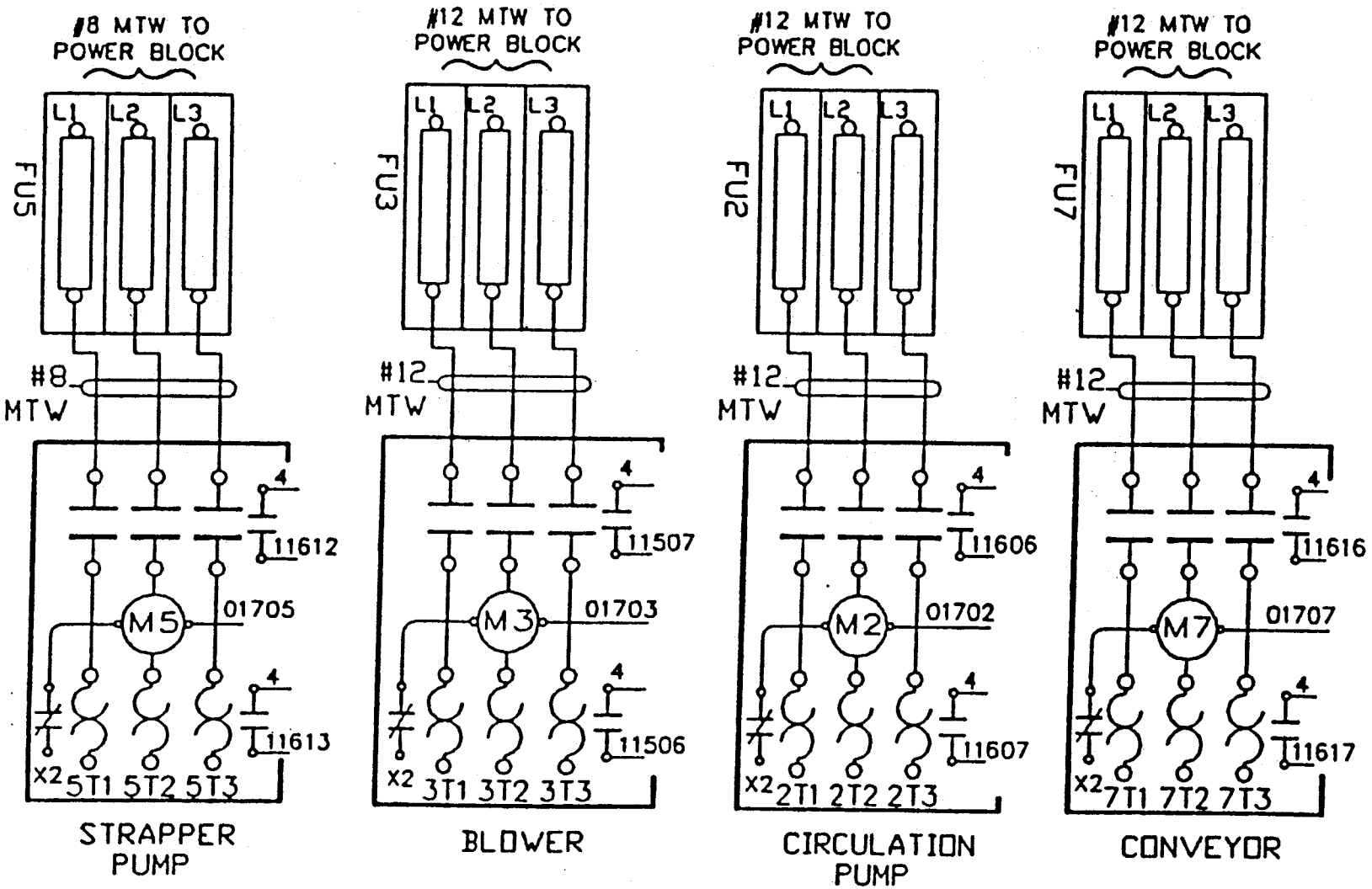
FIG. 1402

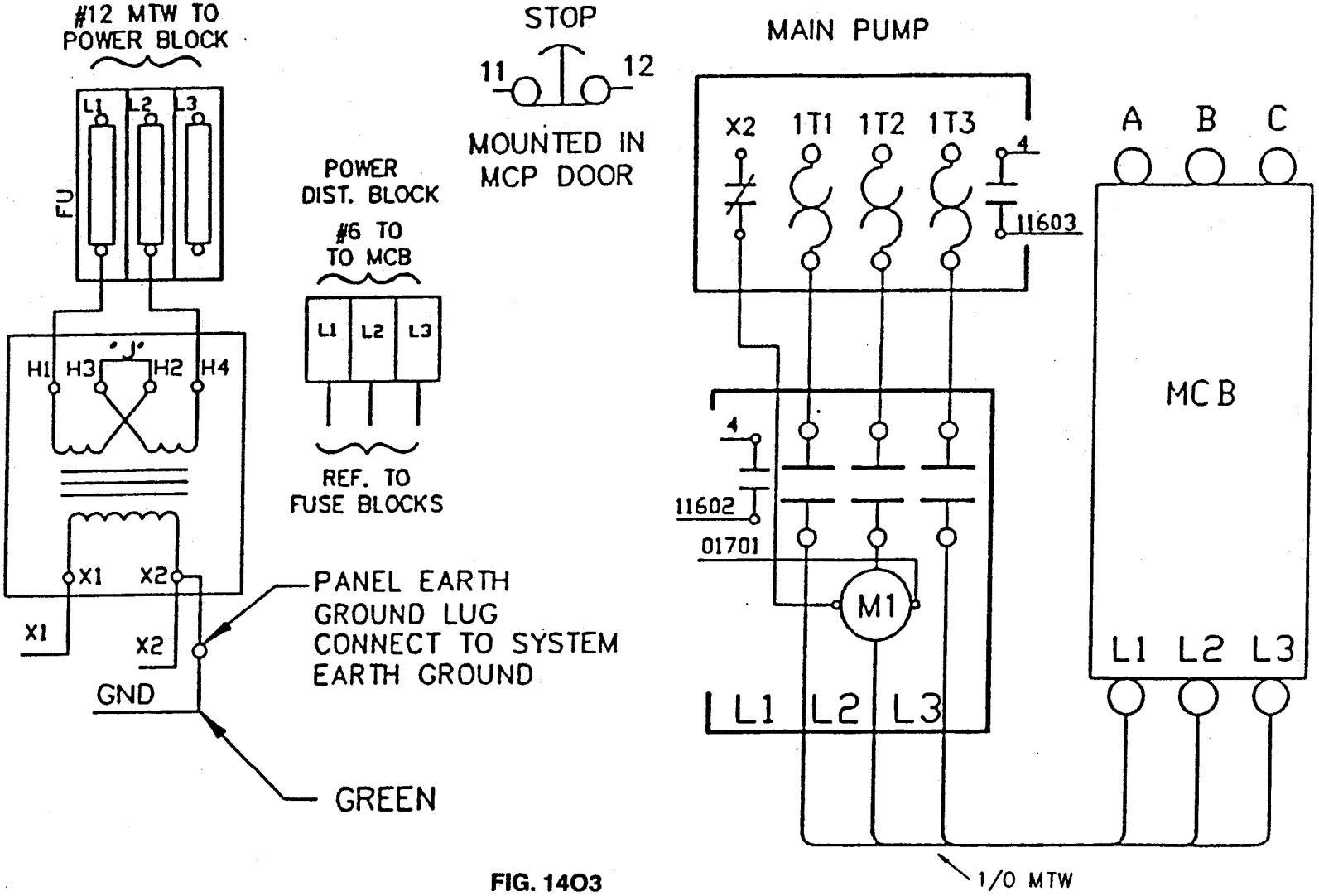
FIG. 14O3

*BILL OF MATERIAL*

| ITEM | QTY | ***MANUFACTURER AND CATALOGUE NO.*** | | |
|---|---|---|---|---|
| 1 | 1 | MULTITECH SYSTEMS | ENCLOSURE----------DWG. | PC1100-1011 |
| | | | PANEL---------- | NP-4236 |
| 2 | 1 | ALLEN BRADLEY | 8 AMP POWER SUPPLY-------- | 1771-P4S |
| 3 | 1 | | 12 SLOT I/O CHASSIS-------- | 1771-A3B1 |
| 4 | 5 | | 16 PT INPUT MODULES-------- | 1771-IAD |
| 5 | 2 | | 16 PT OUTPUT MODULES------- | 1771-OAD |
| | 2 | | 16 PT FUSE ARMS---------- | 1771-WHF |
| 6 | 1 | | 16 PT ANALOG INPUT--------- | 1771-IFE |
| 7 | 1 | | PLC-2/16 4K PROCESSOR------ | 1772-LX |
| | 1 | | EEPROM MEMORY MODULE------- | 1772-MJ |
| 8 | 2 | | RS-232 COMMUNICATION------- | 1771-KG |
| 9 | 1 | CONDOR | 24VDC POWER SUPPLY--------- | HB24-1.2A |
| 10 | 1 | STEEL CITY | HANDY BOX---------- | 52151-1/2 |
| | 1 | | COVER---------- | RS2 |
| | 1 | LEVITON | DUPLEX RECEPTACLE---------- | 5320 |
| | 1 | | TOGGLE SWITCH---------- | 1453 |
| 11 | LOT | BUCHANAN | TERMINAL BLOCKS---------- | 0714 |
| 12 | 2 | OMEGA | RTD TRANSMITTERS---------- | TX 58 |
| | 2 | | PLATINUM RTD SENSORS------- | TX-58-Pt2 |
| 13 | 1 | ALLEN BRADLEY | 600V 6 POLE RELAY---------- | 700P600A1 |
| 14 | LOT | BUCHANAN | 300V TERMINAL BLOCKS------- | 0512 |

FIG. 14P

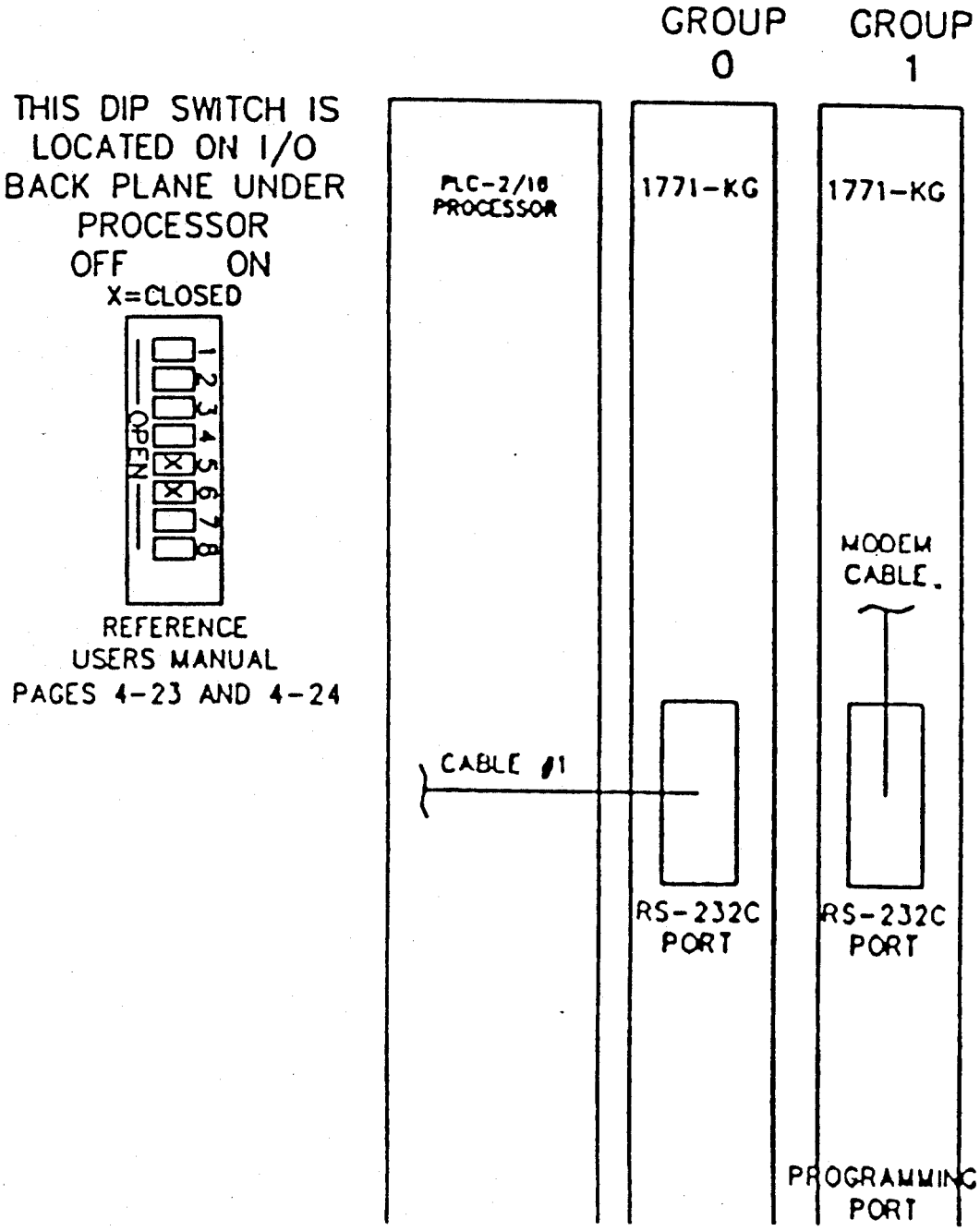
FIG. 14R1

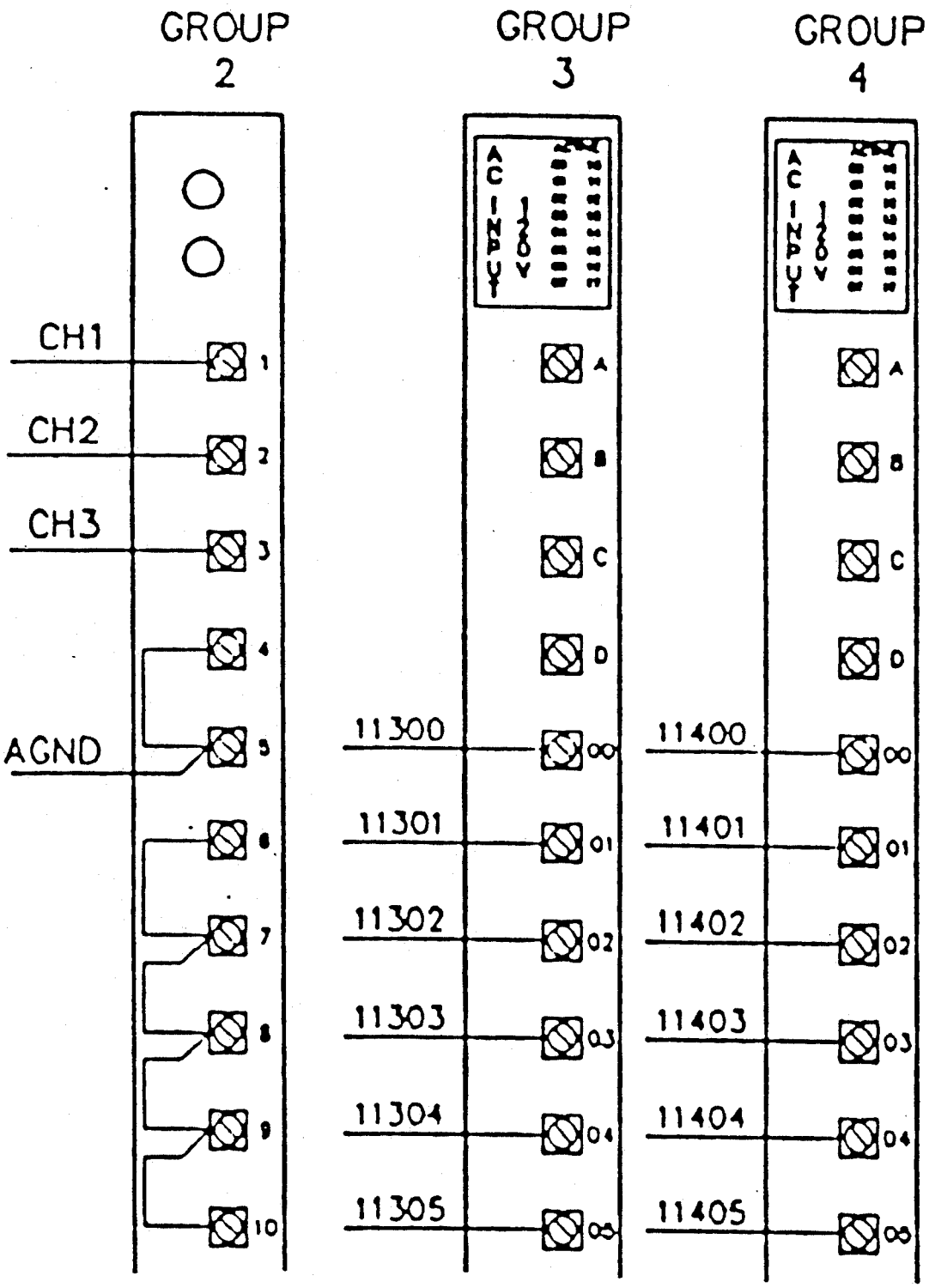
FIG. 14R2

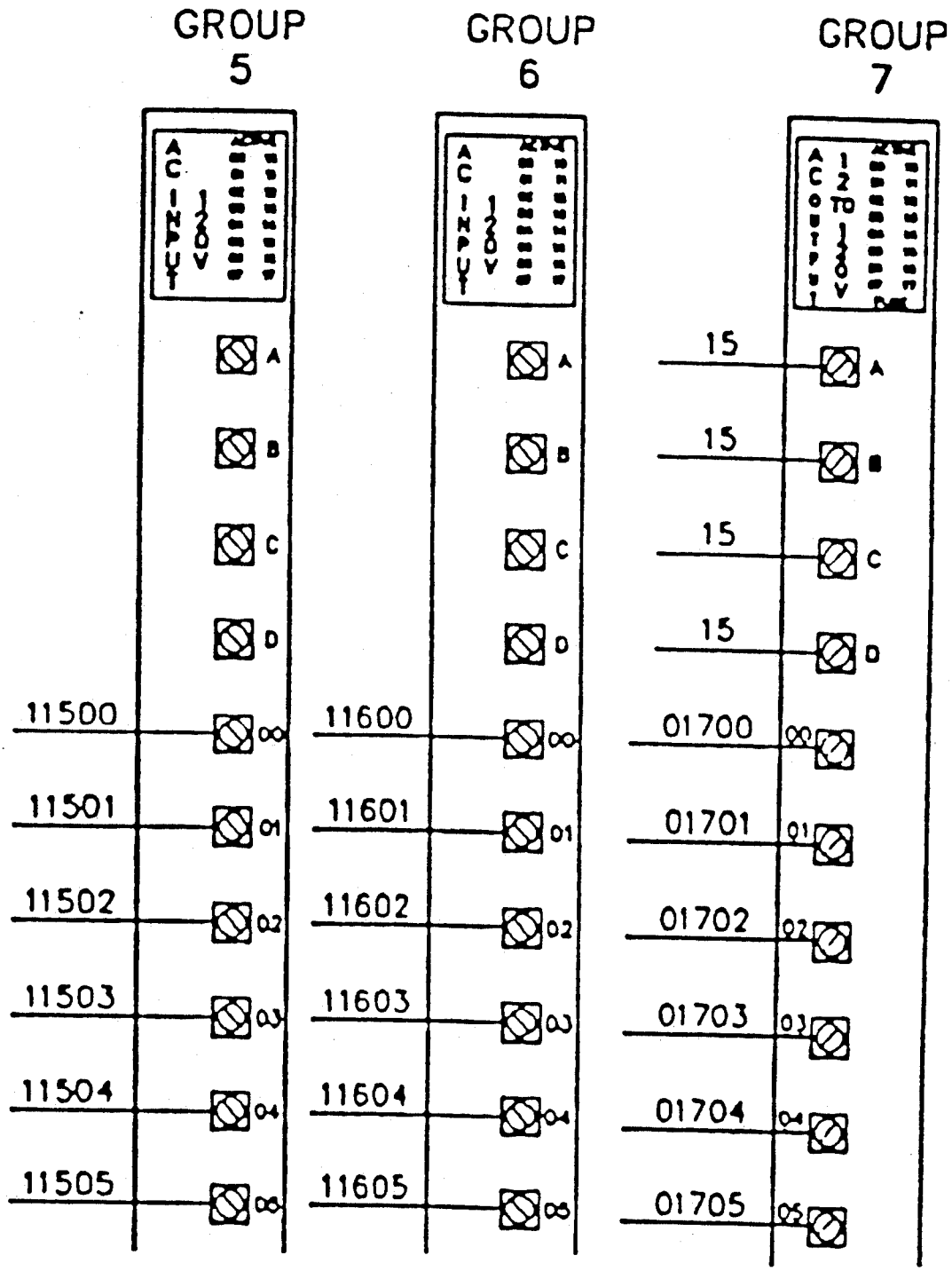
FIG. 14R3

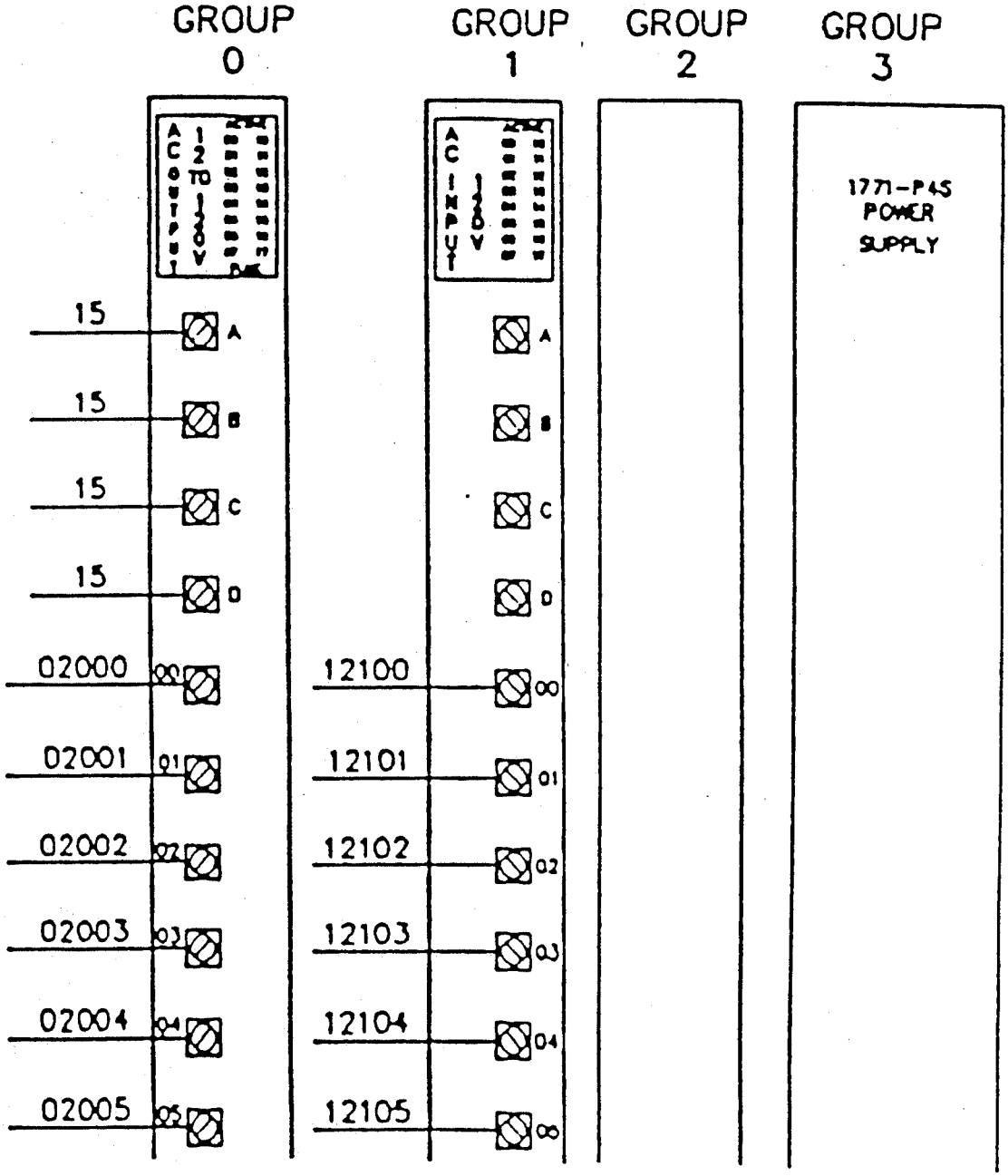
FIG. 14R4

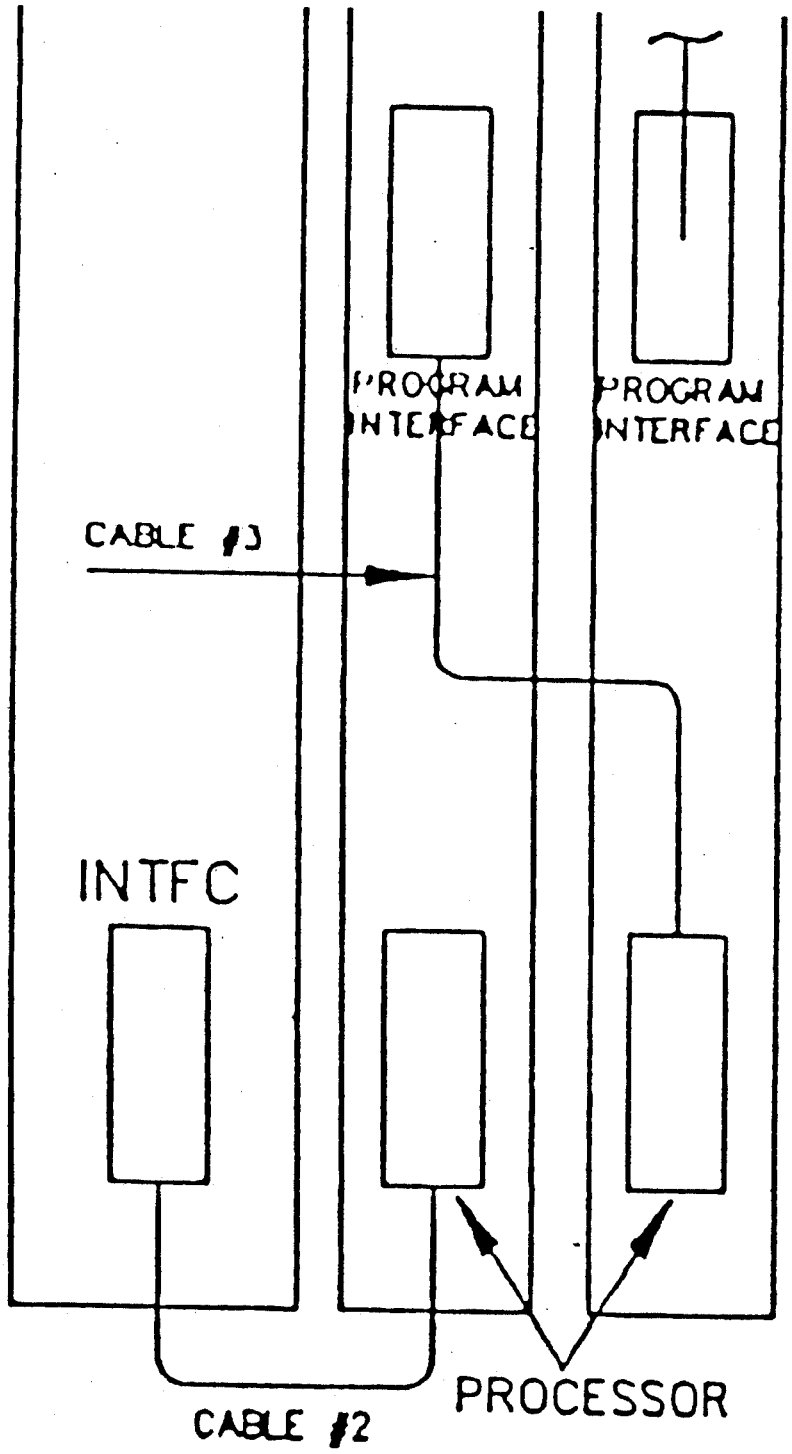
FIG. 14R5

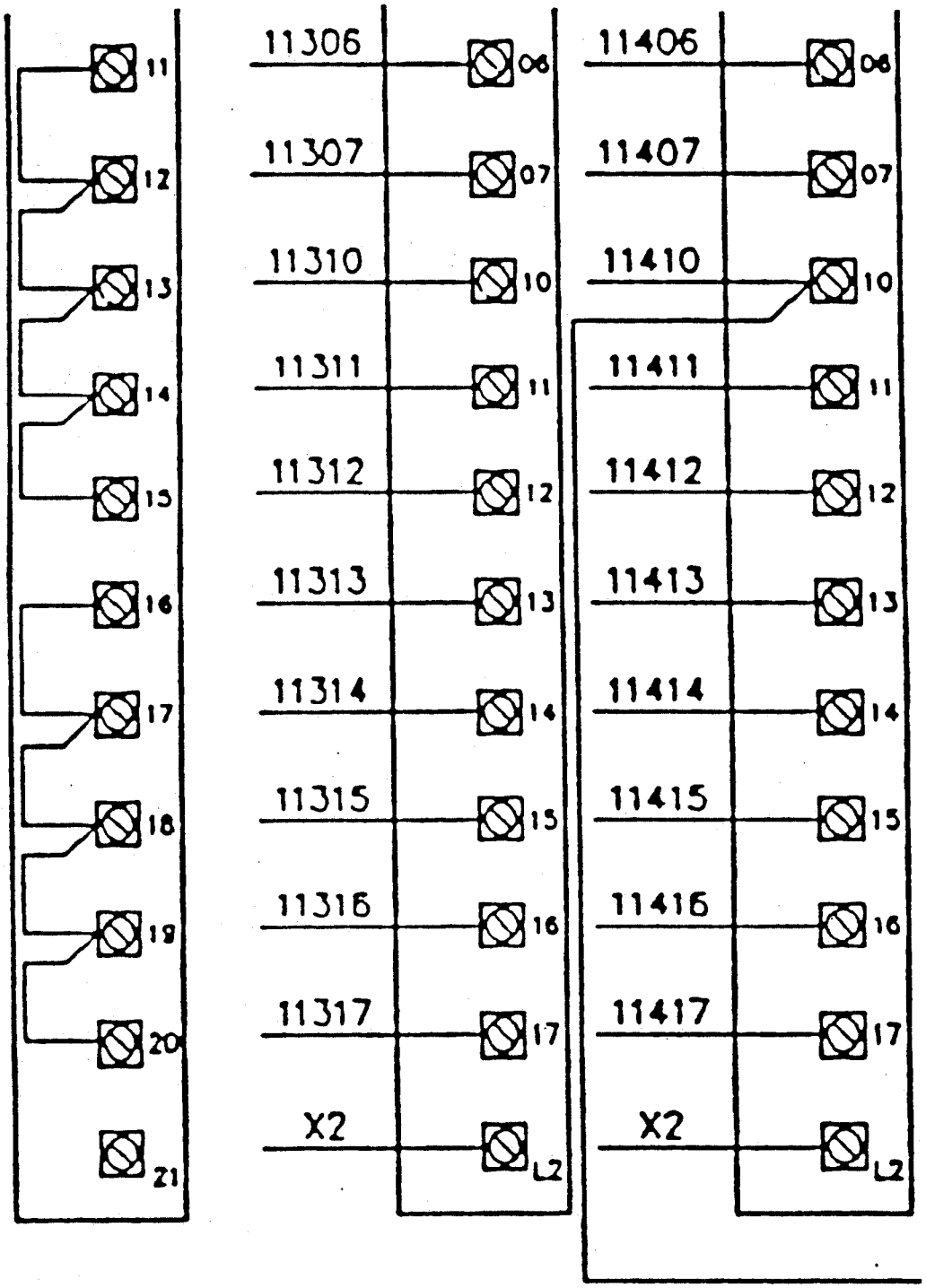
FIG. 14R6

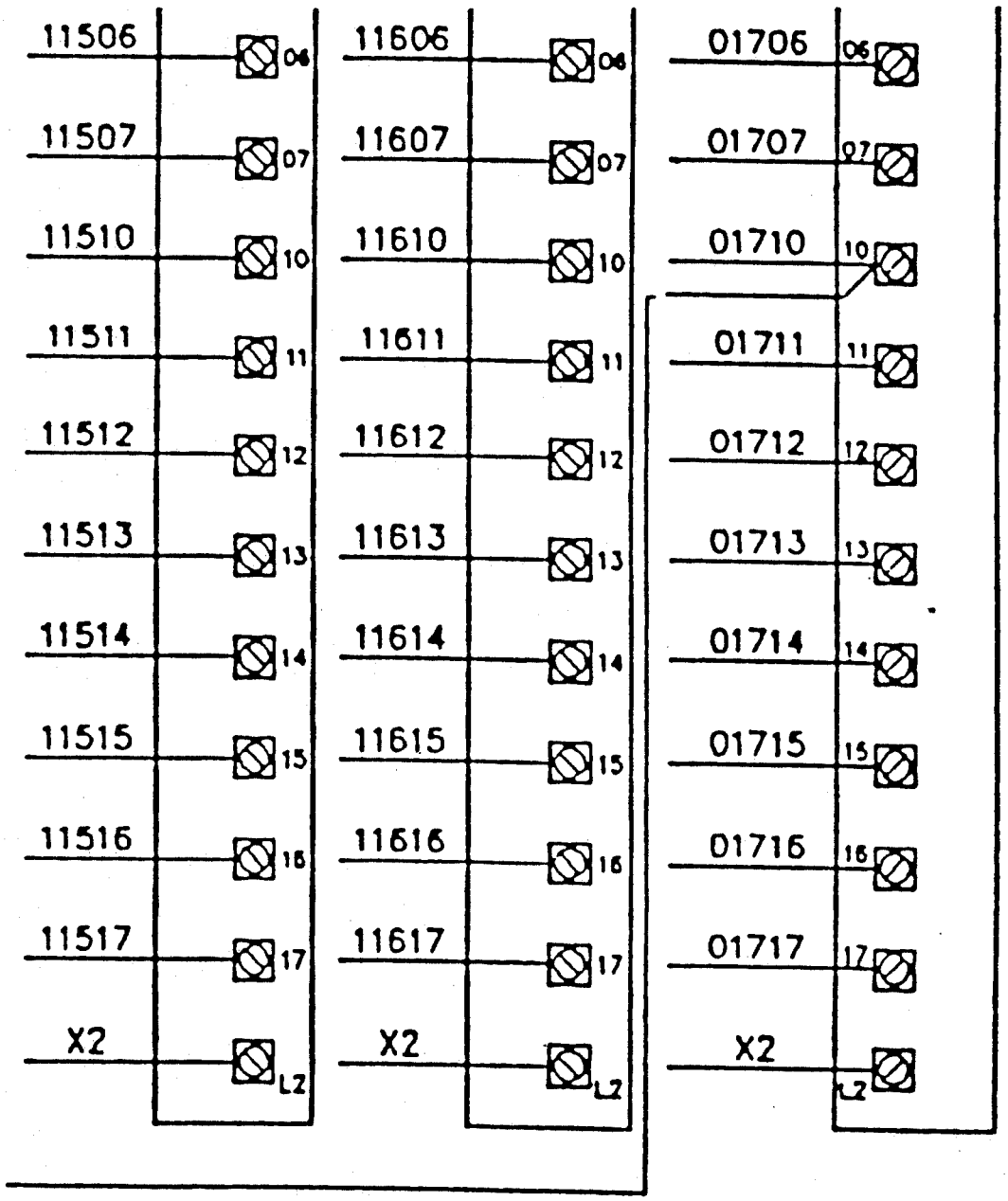
FIG. 14R7

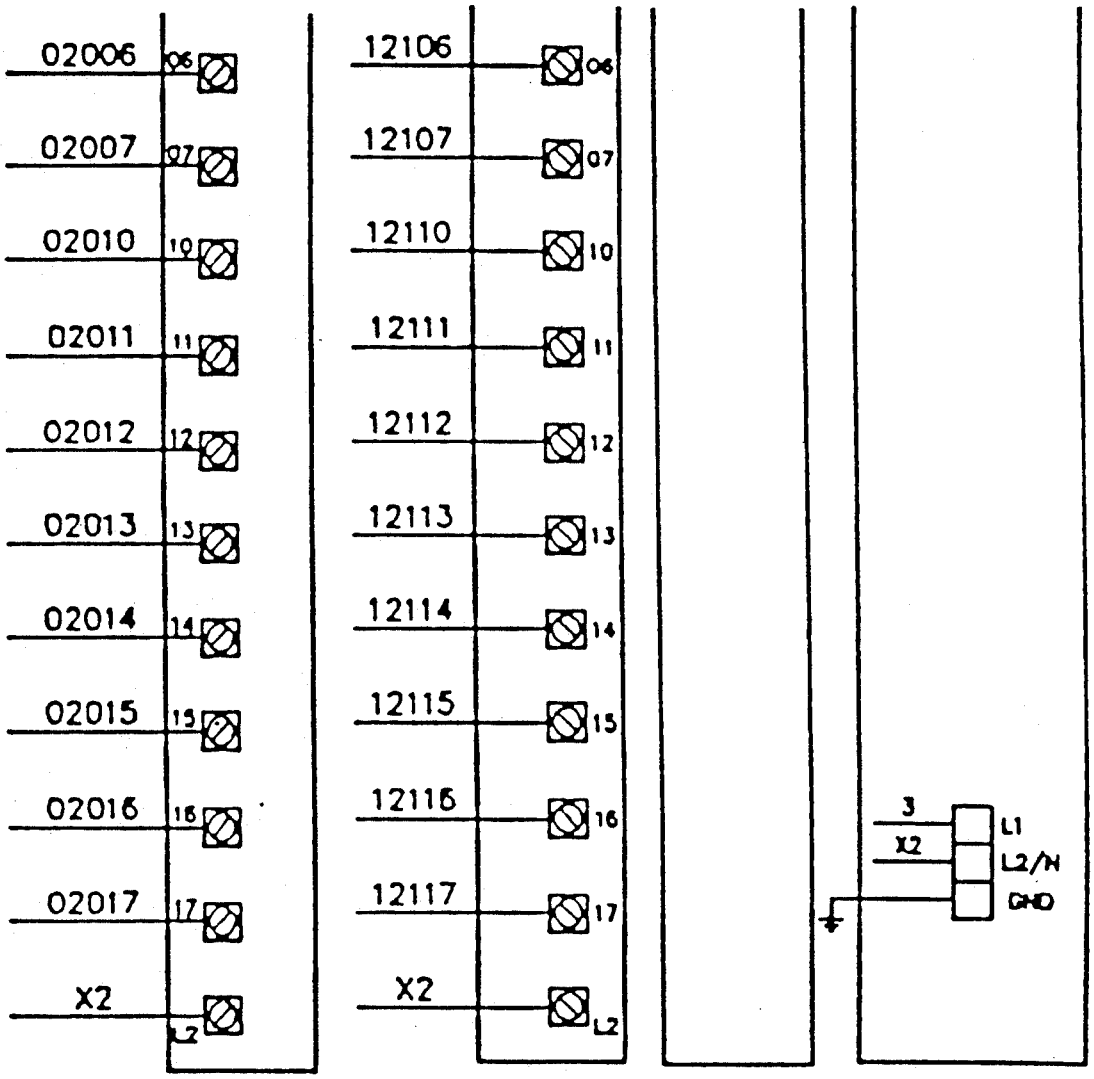
FIG. 14R8

| |
|---|
| X2 |
| X2 |
| X2 |
| X2 |
| 4 |
| 4 |
| 4 |
| 4 |
| 5 |
| 6 |
| 7 |
| 8 |
| 9 |
| 10 |
| 11 |
| 15 |
| 11415 |
| 11416 |
| 11500 |
| 11501 |
| 11502 |
| 11503 |
| 11504 |
| 11505 |
| 11510 |
| 11511 |

| |
|---|
| X2 |
| 1 |
| 4 |
| 11 |
| 12 |
| 11317 |
| 11414 |
| 11506 |
| 11507 |
| 11516 |
| 11517 |
| 11602 |
| 11603 |
| 11606 |
| 11607 |
| 11612 |
| 11613 |
| 11616 |
| 11617 |
| 01701 |
| 01702 |
| 01703 |
| 01704 |
| 01705 |
| 01706 |
| 01707 |

| |
|---|
| X2 |
| 3 |
| 4 |
| 12 |
| 13 |
| 14 |
| 16 |
| 46 |
| 60 |
| 63 |
| 66 |
| 67 |
| 11300 |
| 11301 |
| 11302 |
| 11303 |
| 11304 |
| 11305 |
| 11306 |
| 11307 |
| 11310 |
| 11311 |
| 11312 |
| 11313 |
| 11314 |
| 11315 |

FIG. 14S1

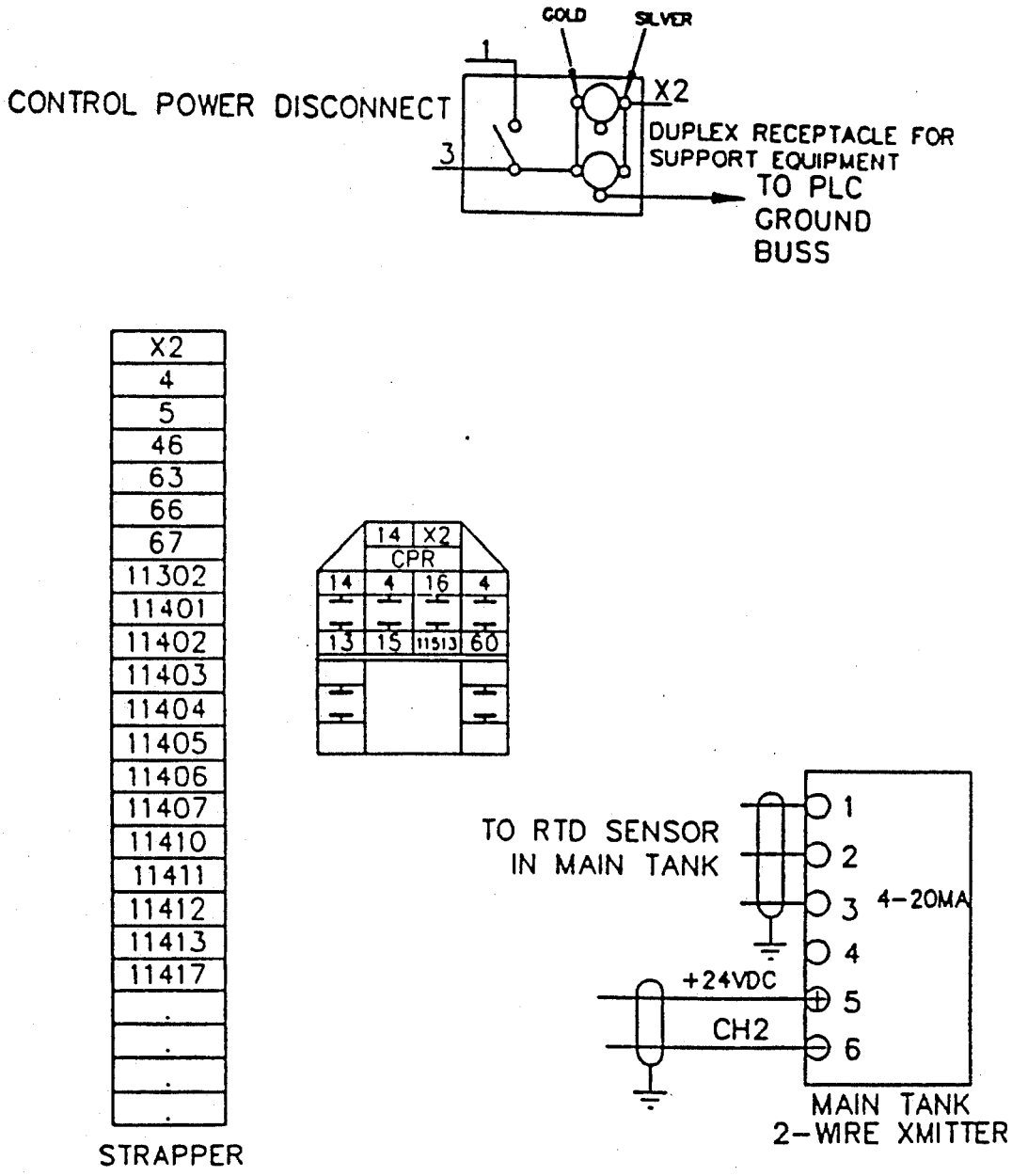
FIG. 14S2

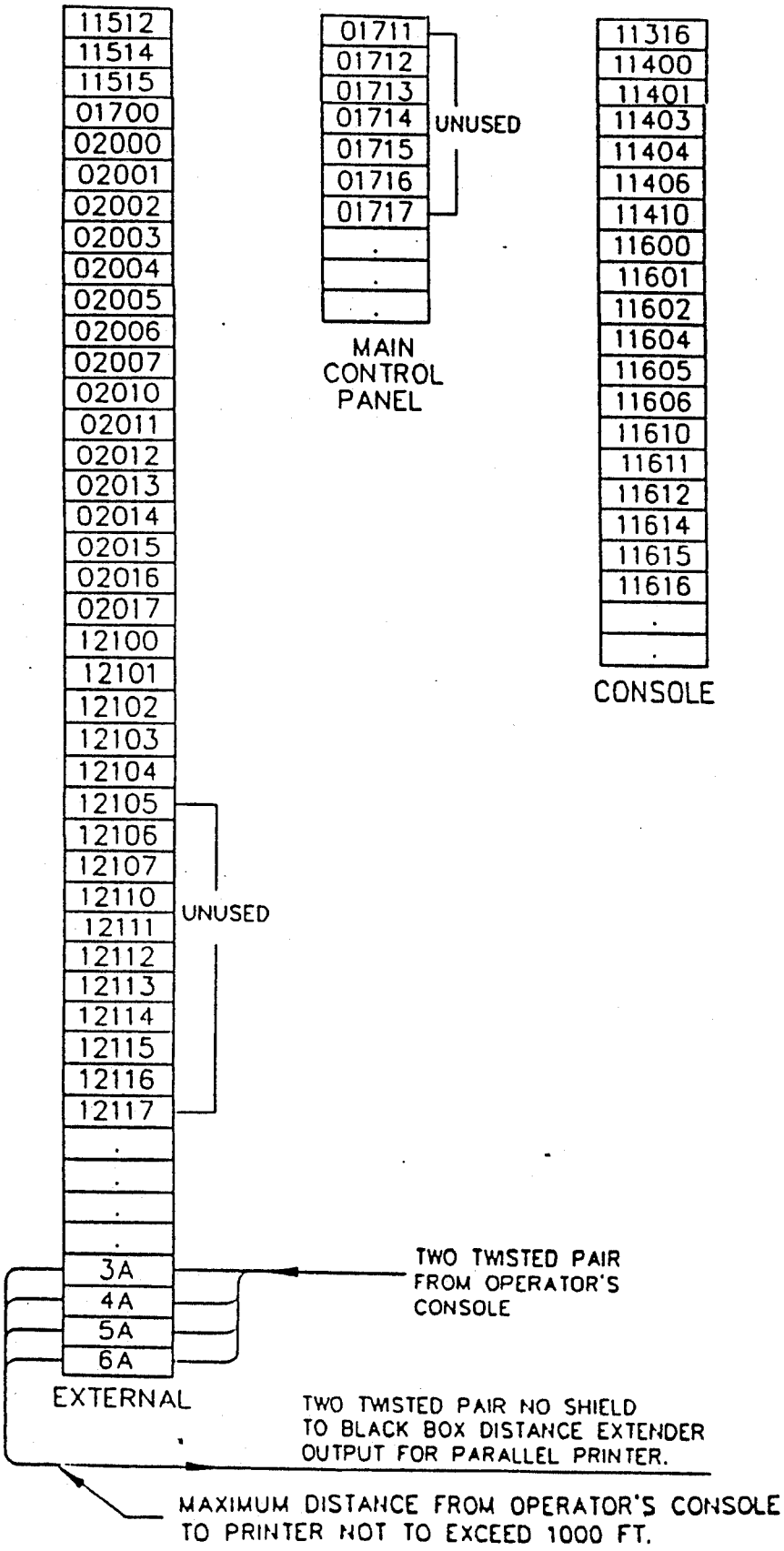
FIG. 14S3

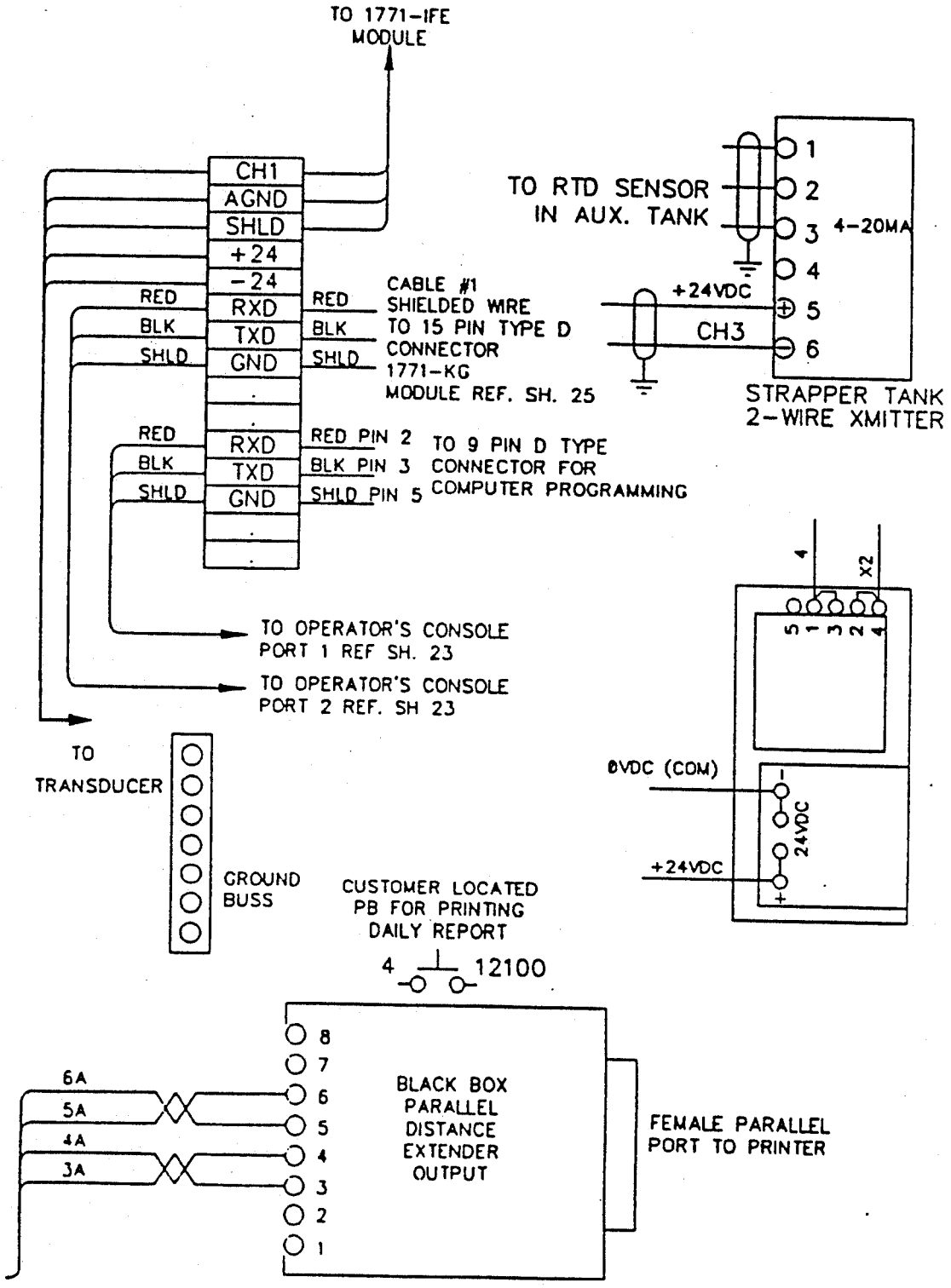
FIG. 14S4

OPERATOR'S CONSOLET BILL OF MATERIAL

| ITEM | QTY | MANUFACTURER | CATALOGUE NO. |
|---|---|---|---|
| 1 | 1 | MULTITECH SYSTEMS CONSOLE---------- | |
| 2 | 1 | AB CO. KEYED SELECTOR SW.---------- | 800T-J45KC1B |
| | 1 | " CONTACT BLOCK---------- | 800T-XA |
| 3 | 1 | " RED MUSHROON PB---------- | 800T-FX6D4 |
| 4 | 1 | " BLUE EXTENDED HD.PB---------- | 800MR-B7A2K |
| | 1 | " GUARD---------- | 800MR-N4 |
| 5 | 5 | " RED EXTENDED HD.PB---------- | 800MR-B6D2K |
| 6 | 1 | " GREEN EXTENDED HD. PB.-------- | 800MR-B1D1K |
| | 1 | " GUARD---------- | 800MR-N4 |
| 7 | 1 | " 3 POSITION SEL. SW.---------- | 800MR-JH2BLAK |
| 8 | 5 | " GREEN ILLUM. PB.---------- | 800MR-PGA16GD1K |
| 9 | 1 | " 2 POSITION SEL. SW.---------- | 800MR-HH2BLAK |
| 10 | 5 | " YELLOW EXT. HD. PB.---------- | 800MR-B9D1K |
| | 5 | " GUARD---------- | 800MR-N4 |
| 11 | 1 | " 3 POSITION SEL. SW.---------- | 800MR-JH9BLAK |
| 12 | 5 | " BLACK EXT. HD. PB.---------- | 800MR-B2D1K |
| | 5 | " GUARD---------- | 800MR-N4 |
| 13 | 3 | " BLUE EXT. HD. PB.---------- | 800MR-B7D1K |
| | 3 | " GUARD---------- | 800MR-N4 |
| 14 | 1 | " SELECTOR SWITCH ADAPTER-------- | 800A-P2AW |
| | 1 | GRAYHILL SELECTOR BINARY CODED SEL.SW. | 26ASD22-01-1-AJS |
| | 1 | BLACK BOX PARALLEL PRINTER DISTANCE--- EXTENDER (SET) | TN-PI320A |
| | 1 | PARALLEL PRINTER CABLE | |
| | 1 | OPERATOR INTERFACE TERMINAL | |

FIG. 14T

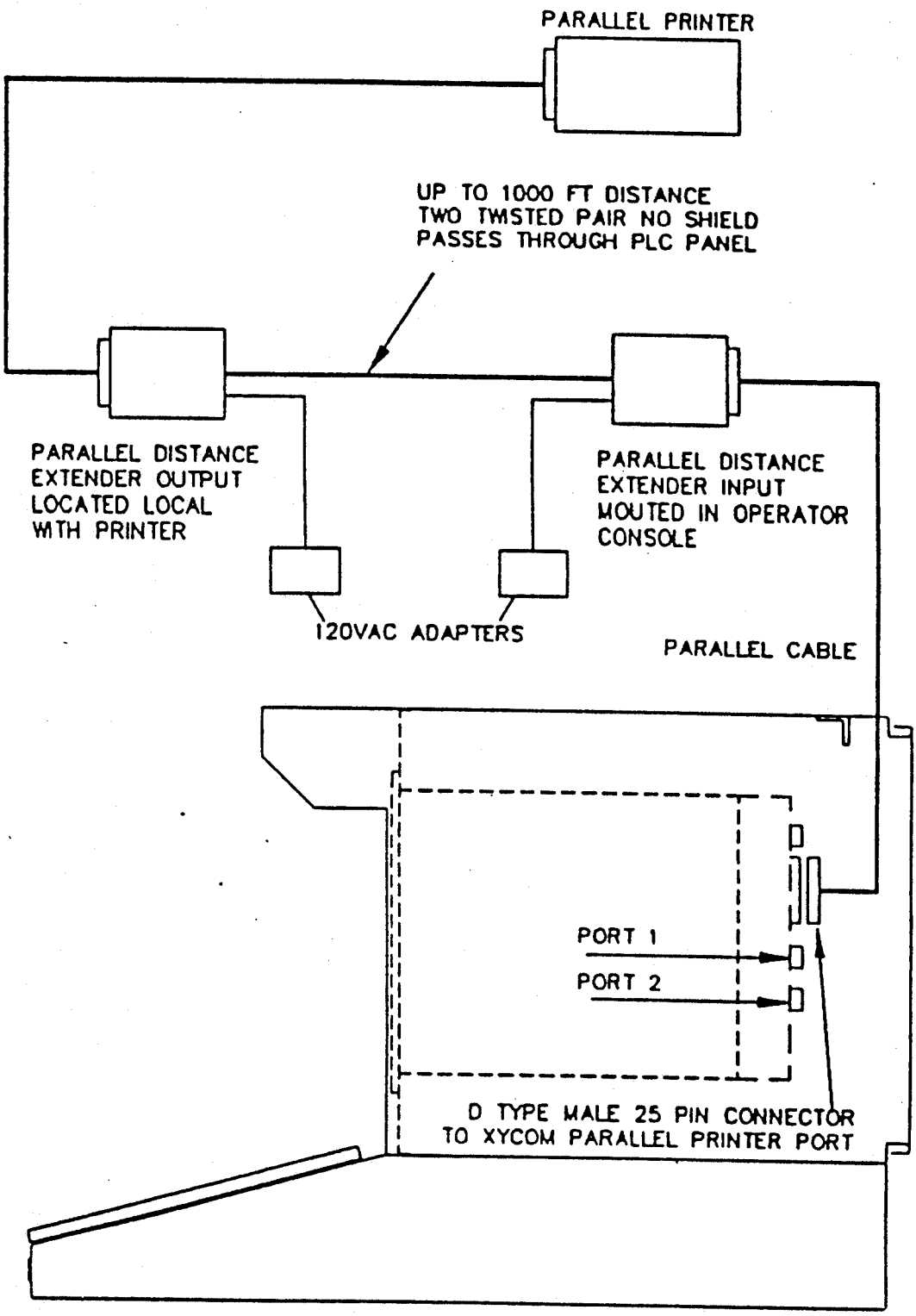
FIG. 14U1

| | | | |
|---|---|---|---|
| TXD | BLK | PIN 2 | PORT 1 |
| RXD | RED | PIN 3 | 9 PIN D TYPE CONNECTOR |
| GND | SHLD | PIN 5 | FEMALE |
| | | | |
|---|---|---|---|
| RXD | RED | PIN 2 | PORT 2 |
| TXD | BLK | PIN 3 | 9 PIN D TYPE CONNECTOR |
| GND | SHLD | PIN 5 | FEMALE |
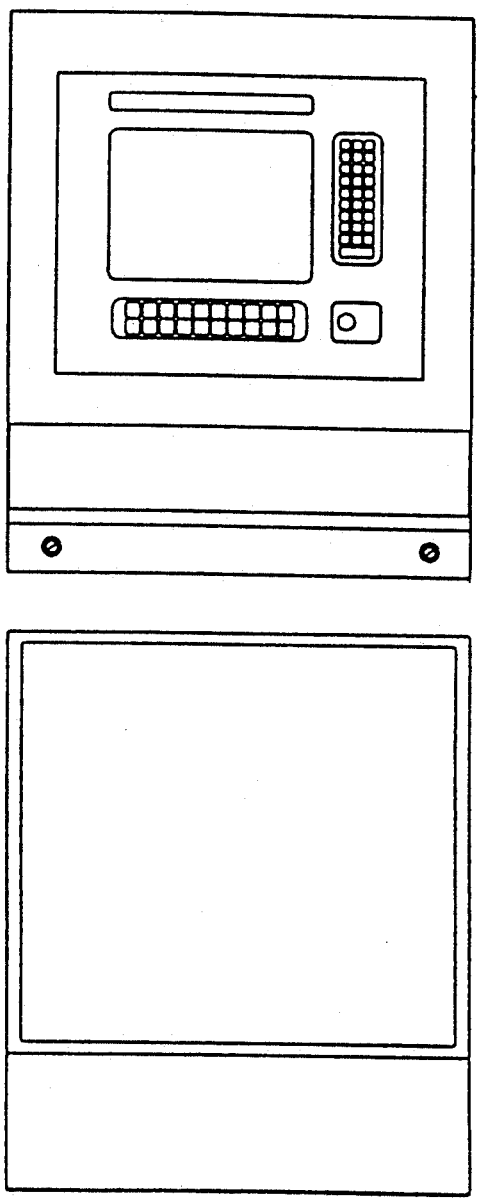
FIG. 14U2

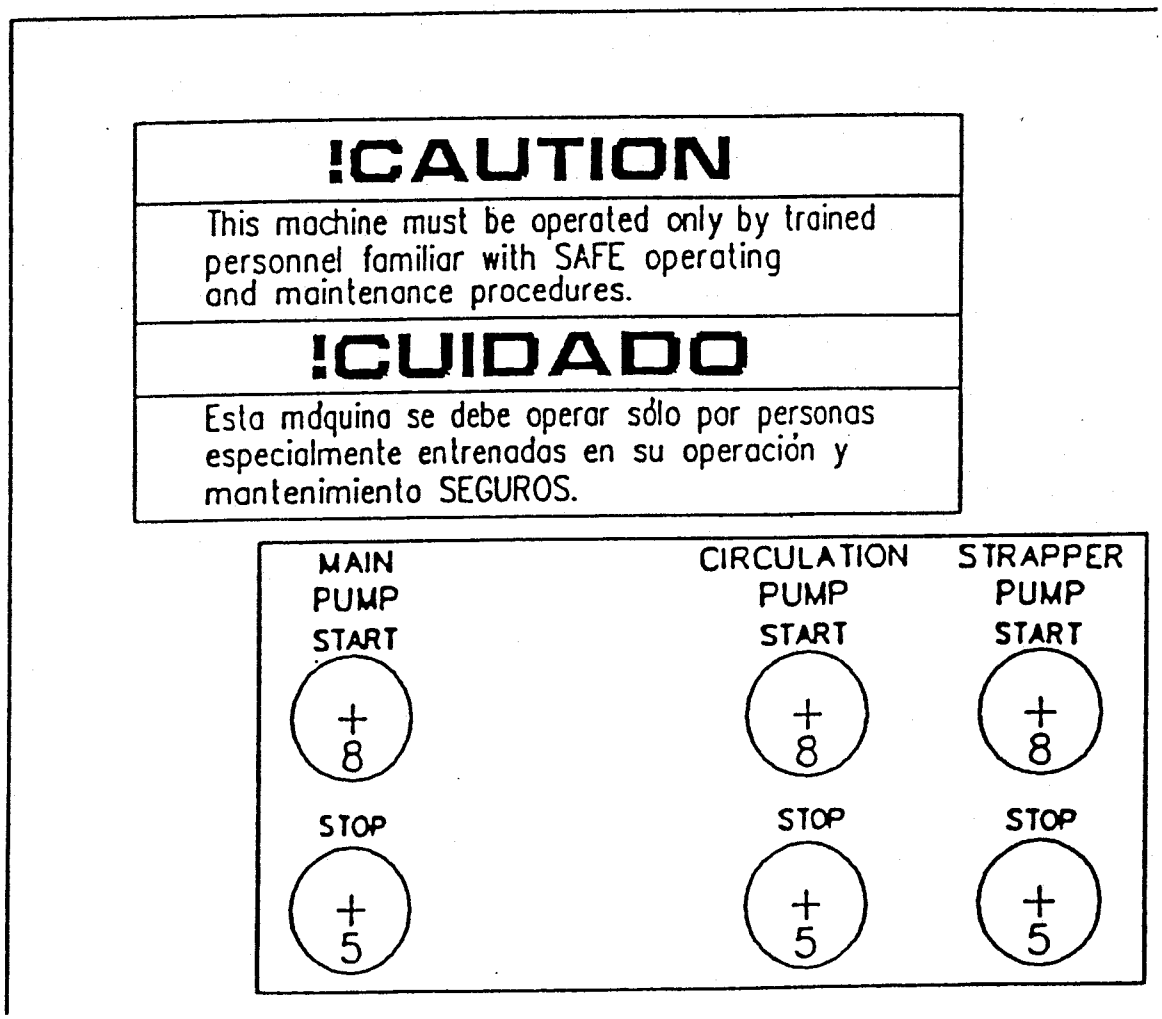
FIG. 14V1

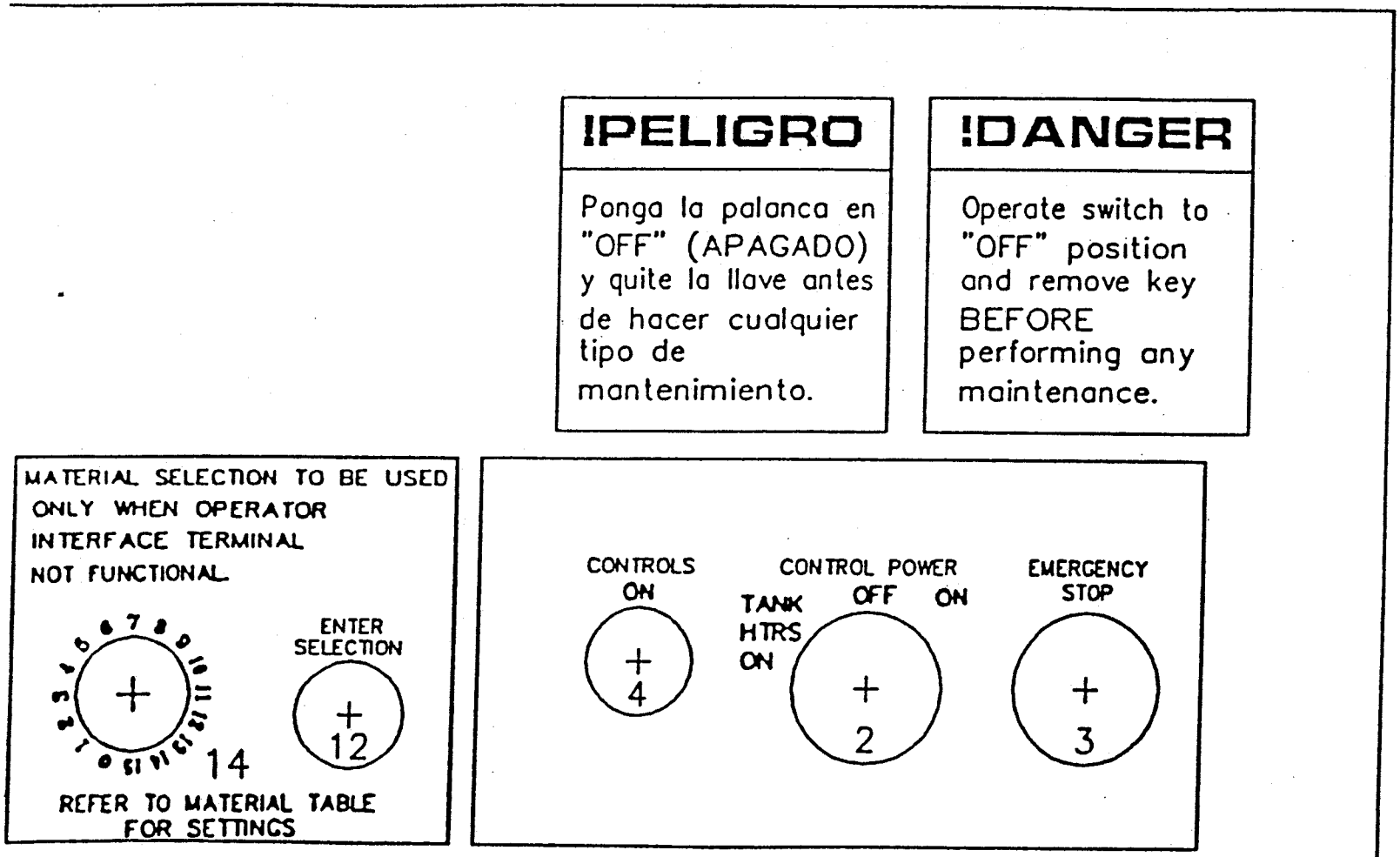
FIG. 14V2

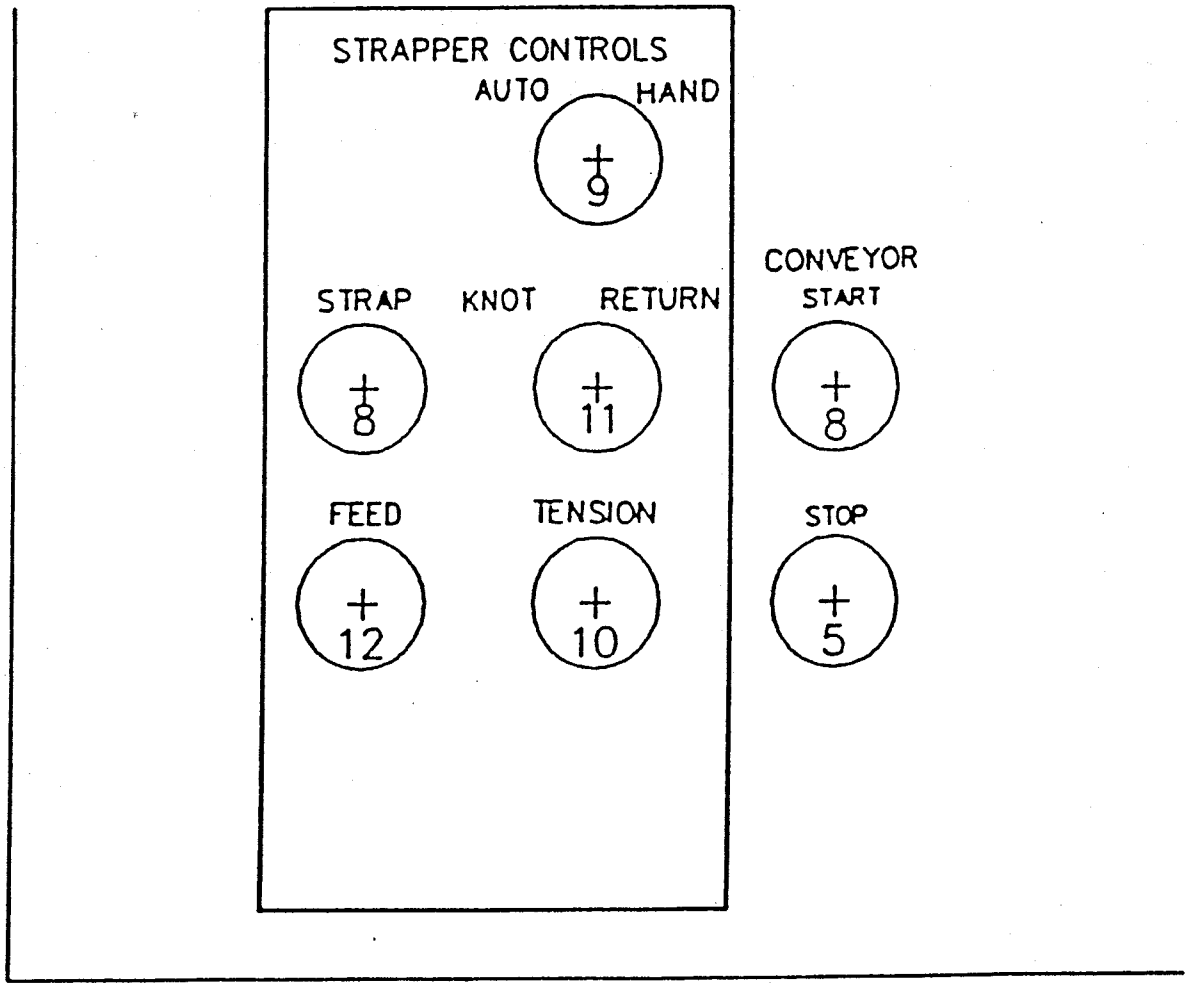
FIG. 14V3

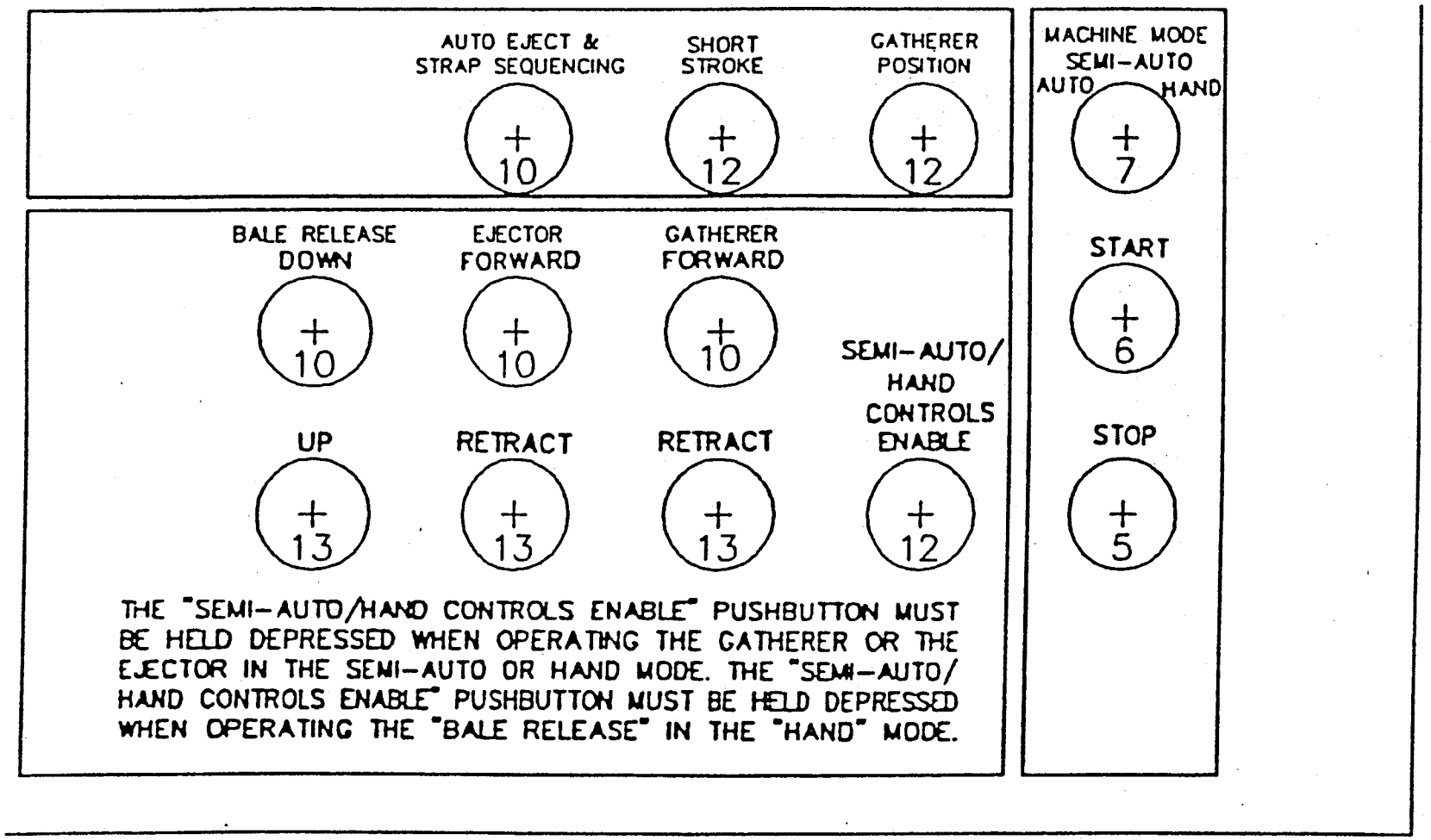
FIG. 14V4

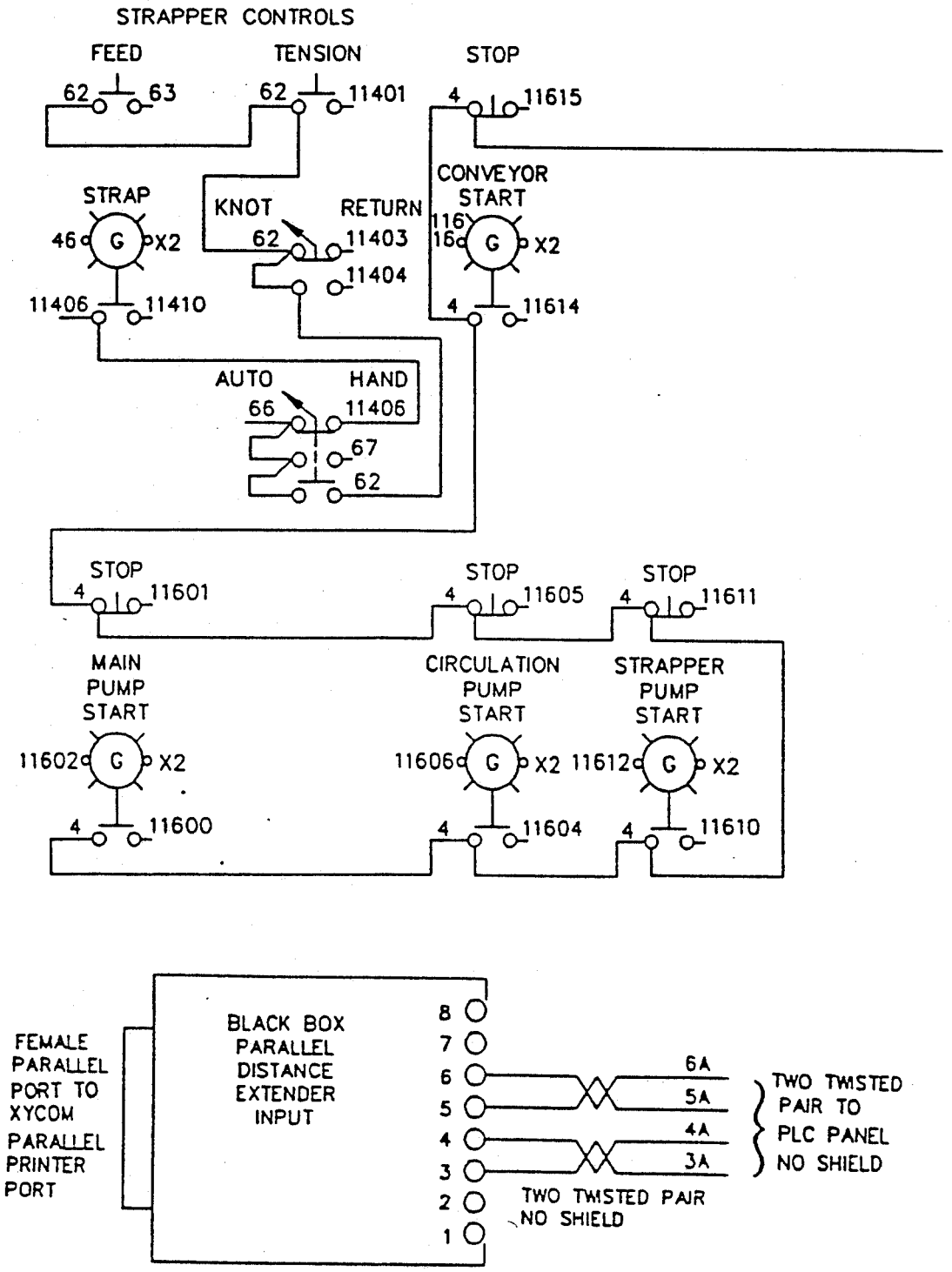
FIG. 14W1

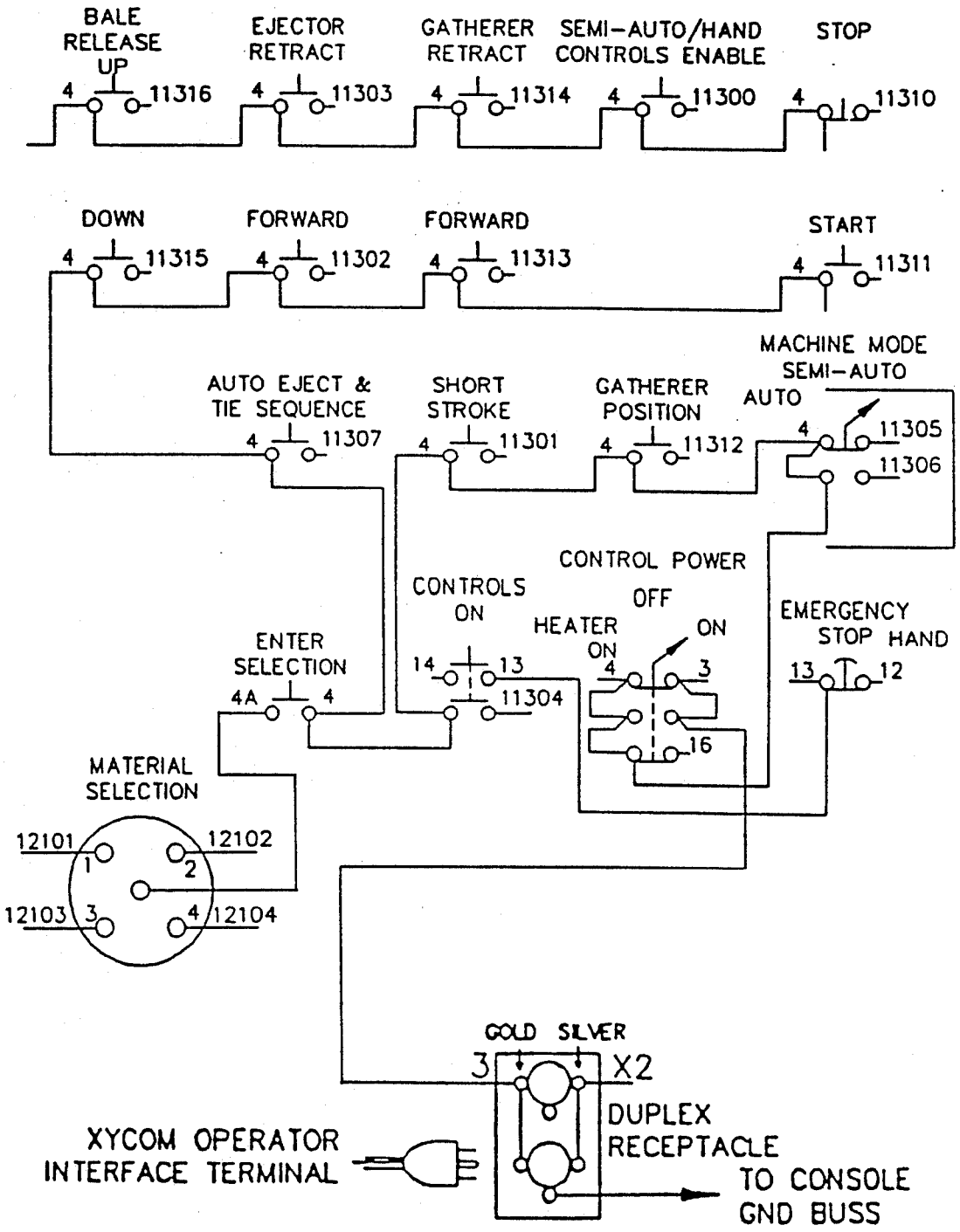
FIG. 14W2

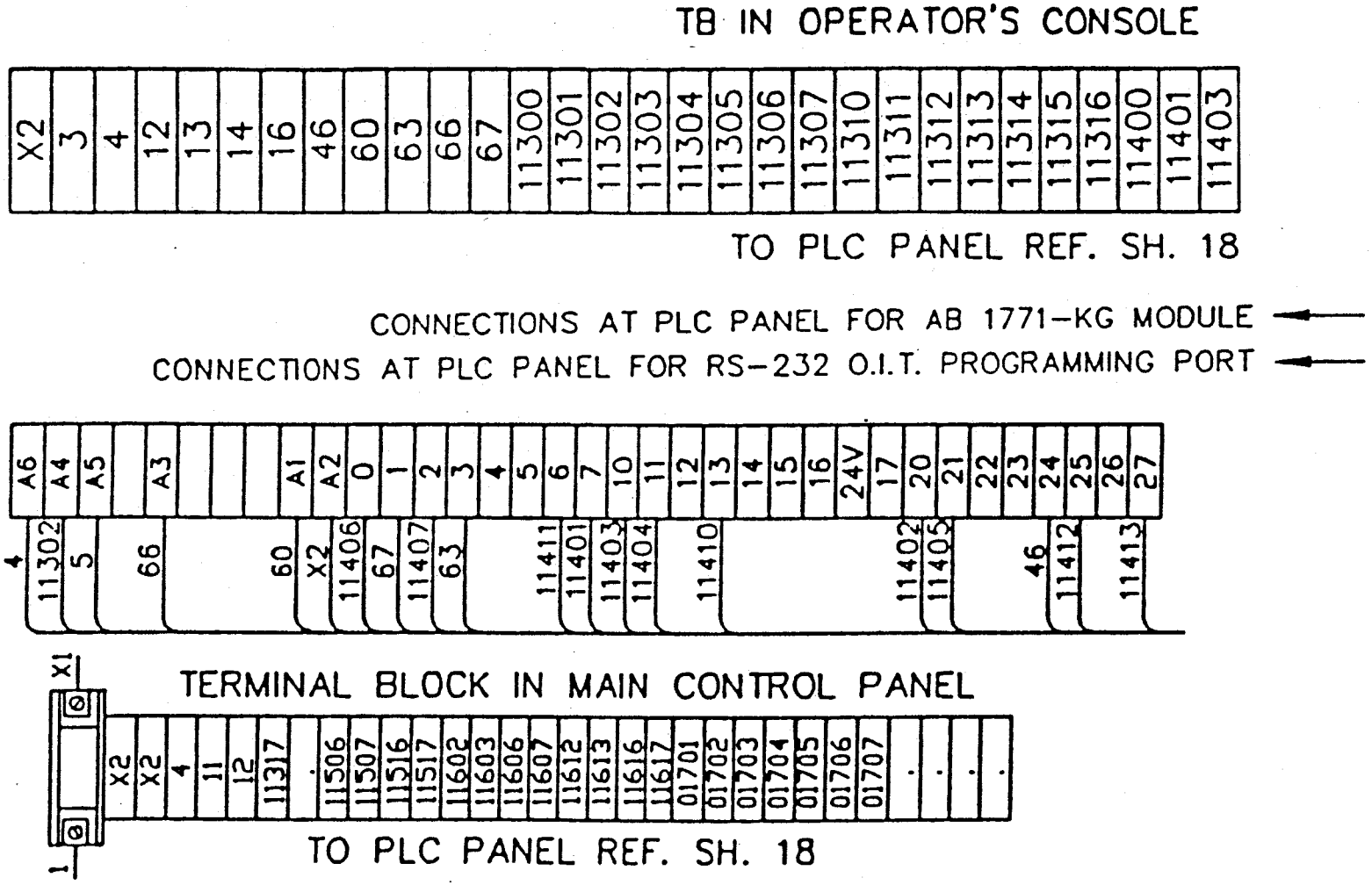
FIG. 14X1

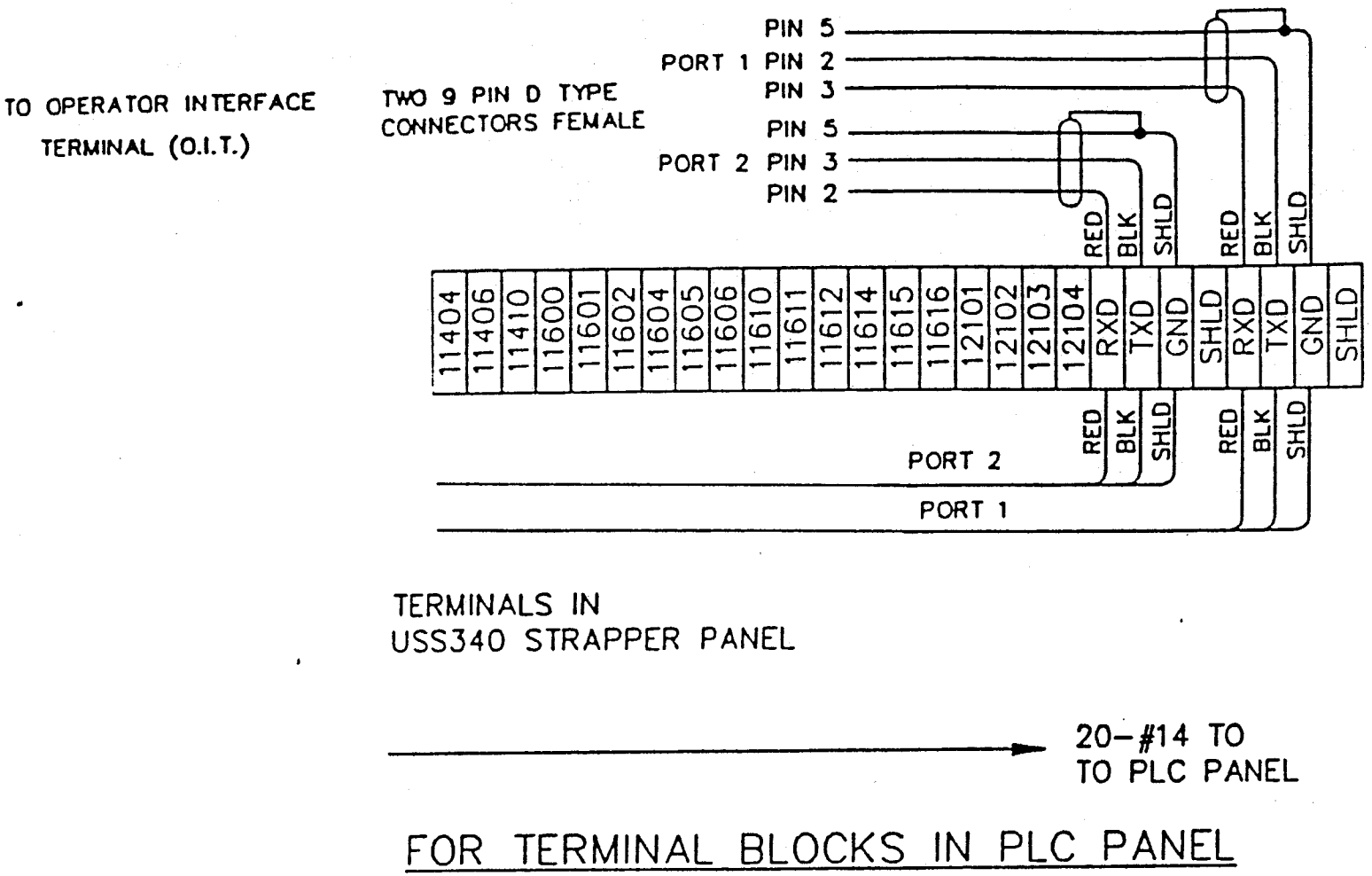
FOR TERMINAL BLOCKS IN PLC PANEL
REF. SH. 18
FIG. 14X2

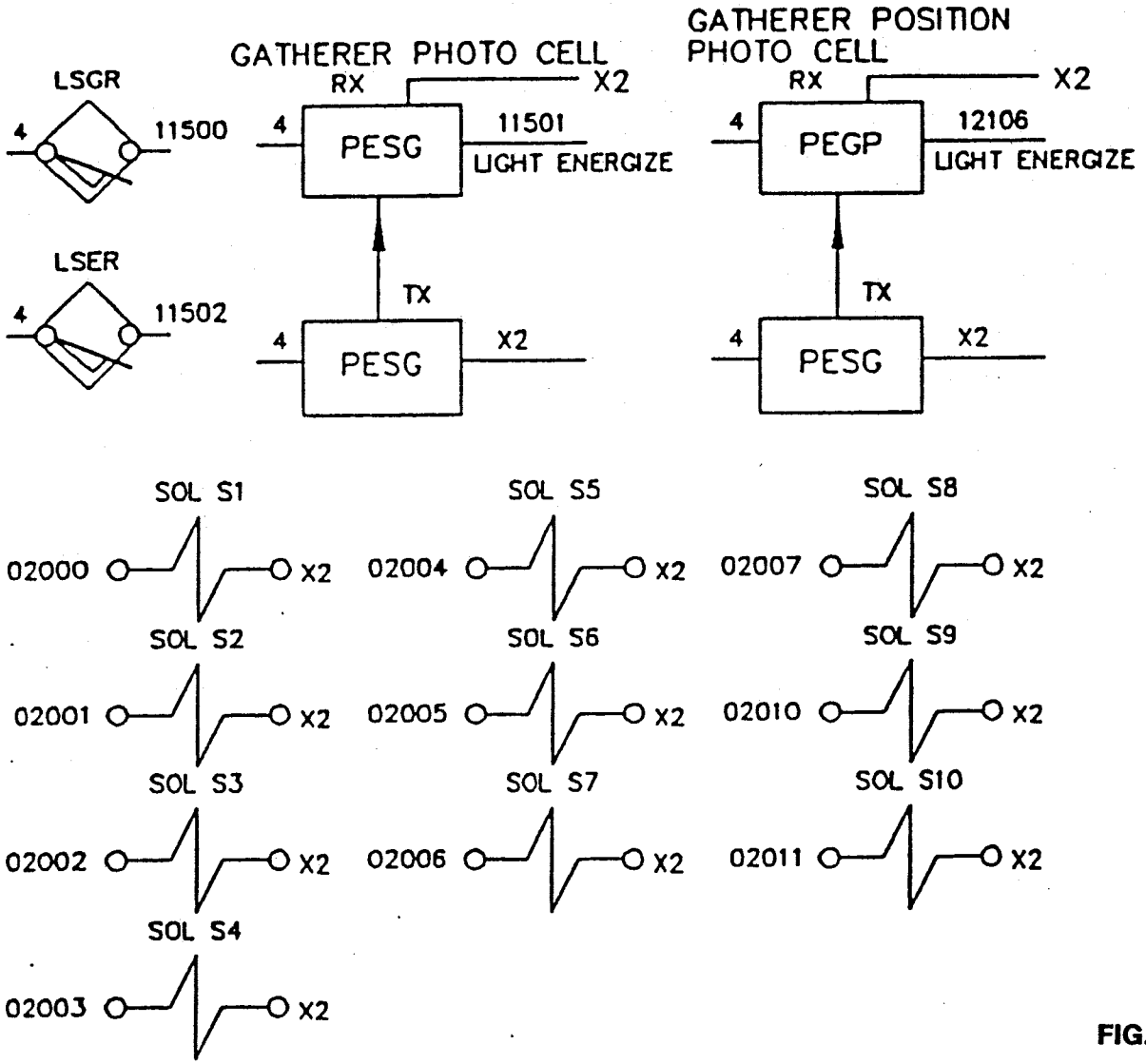
FIG. 14X3

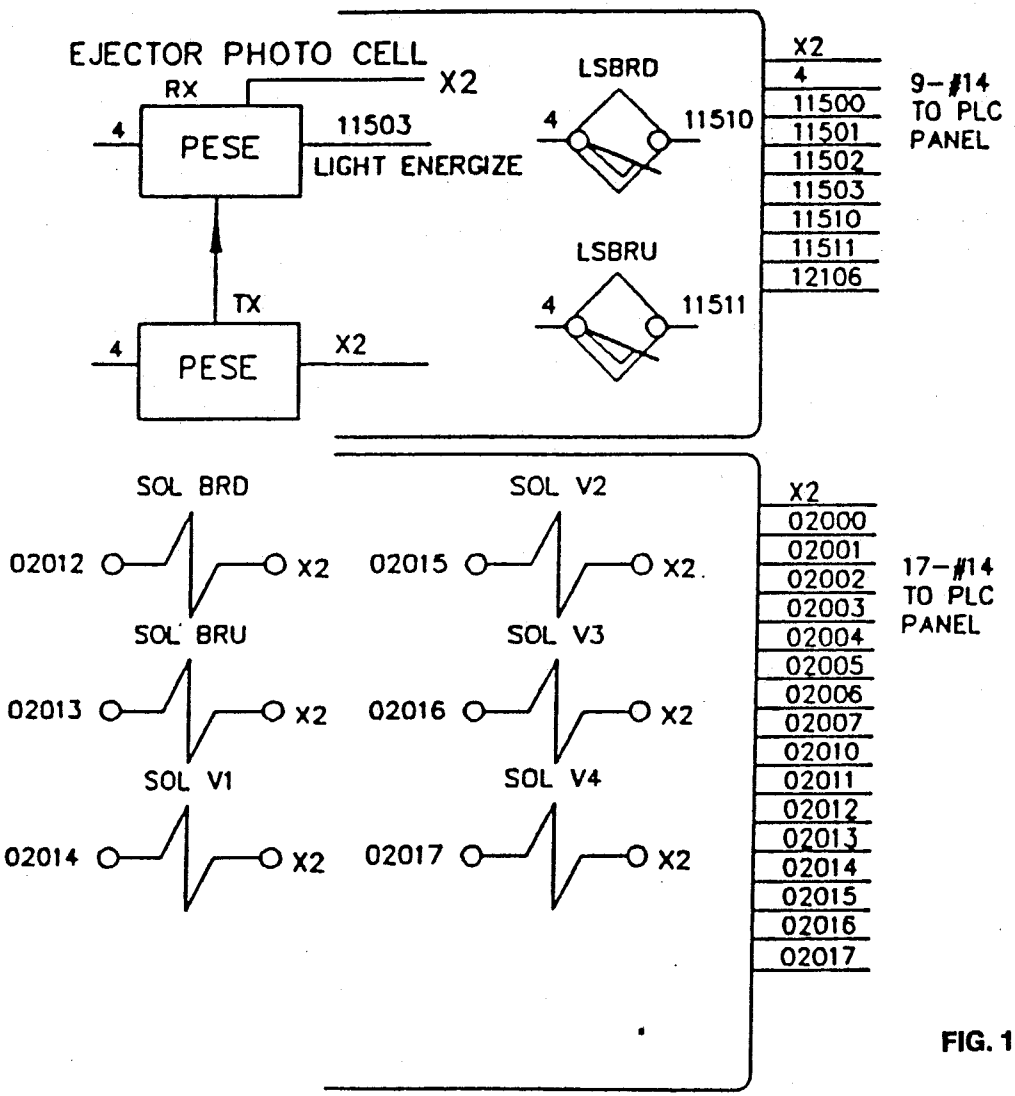
FIG. 14X4

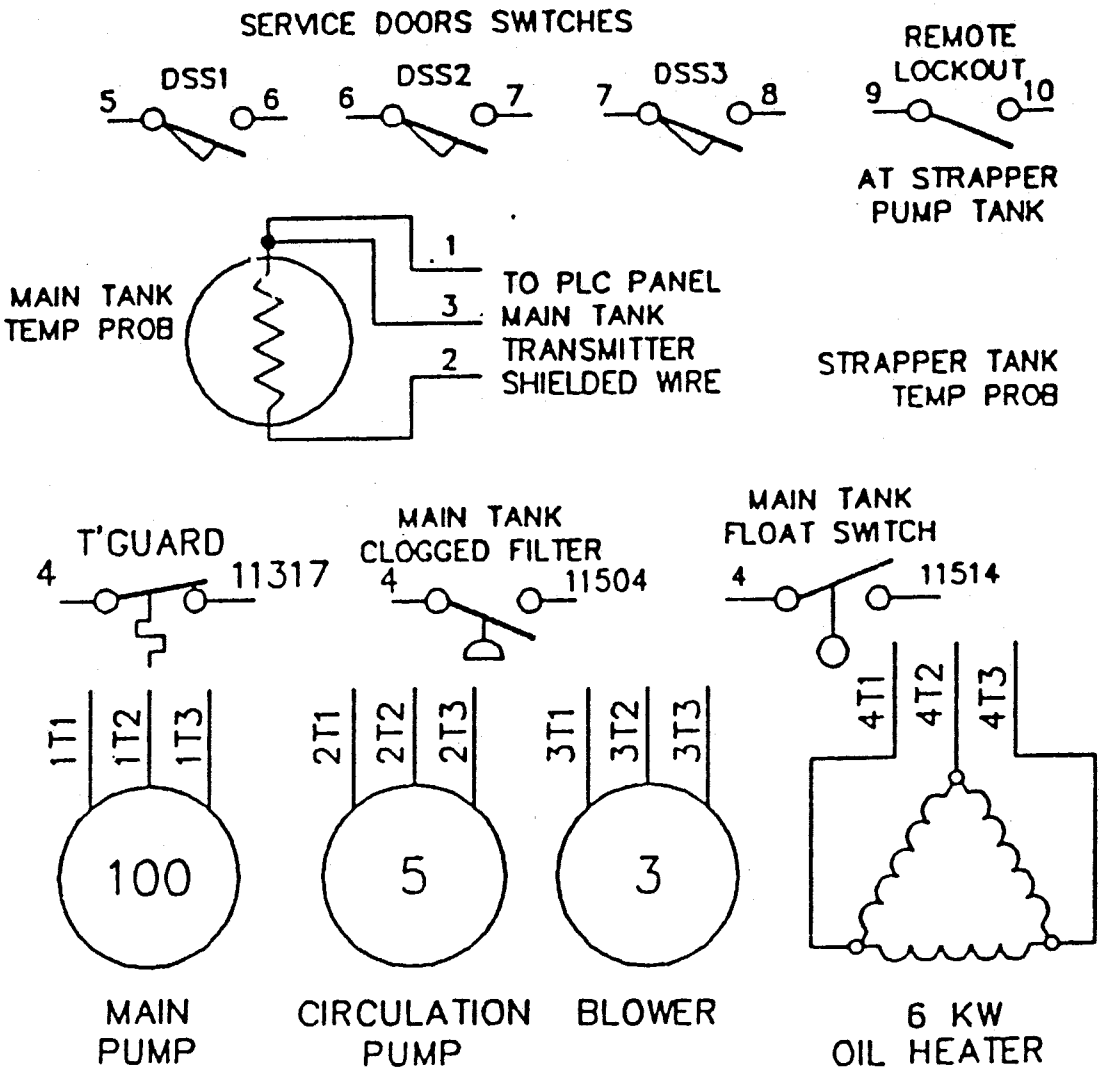
FIG. 14X5

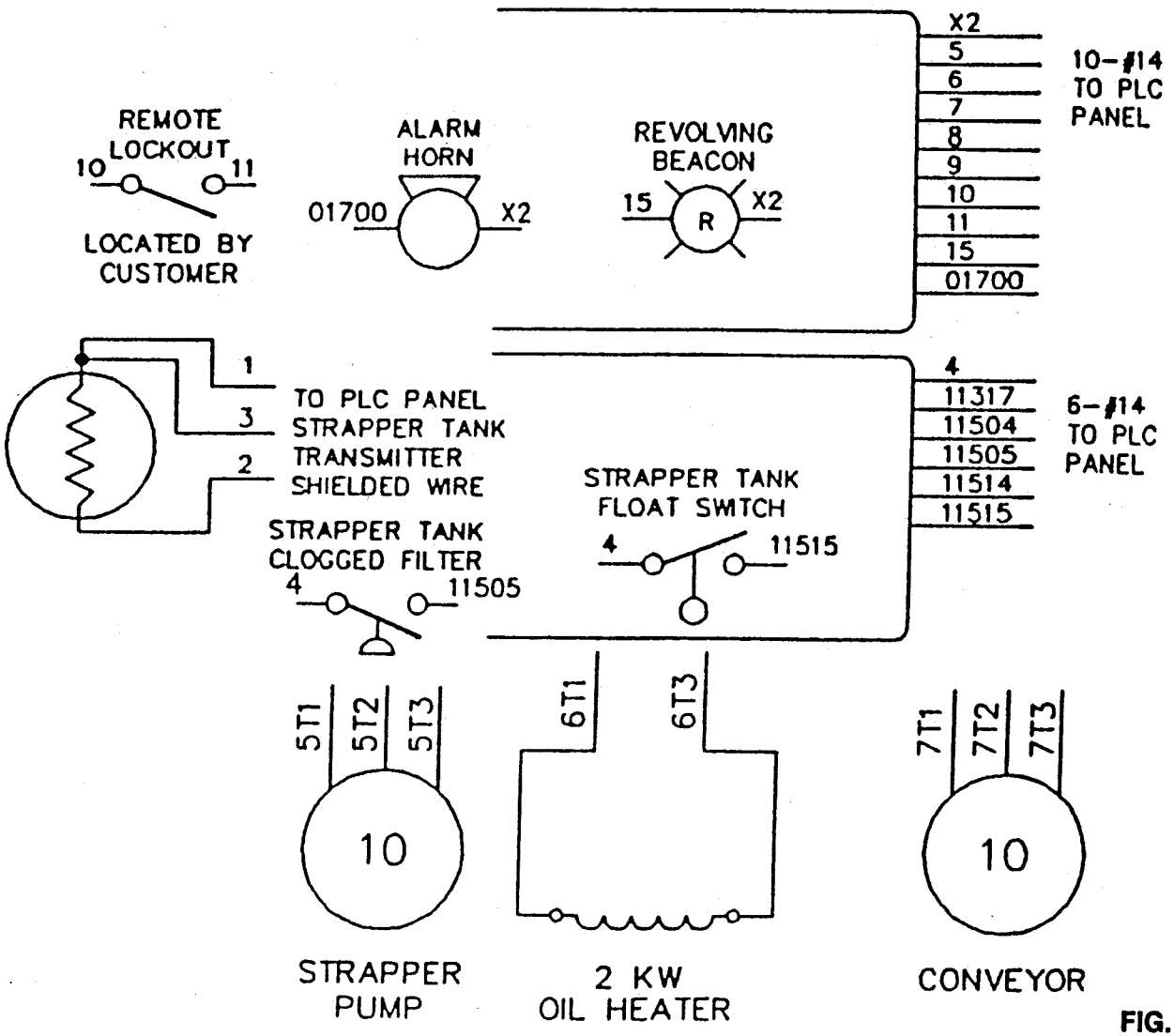
FIG. 14X6

BALER AUTOMATIC SEQUENCE OF OPERATION

1. BE SURE ALL EMERGENCY STOPS AND LOCKOUTS ARE ON.
2. SWITCH "CONTROL POWER" KEY SWITCH TO THE "ON" POSITION.
3. PRESS "CONTROLS ON" PUSHBUTTON. THE START-UP HORN WILL SOUND FOR 15 SECONDS TO SIGNAL MACHINE START-UP.
4. START MAIN PUMP. CIRCULATION PUMP AND THE STRAPPER PUMP. THE MAIN PUMP WILL CYCLE "ON" THEN "OFF" THREE TIMES IF IT HAS NOT BEEN USED FOR AN HOUR.
5. SWITCH "AUTO/SEMI-AUTO/HAND" SELECTOR SWITCH TO THE "HAND" POSITION.
6. MANUALLY RETRACT THE GATHERER AND THE EJECTOR.
7. "AUTO/SEMI-AUTO/HAND" SELECTOR SWITCH TO THE "AUTO" POSITION. STRAPPER "AUTO/OFF/HAND" SELECTOR SWITCH TO THE "AUTO" POSITION ONLY IF A BALE IS PRESENT THROUGH THE STRAPPER WIRE TRACK.
9. GO TO THE MATERIAL SCREEN TO MAKE "MATERIAL SELECTION" FOR BALING.
10. START THE CONVEYOR.
11. WHEN OPERATOR SEES MATERIAL FALLING INTO HOPPER, PRESS "CYCLE START".
12. THE GATHERER WILL START FORWARD COMPRESSING THE MATERIAL INTO THE COMPRESSION BOX. AFTER A FEW COMPRESSIONS, THE BALE MADE SIGNAL WILL OCCUR.
13. GATHERER WILL RETRACT TO POSITION. EJECTOR WILL START FORWARD TO EJECT BALE AND START STRAPPING SEQUENCE.
14. THE EJECTOR WILL STOP AT DESIGNATED POSITIONS SET BY THE STRAP SPACING PATTERN CHOSEN AUTOMATICALLY WHEN THE MATERIAL SELECTION WAS MADE. THE OPERATOR CAN OVERRIDE THE STRAP PATTERN FROM THE MAIN SCREEN.
15. THE EJECTOR WILL CONTINUE FORWARD STRAPPING UNTIL IT REACHES POSITION 16.
16. THE EJECTOR RETRACTS TO LSER OR POSITION ZERO.
17. THE GATHERER RETRACTS TO LSGR OR POSITION ZERO.
18. WHEN THE GATHERER REACHES LSGR, IT WILL AUTOMATICALLY START FORWARD AGAIN TO REPEAT ANOTHER BAILING CYCLE IF STILL IN THE "AUTO" MODE.
19. WHEN THE GATHERER IS RETRACTING, THE OPERATOR MAY WISH TO PRESS THE "SHORT STROKE" PUSHBUTTON BEFORE THE GATHERER IS ALL THE WAY RETRACTED. THIS WILL ALLOW SMALLER AMOUNTS OF MATERIAL TO FALL INTO THE COMPRESSION BOX. THERE ARE AUTOMATIC SHORT STROKES PROGRAMMED BASED ON HYDRAULIC PRESSURE.

FIG. 14Y1

BALER SEMI-AUTOMATIC SEQUENCE OF OPERATION

1. WITH "AUTO/SEMI-AUTO/HAND" SELECTOR SWITCH IN THE "SEMI-AUTO" MODE, ALL MATERIAL COMPRESSION WITH THE GATHERER WILL BE DONE MANUALLY. USING GATHERER FORWARD/RETRACT PUSHBUTTONS TO COMPRESS MATERIAL AND A "BALE MADE" SIGNAL IS INDICATED. PRESS THE "GATHERER POSITION" PUSHBUTTON UNTIL THE GATHERER STOPS MOVING BACK. THEN PRESS THE "AUTO EJECT & TIE SEQUENCE" PUSHBUTTON. THE EJECTOR AND THE STRAPPER WILL BE FULLY AUTOMATIC FOR THE REST OF THE CYCLE. WHEN THE EJECTOR HAS RETRACTED, MANUALLY RETRACT THE GATHERER.
2. REPEAT ABOVE FOR NEXT BALE.

THIS MACHINE HAS MANY ALARM AND WARNING CONDITIONS

SEE ALARM SCREEN FOR LIST.

1. IF BALER REMAINS IDLE FOR APPROXIMATELY 12 MINUTES, THE ENTIRE MACHINE WILL SHUT-DOWN SIGNALING A NO PRODUCTION TIME. A COMPLETE START-UP SEQUENCE WILL BE NECESSARY.
2. IF THE GATHERER SHOULD SIGNAL AN "OVERSIZE BALE", SWITCH BALER TO "HAND" MODE. RAISE THE BALE RELEASE. THE BALE WILL HAVE TO BE EJECTED AND STRAPPED MANUALLY. IF A BALE SHOULD BE TOO LARGE TO BE EJECTED WITH THE BALE RELEASE UP, A PORTION OF THE BALE MAY HAVE TO BE REMOVED BY HAND. DO THIS WITH EXTREME CAUTION. SWITCH "OFF" THE "CONTROL POWER" SWITCH AND REMOVE THE KEY. THE KEY MUST REMAIN ON THE PERSON OF THE ONE REMOVING THE BALE. ALSO SWITCH "OFF" THE MAIN BREAKER AT THE MAIN CONTROL PANEL AND PAD LOCK IT.
3. THE EJECTOR ALSO HAS AN OVERSIZE BALE SIGNAL. IF EJECTOR OVERSIZE BALE IS SIGNALED, SWITCH TO "HAND", RAISE THE BALE RELEASE AND EJECT AND STRAP BALE MANUALLY.
4. ALL ALARM OR WARNING CONDITIONS ARE FLASHED AT THE BOTTOM OF THE SCREEN. IF YOU EXPERIENCE AN ALARM CONDITION, THE SCREEN WILL CHANGE AUTOMATICALLY TO THE ALARM LIST SCREEN FOR A DESCRIPTION OF THE CONDITION.
5. SHOULD THE CONDITION ARISE THAT THERE IS NOT A BALE IN THE BALER, THE STRAPPER MUST BE SWITCHED "OFF" UNTIL THE LEADING EDGE OF A BALE IS THROUGH THE STRAPPER WIRE TRACK. AS THE BALE STARTS THROUGH THE WIRE TRACK, SWITCH THE STRAPPER TO "AUTO" AND STRAPPING SHOULD START WITH THE NEXT STRAP POSITION. IF THIS IS NOT DONE, THE STRAPPER HAS NO MEANS OF KNOWING IF A BALE IS PRESENT OR NOT AND CAN CAUSE A STRAPPER MALFUNCTION.

FIG. 14Y2

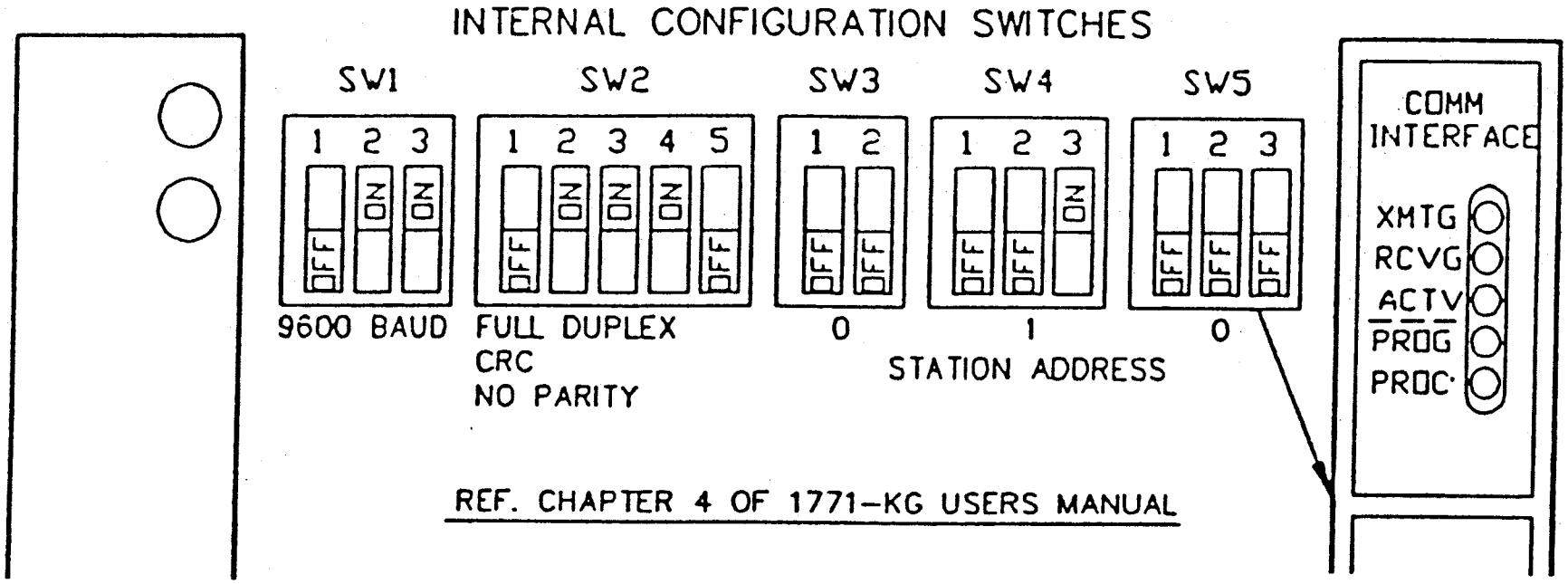
FIG. 14Z1

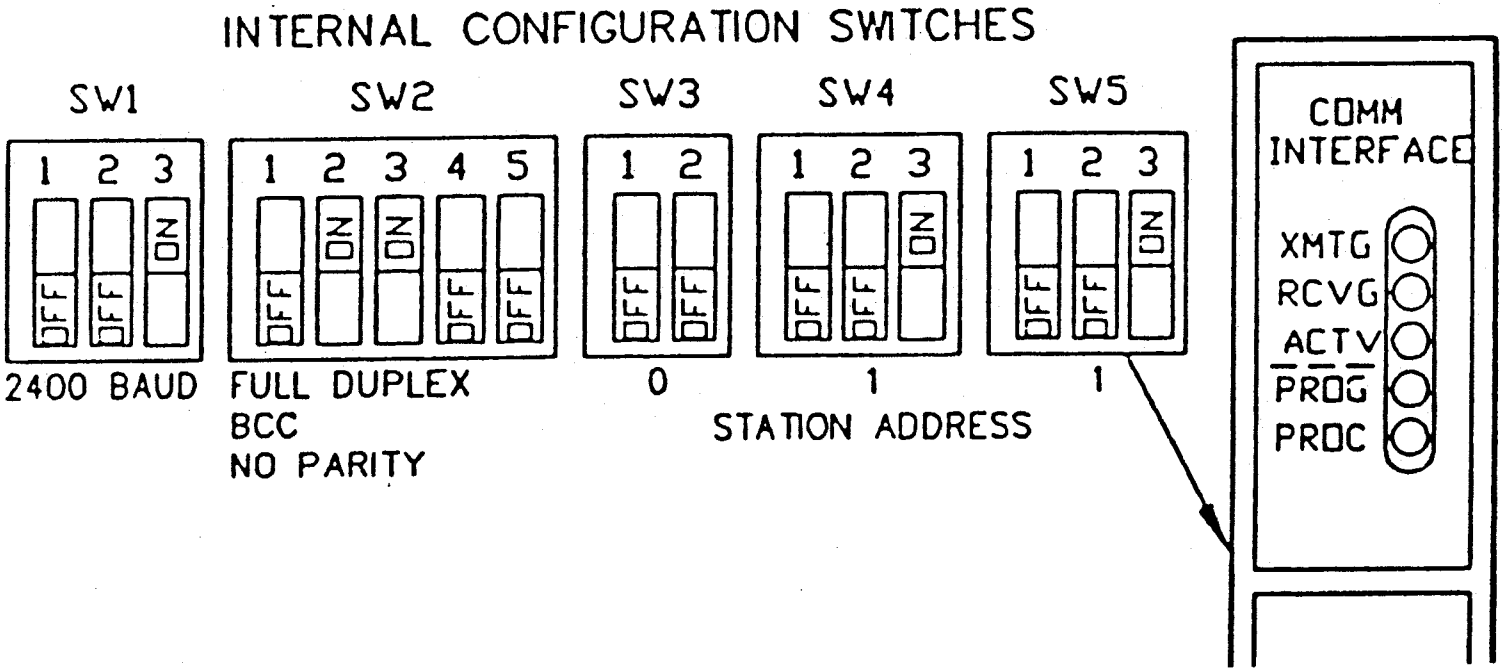
FIG. 14Z2

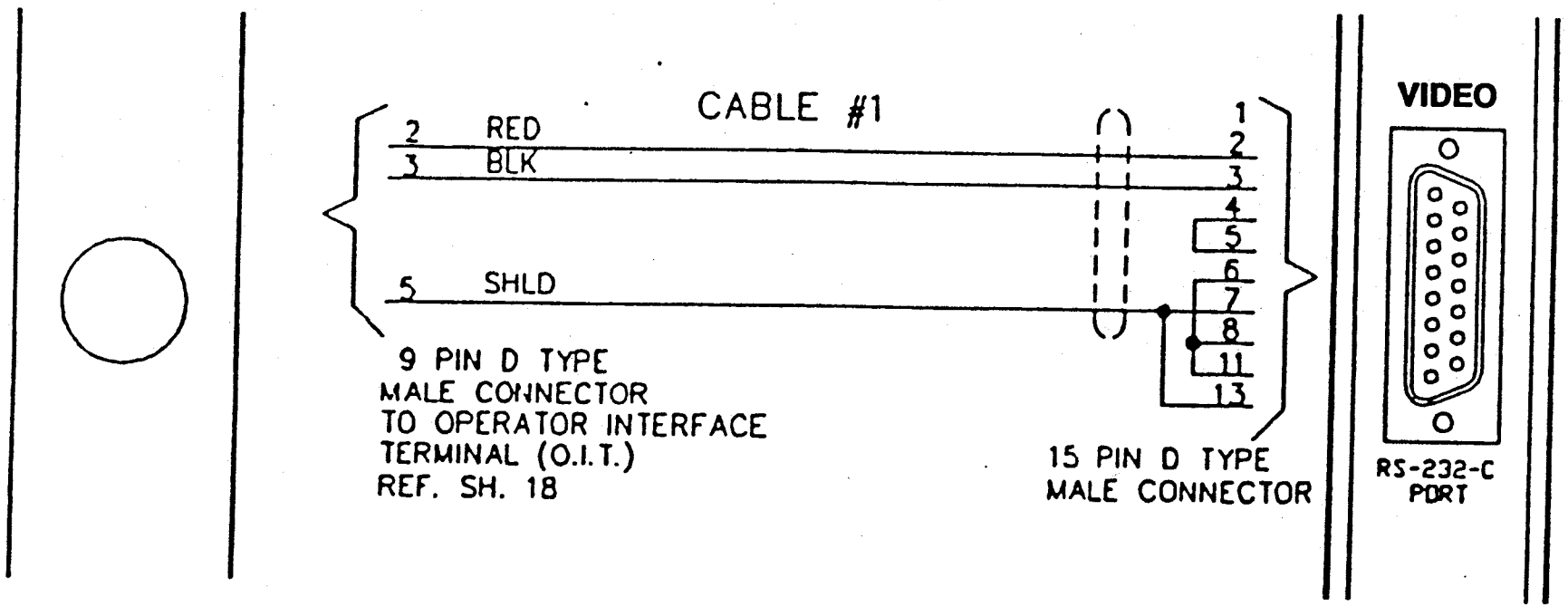
FIG. 14Z3

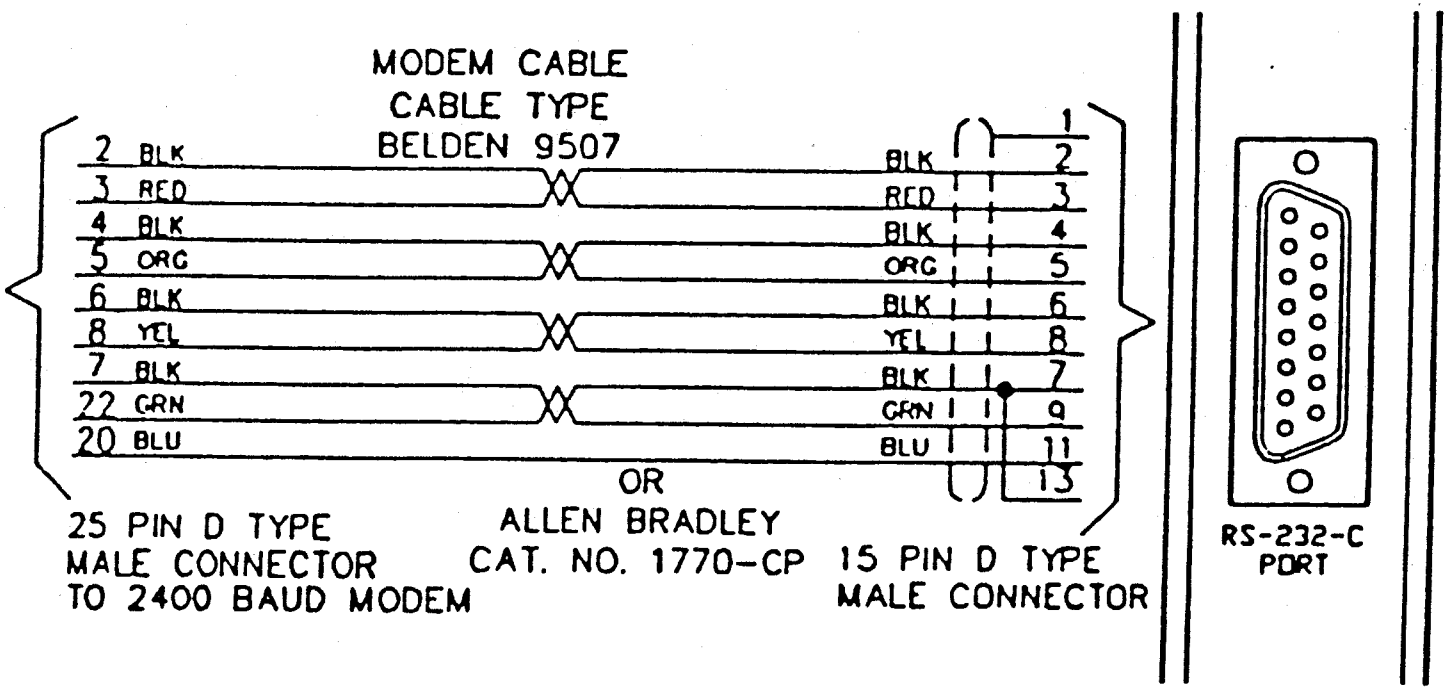
FIG. 14Z4

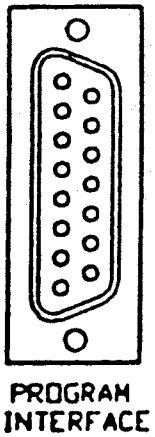
FIG. 14Z5

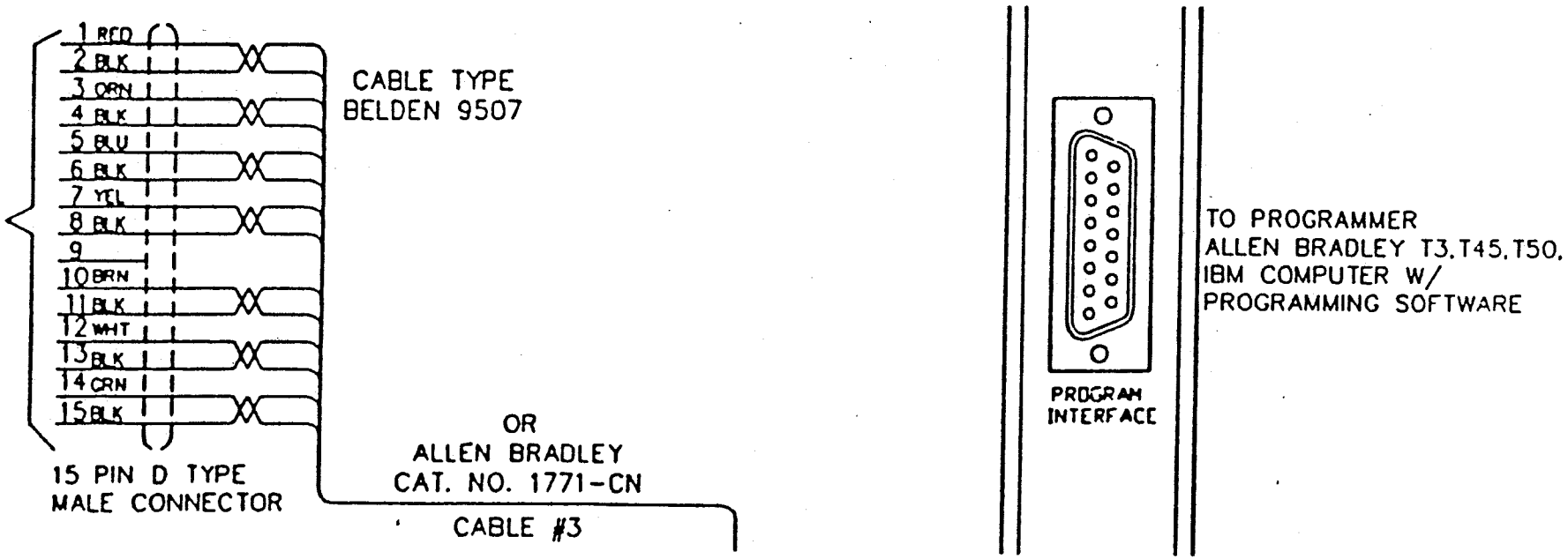
FIG. 14Z6

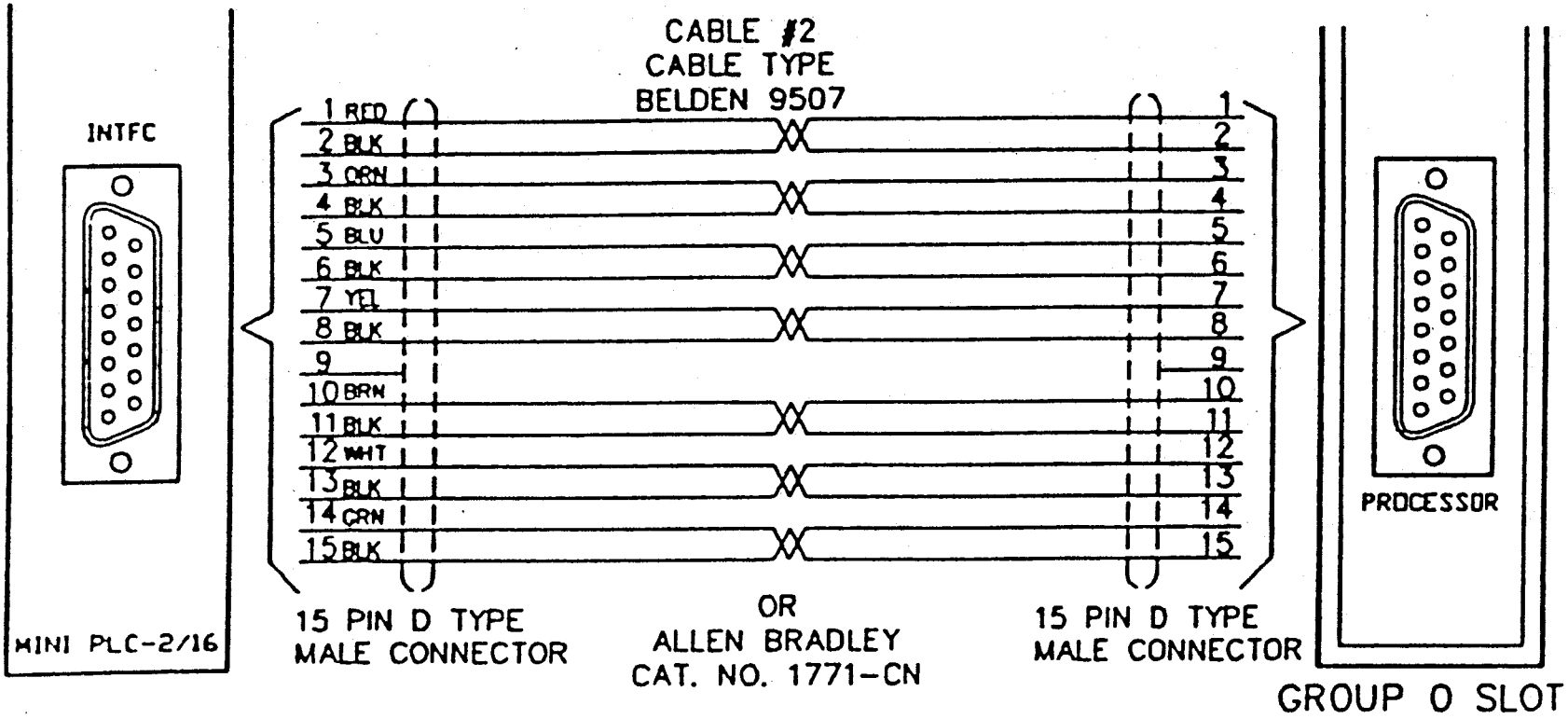
FIG. 14Z7

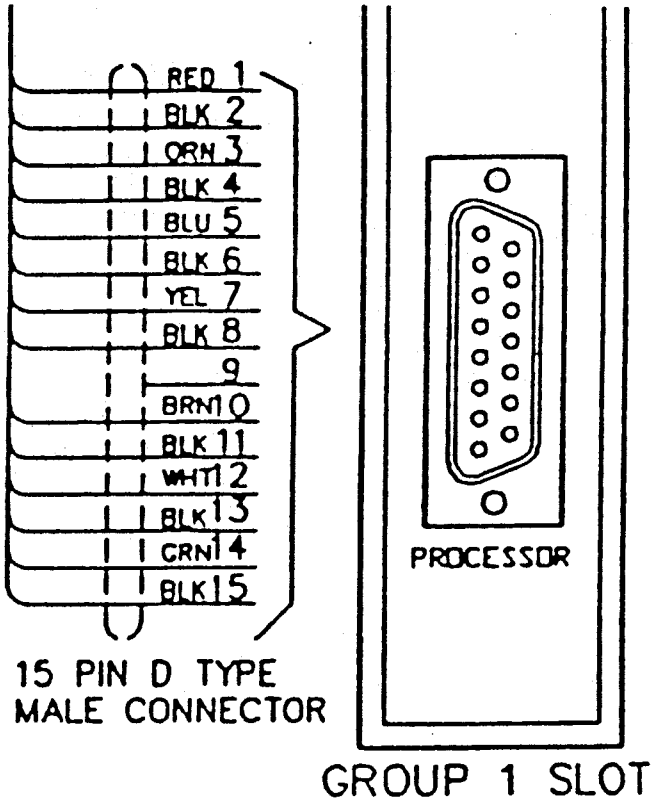
FIG. 14Z8

*IBM COMPUTER W/ICOM SOFTWARE MODEM COMMUNICATION SETUP*

ALLEN BRADLEY 1771-KG MODULE-STATION 11-MONITOR, CHANGE DATA TABLE VALUES, AND UP/DOWN LOAD PROGRAMS

1. MAIN ICOM SOFTWARE MENU
2. F8 CONFIGURE PROGRAM PARAMETERS
3. F1 COMMUNICATION HARDWARE
4. 1771-KG DATA HIGHWAY PORT CONFIGURATION
5. F4 COM1 OR COM2 ON IBM COMPUTER
6. F5 1200 OR 2400 BAUD RATE DEPENDING ON MODEM
7. F6 PARITY NONE
8. F7 FULL DUPLEX
9. F9 KG
10. F10 IBM COMPUTER STATION NUMBER MUST BE 12 OR ABOVE
11. SELECTING PROGRAM AND MODIFY DATA HIGHWAY ADDRESS
    ICOM MAIN MENU F1 SELECT PROGRAM/PLC2 ADDR
12. F1 MODIFY DH ADDR
13. ENTER PLC-2 ADDRESS ON DATA HIGHWAY LINK 0-376, TYPE IN 11
14. PRESS ENTER TO ENTER PROGRAM AND DH STATION NUMBER

REF. SH. 25 OF HARRISGROUP DRAWINGS. 1771-KG MODULE IN GROUP 1 SLOT MUST BE SETUP AND CONNECTED WITH CABLES AS PER THIS DRAWING
15. SETUP COMPUTER MODEM AND PLC2 MODEM AND ESTABLISH TELEPHONE LINE COMMUNICATIONS
16. F5 IN ICOM MENU, UTILITY OPTIONS
17. ARROW DOWN TO ITEM 12 AND PRESS ENTER. MODEMS SHOULD ESTABLISH DATA HIGHWAY COMMUNICATIONS BETWEEN IBM COMPUTER AND PLC2.

TO UP/DOWN LOAD PROGRAMS TO PLC2
    MAIN ICOM MENU
1. F6 UP/DOWN LOAD PROGRAM TO PLC2
2. F2 DATA HIGHWAY UP/DOWN LOAD
3. F1 TO READ PROGRAM FROM PLC2
   F2 TO WRITE PROGRAM TO PLC2

XYCOM OPERATOR INTERFACE TERMINAL COMMUNICATION SETUP
1. REF. SH. 25 HARRISGROUP DRAWINGS. 1771-KG MODULE IN GROUP 0 SLOT MUST BE SETUP AND CONNECTED WITH CABLES AS PER THIS DRAWING.

FIG. 14ZZ

HORIZONTAL BALING APPARATUS

1 Microfiche Appendix of 2 Pages

CROSS REFERENCE TO CO-PENDING APPLICATIONS

U.S. patent application Ser. No. 683,606 (pending) filed on even data and entitled "Baler" is commonly assigned to the assignee of the present invention and incorporated herein by reference.

BACKGROUND OF THE INVENTION

1. Field of the Invention

The present invention is a baler for baling of materials for subsequent recycling or disposition, and more particularly, pertains to a baling system which is automated, requires a trained operator, and which is easy to implement adjustments pertaining to the ram, as well as the shear knives.

2. Description of the Prior Art

Prior art balers have been physically bulky devices requiring time consuming adjustments, as well as operation by a trained operator.

Prior art balers have usually required time-consuming adjustments for holding down of the ram during a charging operation, as well as time-consuming adjustment for spacing of the shear knives. These adjustments were time consuming of the baler in one fashion or another. There were literally no easy adjustments for ram hold-down assemblies or for the shear knives, and any adjustments were cumbersome, time consuming, and labor-intensive. Prior art balers were literally left unadjusted because of the time-consuming adjustments, as it was easier not to make the adjustments, than to make the adjustments.

The operator usually had to be trained to figure out how to operate the baler, as well as also attempting to observe the baling operation. Often, it was difficult for the operator to see a charging operation of materials. The operator was not always able to observe the materials being charged by the ram into the compression chamber. The operator may not have had a full and complete view of charging operation of the ram pushing materials into the compression chamber for forming of a bale.

Finally, an operator had to be trained in knowing the types of materials being baled and how the baler would bale these types of materials. It was an operator-intensive task and required complete operator attention to the adjusting of pressure settings for the gatherer ram to compensate for the baling of different materials.

The present invention overcomes the disadvantages of the prior art by providing a baler which is state-of-the-art and energy efficient, and is more accessible to being maintained for the gatherer hold down and shear beam, as well as other components in efficient maintenance personnel utilization.

SUMMARY OF THE INVENTION

The general purpose of the present invention is a state-of-the-art baler for baling of materials, such as recyclable materials. The baser is computer assisted, and can be operated by one trained operator who is able to control the baler operations for different types of materials, as well as observing the baler operation. The baler system is energy efficient and provides for trained operator control of the baler operations.

According to one embodiment of the present invention, there is provided a baler with a power unit positioned over the gatherer cylinder behind a hopper, a gatherer cylinder with an intensification apparatus, a charging box section, a compression chamber, and ejector cylinder, a bale release device, and wire tier with separate and included power unit. An operator stands between the hopper and the power unit to control baler operations from a computer-assisted console. The rear end of the hopper provides for visual inspection by the operator. The forward end of the hopper is adjacent an ejector ram for ejecting a bale from the compression chamber. Materials are fed into the hopper. The baled material is ejected by the ejector ram and can be disposed of in any fashion, such as on a conveyor, by a forklift, etc.

Significant aspects and features of the present invention include a baler which is computer assisted and user friendly. The baler is also efficient in operation, providing that an operator can view aspects of baler operations, as well as monitor the status of the power units. The operator is in control of baler operations, and is able to view components utilized during the bale operations, such as the ram, the hopper and the material being conveyed into the hopper.

Another significant aspect and feature of the present invention is a baler which is easily adjusted, particularly for the ram hold-down assembly and the shearing knives. The adjustments can be easily performed by a trained individual.

A further significant aspect and feature of the present invention is a baler which can bale different types of materials especially recyclable materials. The operator can easily compensate for the different materials.

Additional significant aspects and features include a baler which is energy efficient and operator friendly. The baler is energy efficient and derives its hydraulic power from a power unit located over the gatherer cylinder. The system is powered from a hydraulic power unit with a vertically mounted and hinged-pivoted motor and hydraulic pump assembly, providing for easy, time-effective access for maintenance or servicing. A separate power unit is provided for wire tying for the baler. Energy efficiency in the hydraulic system is enhanced by the use of an intensification apparatus on the gatherer cylinder, thereby providing a fast efficient hydraulic power unit system with intensified high pressure hydraulic force only when required, providing state-of-the-art embodiments.

Having thus described some of the embodiments of the present invention, it is the principal object hereof to provide a baler which is energy efficient, operator friendly and cost effective for baling of materials on the flow through the hopper, through the charging box, into the compression area, and for subsequent ejection as a strapped bale by an ejector ram.

One object of the present invention is a baler which is readily controlled by an operator through a computer-assisted operator console, which is adjacent to the hopper so that the operator has real time control and observation basis for baler operations.

Another object of the present invention is to provide a baler which bales material flowing into the operator, providing for change-over between different types of materials, such as recyclable materials. This is especially important for baling of recyclable materials, where some of the quantities may be small, but it is desirous to efficiently change over from one type of material to another type of material on the flow. Such an example is the baling of these types of recyclable materials, such as corrugated materials, news print, magazine papers, computer papers, flattened cans, round cans, plastic bottles, scrap aluminum, scrap copper, aluminum radiators, and other miscellaneous materials too numerous to mention, but certainly within the scope and teachings of the present invention and not limiting of the present invention.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein:

FIG. 13A illustrates an operations plan of the hydraulic system;

FIGS. 14A1-14ZZ illustrate the electrical schematic and electrical connections for the baler.

DESCRIPTION OF THE PREFERRED EMBODIMENTS

Figure 1:
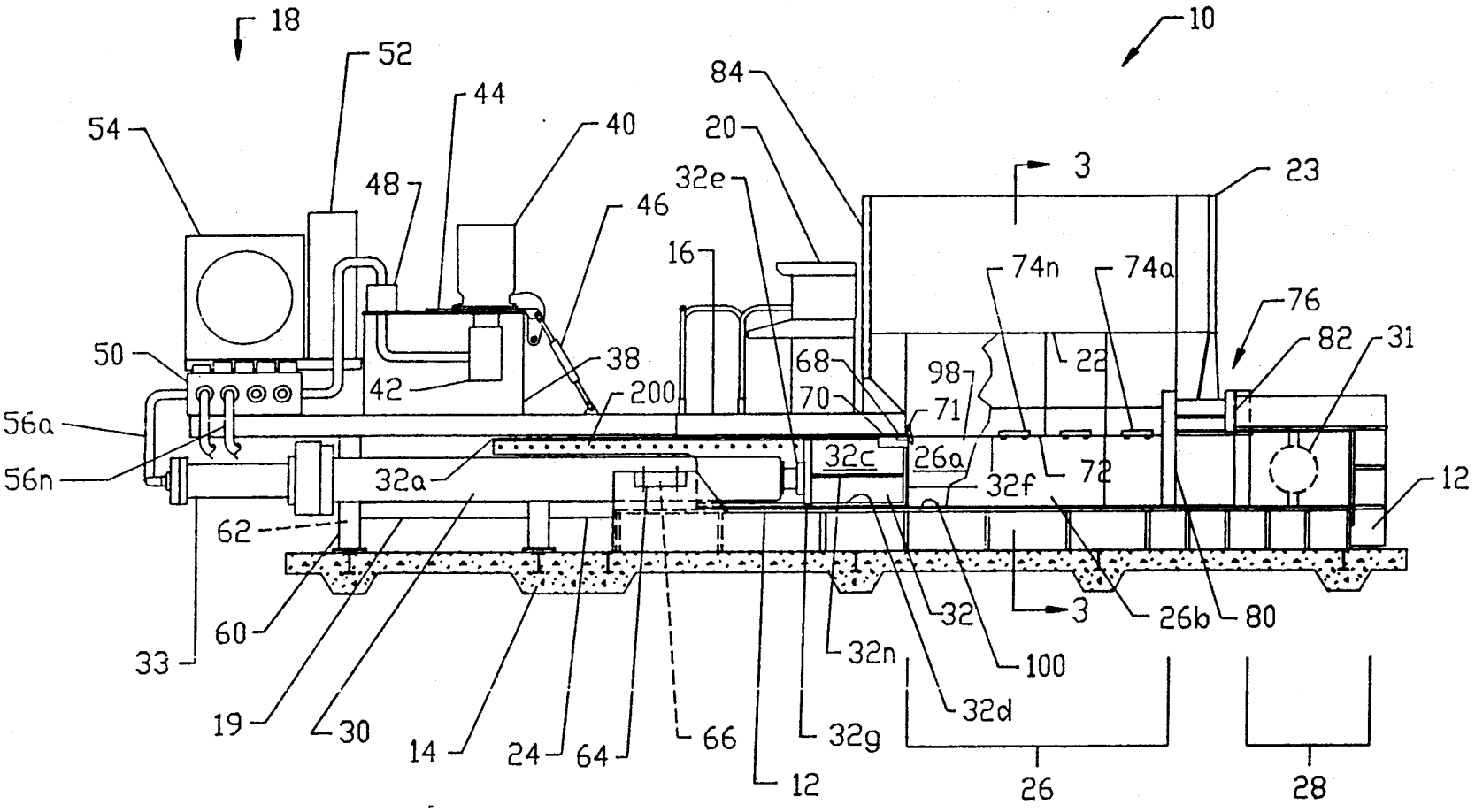
FIG. 1 illustrates a side view in cutaway of the baling system, the present invention.

FIG. 1 illustrates a side view in cutaway of a baler 10, the present invention. The baler 10 includes a charging box-press box framework structure support 12 upon which numerous component members are secured and attached, and is illustrated mounted to a slab or a pad 14. A gathering deck 16 aligns and secures to the upper portion of the framework structure support 12. A power unit 18 mounts on a power unit frame 19, and an operator console 20 mounted on gathering deck 16. A hopper 22 with hopper extensions 23 aligns to the right of the gathering deck 16. A conveyor 23*a*, powered by a conveyor motor 23*b*, feeds material to hopper 23. Several chambers, including a gatherer ram area 24, a charging box chamber 26, a bale compression chamber 28, and a bale exit chamber 29 align horizontally with respect to each other, and position generally beneath the gathering deck 16 and below or adjacent hopper 22 as illustrated. Material to be baled is loaded in the hopper 22, and is fed by gravity into the charging box chamber 26. A gatherer cylinder 3 and an intensifier cylinder 33 align in the gatherer ram area 24 to power a gatherer ram 32, which forcibly moves the material to be baled from the charging box chamber 26 into the bale compression chamber 28. After material is compressed, an ejection cylinder 31 shown in dashed lines and an ejection ram 34, illustrated in FIG. 2, ejects the bale.

The power unit 18 on the power unit frame 19 includes a number of connected components, including a hydraulic reservoir box 38, motor 40 and staged pump 42 mounted on a operated pivot base 44, a pivot base actuator 46 secured between the pivot base 44 and the power unit frame 19. A manifold 48 connects to the staged pump 42, a second manifold 50, a filter 52 and a cooling fan 54. A plurality of manifold pipes 56*a*-56*n* connect to the gatherer cylinder 30, the ejection cylinder 31 and to the bale release cylinder 58 of FIG. 2.

Figure 4:
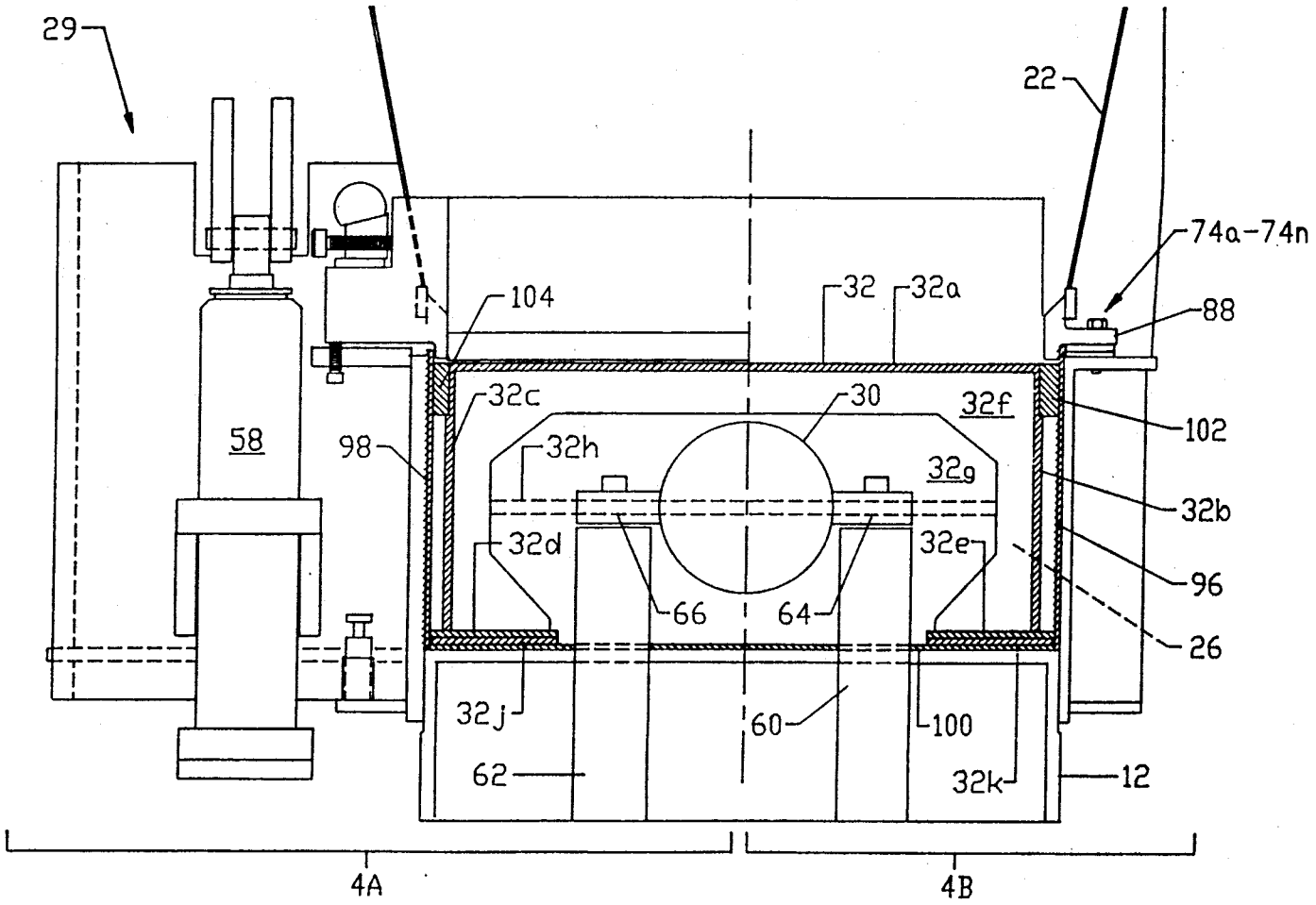
FIG. 4 illustrates partial cross-sectional views 4A and 4B along lines 4A—4A and 4B—4B of FIG. 2.

The gatherer cylinder 30 aligns and secures in the gatherer ram area 24, and secures on the outboard end by power unit frame 19 and mounted vertical cylindrical supports 60 and 62 illustrated also in FIG. 4. The inboard end of the gatherer cylinder 30 secures to the framework structure support 12 by horizontal cylinder mount pads 64 and 66 on opposing sides of the gatherer cylinder 30. The gatherer ram 32 is generally of an open rear box shape which secures to the gatherer cylinder 30 and is illustrated further in FIG. 4. The upper leading edge of the gatherer ram 32 includes a gatherer ram knife 68 and a shear knife holder 70, which extend across the leading edge of the gatherer ram 32, and is an integral part of the gatherer ram. A sweeper 71 secures in the hopper to remove debris on the gatherer ram 32 during the retraction mode.

A charging box chamber 26 aligns beneath the hopper 22, and includes a left charging box side frame 26*a* and a right charging box side frame 26*b*. A charging box flange 72 extends perpendicularly and outwardly from the top of the right charging box side frame 26*b*. A plurality of hold down adjustors 74*a*-74*n* secure and align to the charging box flange 72 to adjust a hold down bar as later described in detail. A shear beam assembly 76 mounts between heavy vertical supports 80 and 82, each of which secure to the framework structure support 12. The shear beam assembly 76 extends from the left side of the framework structure support 12 to the right side, and attaches to heavy vertical supports similar to vertical supports 80 and 82, which are not illustrated for purposes of brevity and clarity.

A viewing panel assembly 84, such as Lexan®, is located on the inboard wall of the hopper 22 so that the operator can visually view and monitor the interior of the hopper 22 and the charging box chamber 26.

Figure 2:
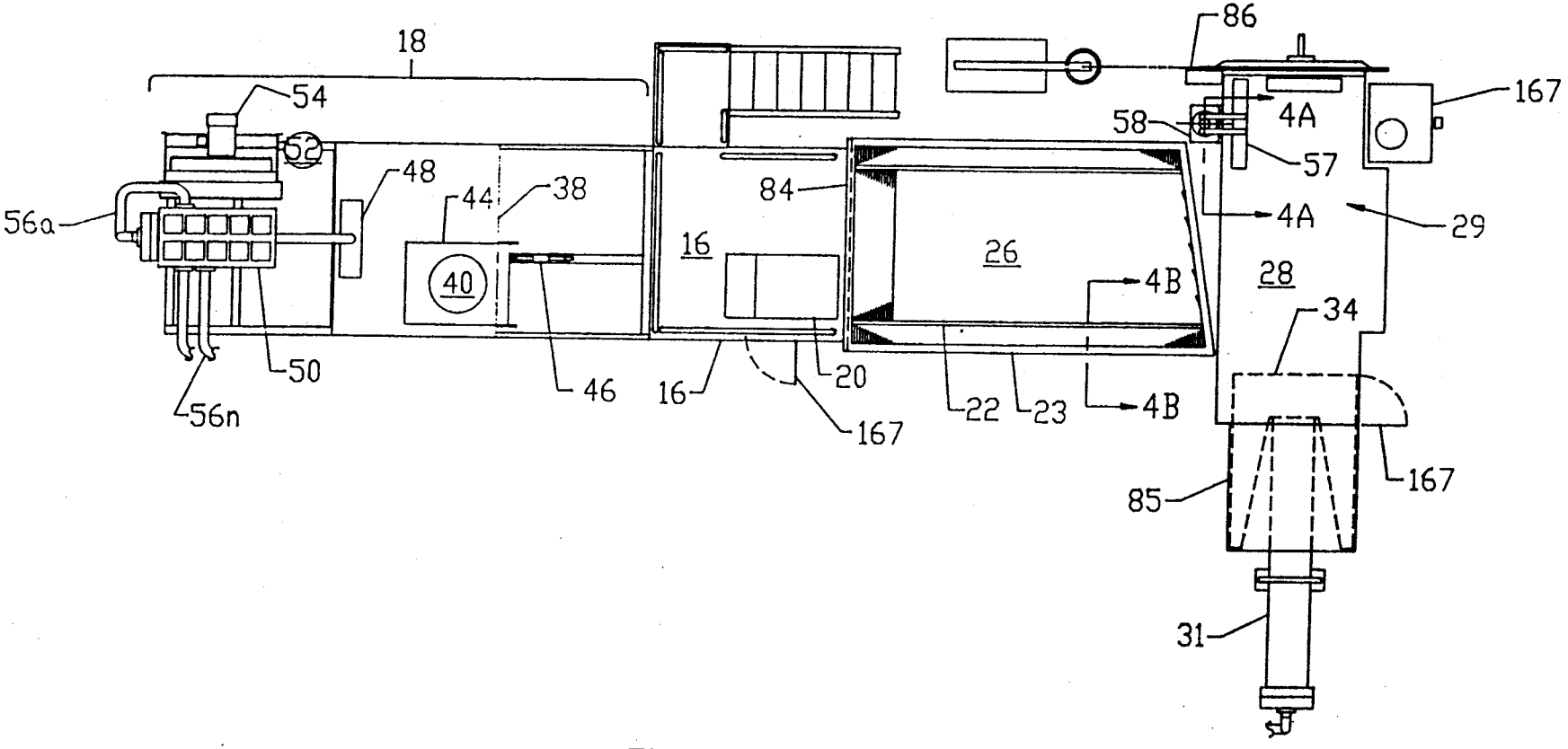
FIG. 2 illustrates a top view of the baling system.

FIG. 2 illustrates a top view of the baler 10 where all numerals correspond to those elements previously described. Illustrated in particular is the ejection cylinder 31 and ejection ram 34 in an ejector ram housing 85 which ejects baled material from a bale compression chamber 28 and through the bale exit chamber 29. A wire tier 86 is provided for tieing and binding of the bales at the exit of the bale exit chamber 29. Also, in the top view is a bale release 57 and a bale release cylinder 58. Access covers 167 are provided for maintenance or service of the baler.

Figure 3:
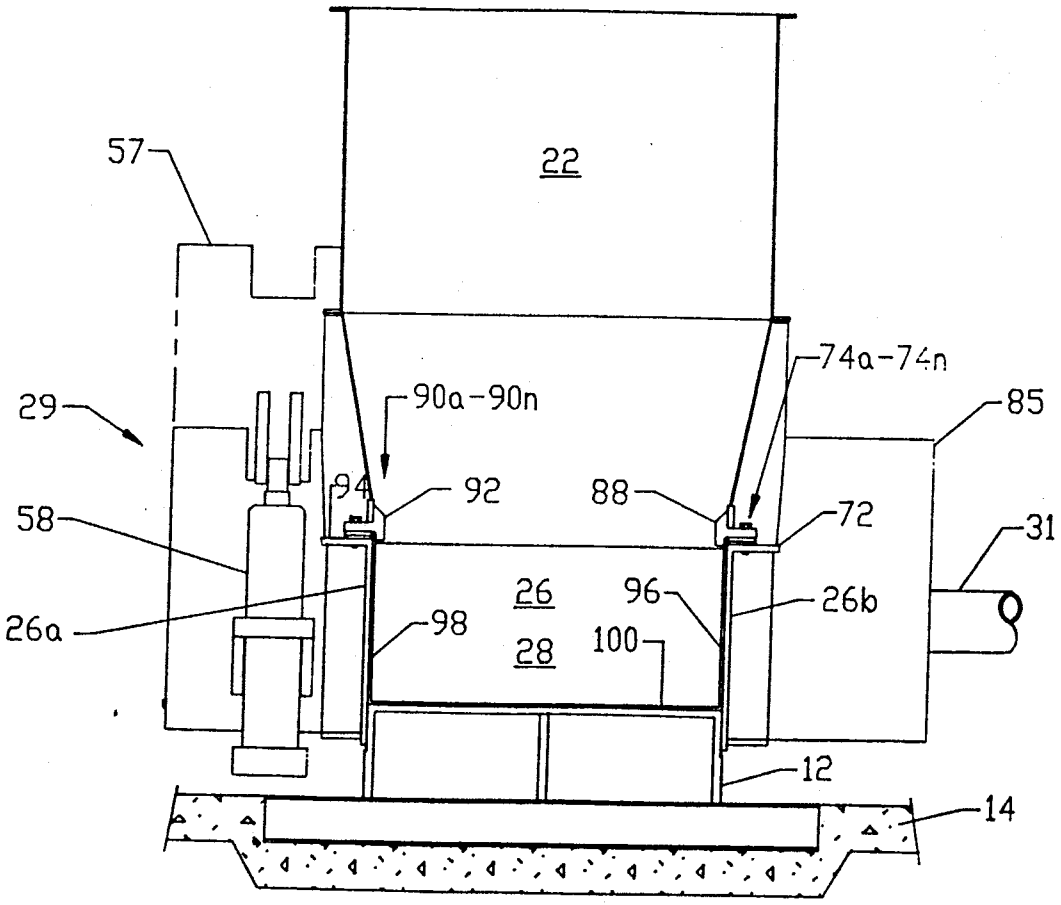
FIG. 3 illustrates a cross-sectional view along line 3—3 of FIG. 1.

FIG. 3 illustrates a cross-sectional view along line 3—3 of FIG. 1 where all numerals correspond to those elements previously described. Illustrated in particular is the alignment of the hold down adjustors 74*a*-74*n*, and a hold down member 88 with a relationship to the charging box flange 72 and the lower right charging box side frame 26b. Similar hold down adjustors 90a–90n and a hold down member 92 align and secure to a left charging box flange 94 extending perpendicularly from the lower left charging box side frame 26a. The gatherer ram 32 is not illustrated for purposes of brevity. A side frame liner 96 aligns to the inner surface of right charging box side frame 26b, a steel side frame liner 98 aligns to the inner surface of the left charging box side frame 26a and a steel liner 100 aligns with the horizontal portion of the framework structure support 12 to line the interior of the charging box chamber 26. The frame liners 96, 98 and 100 substantially extend longitudinally in both directions to line appropriate surfaces of the bale compression chamber 28. A bale release cylinder 58 raises a bale release 57 which provides additional expansion area allowing the ejection of most oversized bales. This minimizes baler down time due to oversize bale jamming of the baler.

Figure 6:
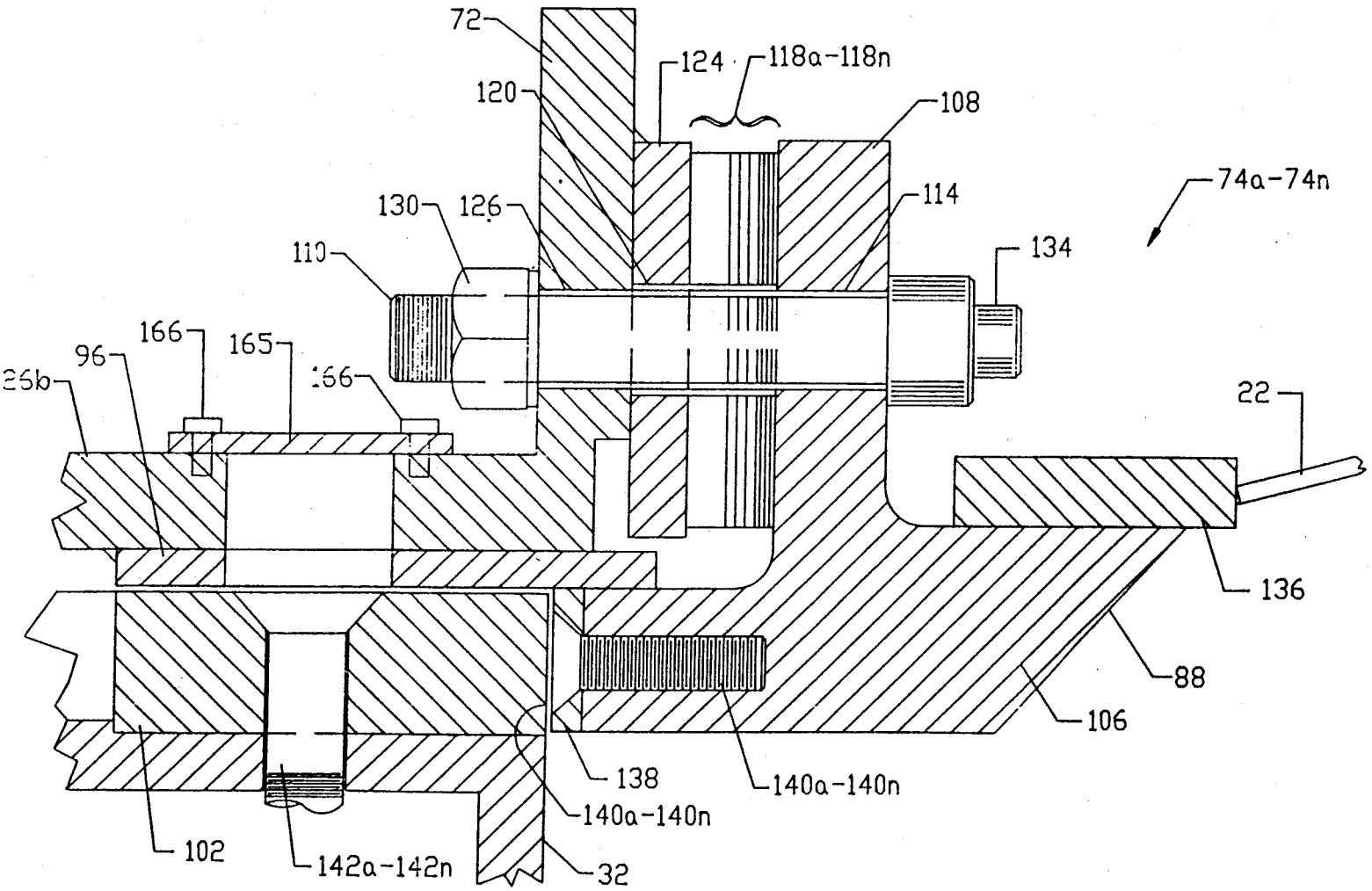
FIG. 6 illustrates a cross-sectional view of the hold-down adjuster along line 6—6 of FIG. 5.

FIG. 4 illustrates partial cross-sectional views 4A and 4B along line 4A—4A and 4B—4B of FIG. 2 and including the gathering ram structure where all numerals correspond to those elements previously described. Gatherer ram 32 is illustrated in engagement with the charging box chamber 26. The gatherer ram 32 includes a top planar member 32a, planar side member 32b, planar side member 32c, lower horizontal planar members 32d and 32e and a front member 32f. A face plate 32g, a horizontal member 32h, and a split ring plate 32i, illustrated in FIG. 1, are also included. Split ring 321 bolts the forward end of the gatherer cylinder 30 to mount plate 32g as illustrated in FIG. 1. Gatherer ram liners 102 and 104 secure to the upper outer edges of the planar side members 32b and 32c of the gatherer ram 32, and slidingly engage the side frame liners 96 and 98, respectively. Liners 32j and 32k bolt to the members 32d and 32e. The gatherer ram liners 32j and 32k slidingly engage the bottom frame liner 100, as well as the side frame liners 96 and 98. Any vertical movement of the gathering ram liners 102 and 104 is restricted and/or guided by the vertical and horizontal hold down members 106 and 108 as found in the hold down members 88 and 92 and as illustrated in FIG. 6. Adjustment of the hold down members 88 and 92 is described later in detail.

Figure 5:
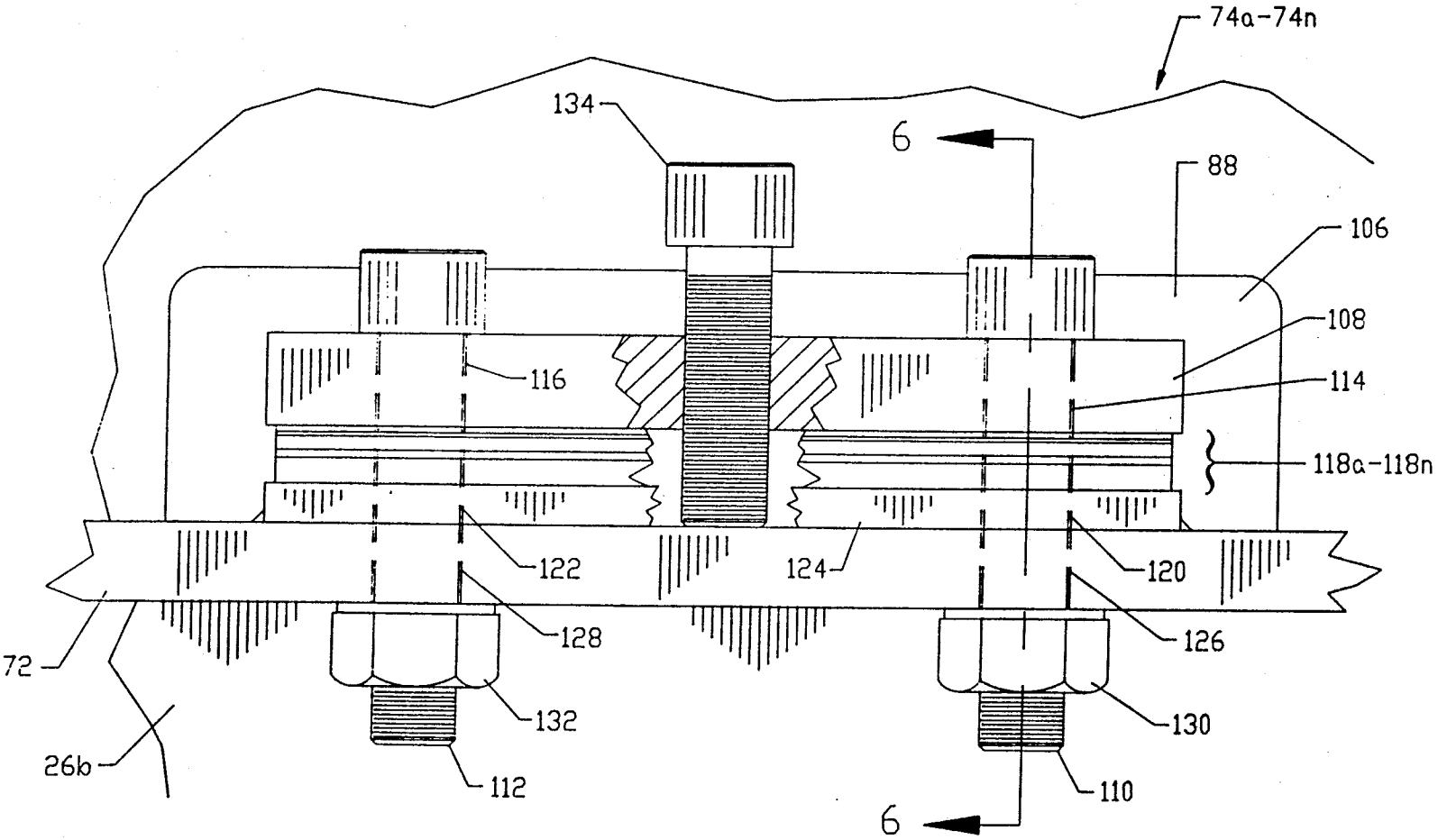
FIG. 5 illustrates a front view of the hold-down adjuster.

FIG. 5 illustrates a front view of hold down adjusters 74a–74n for adjustment of a hold down member 88 where all numerals correspond to those elements previously described. The hold down member 88 includes a vertical hold down member 106 and a horizontal hold down member 108. Bolts 110 and 112 pass through holes 114 and 116 in the horizontal hold-down member 108, through a plurality of shim plates 118a–118n, through holes 120 and 122 in a fixed shim 124, through holes 126 and 128 in the charging box flange 72, and are secured by nuts 130 and 132 drawn tight against the charging box flange 72. The horizontal hold-down member 108 extends horizontally from the vertical hold-down member 106, as illustrated in the following figure. Initial vertical adjustment of the vertical hold-down member 106 is effected by movement of an adjustment cap screw 134, which threadingly engages the horizontal hold-down member 108. The lower end of the adjustment cap screw 134 rests upon the upper surface of the charging box flange 72 to support the horizontal hold-down member 108 above the upper surface of the charging box flange 72 so that once proper alignment is achieved, shim plates 118a–118n of varying thickness can be positioned between fixed shim 124 on the upper surface of the charging box flange 72 and the lower surface of the horizontal hold-down member 108 as required for proper alignment. After proper vertical alignment and insertion or removal of the shim plates 118a–118n, nuts 130 and 132 are tightened against the charging box flange 72 to insure positive positional fixation.

FIG. 6 illustrates a cross-sectional view of the hold-down member 88 including the horizontal hold-down member 108 and the vertical hold-down member 106 generally along line 6—6 of FIG. 5 where all numerals correspond to those elements previously described. Illustrated in particular is the alignment of the gatherer ram 32 with the hold-down member 88 and the lower right charging box side frame 26b. An upper charging box side frame 136 supports the upper portion of the vertical hold-down member 106 as illustrated, and guides the vertical adjustment of the hold-down member 88. A hold-down liner 138, in the form of a long steel bar, secures to the lower portion of the vertical hold-down member 106 with a plurality of fasteners 140a–140n, such as machine screws. The hold-down liner 138 secures longitudinally and continuously along the length, and from hold-down adjuster 74a to hold-down adjuster 74n, each of which are adjusted to the same height. A side frame liner 96 aligns and secures to the inner surface of the lower right charging box side frame 26b. The gatherer ram liner 102 secures to the gatherer ram 32 with a plurality of machine screws 142a–142n. The gatherer ram liner 102 guides the gatherer ram 32 with respect to the hold-down liner 138 and the side frame liner 96. The upper surface of the gatherer ram liner 102 is guided vertically by the hold-down liner 138, and the side surface of the gatherer ram liner 102 is guided horizontally by the side frame liner 96. The various liners can be detached and replaced for proper maintenance. Cover plate 165 is bolted to side frame 26b and can be removed for access to cap screws 142a–142n, holding liner 102 to gatherer ram 32. Hold down members 92 are mirror images of the hold down 88 and perform a like function.

Figure 7:
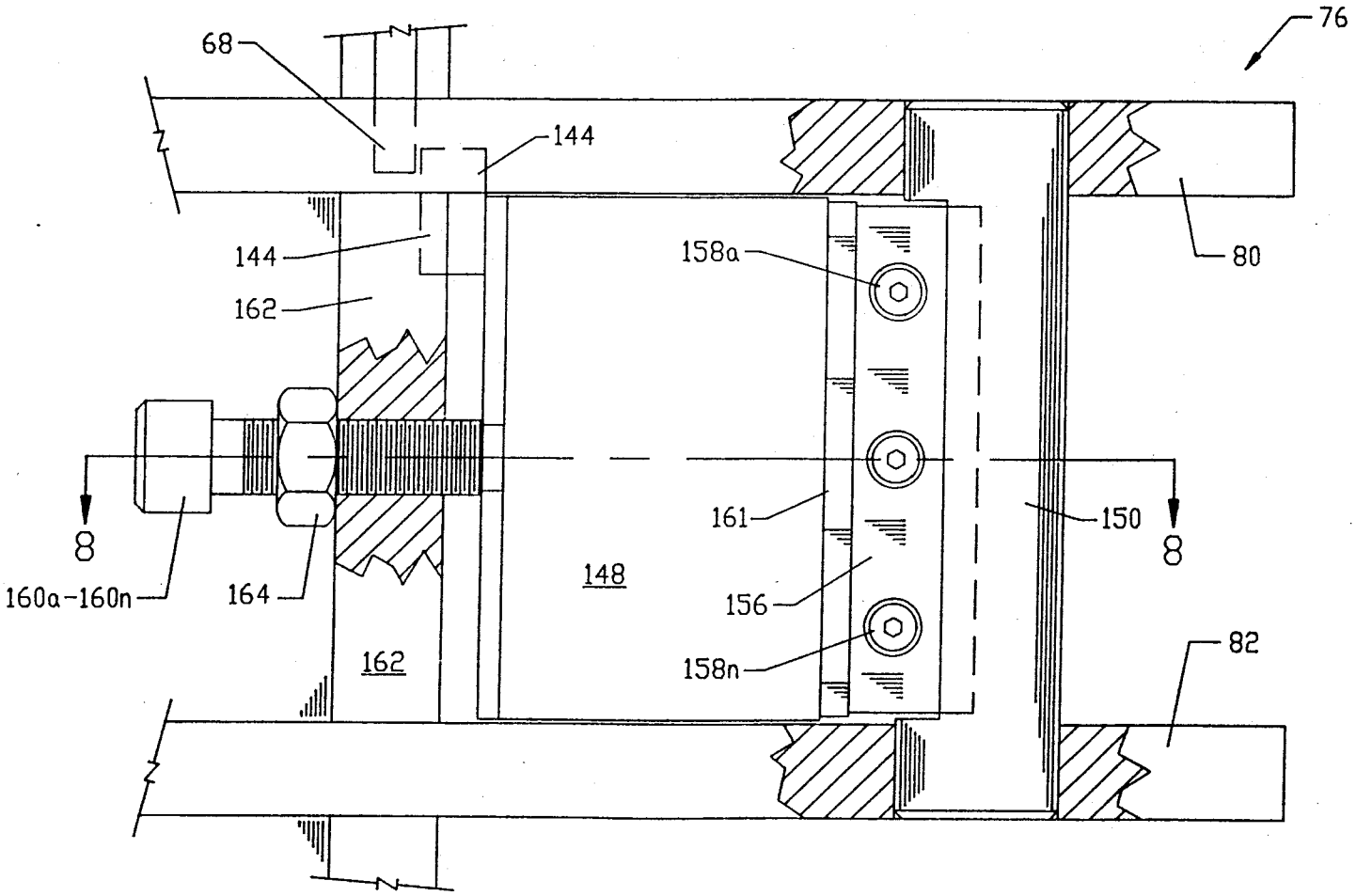
FIG. 7 illustrates a front view of the shear beam assembly.

FIG. 7 illustrates a front view of the shear beam assembly 76 where all numerals correspond to those elements previously described. Reference is also made to components illustrated in FIG. 8. The shear beam assembly 76 aligns a shear beam knife 144 with a gatherer ram knife 146. The shear beam knife 144 is secured in the shear beam 148 with a plurality of cap screws (not illustrated). The ram knife 144 is secured in the gatherer ram 32 with cap screws (not illustrated). The edges of the knives 144 and 146 are finished for shearing. The shear beam assembly 76 mounts between two vertical support members 80 and 82 and across the device to two like vertical members (not illustrated). The shear beam knife 144 aligns across and secures to the lower region leading edge of the shear beam 148. Both ends of the shear beam 148, and thus the shear beam knife 144, are vertically adjusted by shear beam adjustment assemblies 76 on opposing sides of the device. One shear beam adjustment assembly including a fixed pin 150 aligns longitudinally between the vertical supports 80 and 82. The fixed pin 150 is generally cylindrical in shape, but includes an angled planar surface 152 along its lower region. This planar surface 152 aligns with and is supported by an angled planar surface 154 of an adjustment gib 156. A plurality of adjustment cap screws 158a–158n threadingly engage the gib 156 so that the gibs on opposing sides of the shear beam 148 may be positioned to provide incremental vertical adjustment of the shear beam knife 144. The adjustment gib 156 aligns and rests on a fixed shim 161. When the vertical adjustment of the shear beam knife 144 has been accomplished with reference to the gatherer ram knife 146, the beam adjustment cap screws 160a–160n, which threadingly engage the charging box flange 162, is secured by a lock nut 164 against the lower surface of the charging box flange 162.

Figure 8:
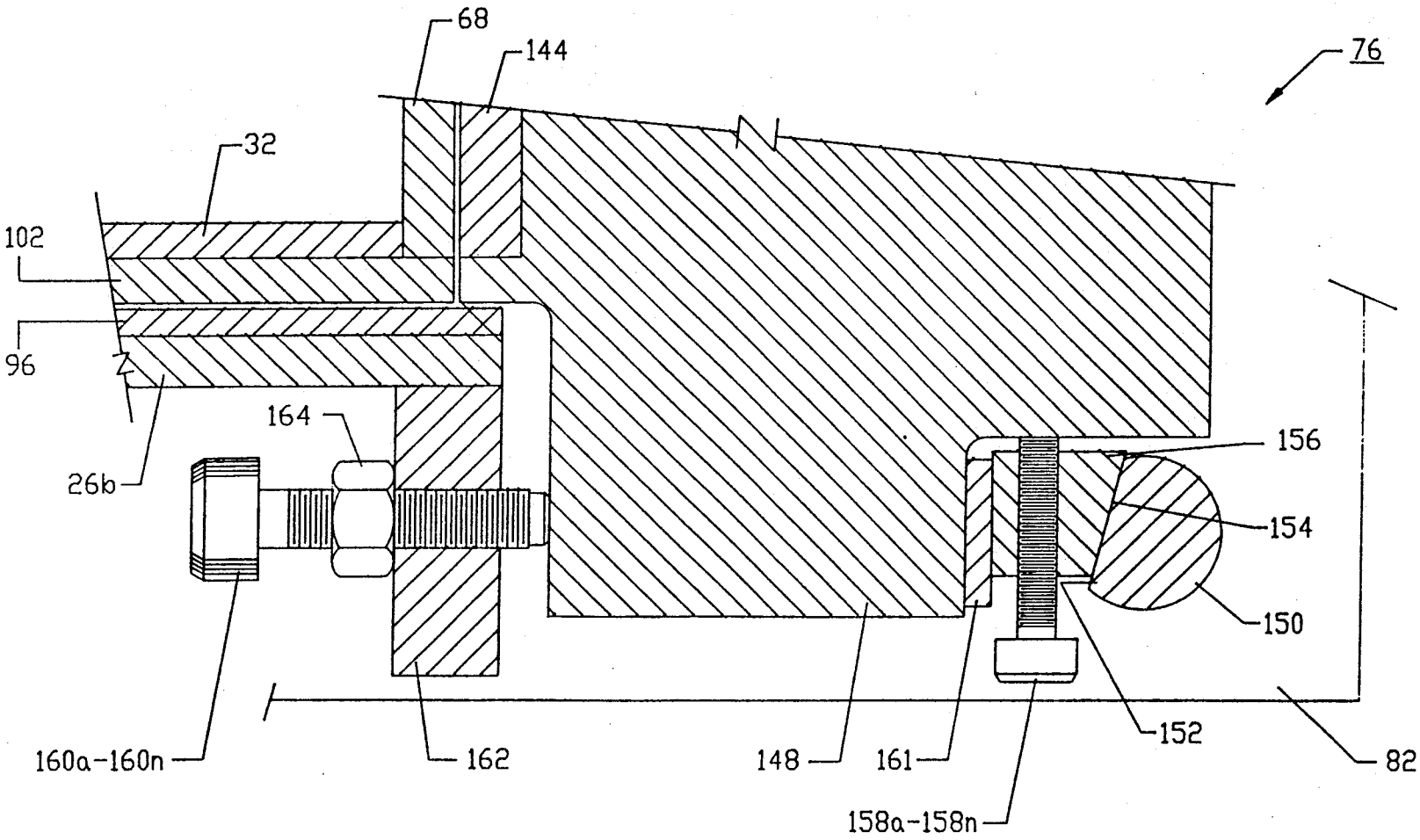
FIG. 8 illustrates a cross-sectional view of the shear beam assembly along line 8—8 of FIG. 7.

FIG. 8 illustrates a cross-sectional view along line 8—8 of FIG. 7 where all numerals correspond to those elements previously described. Illustrated in particular is the alignment of the fixed pin 150, the adjustment gib 156, the shear beam 148, and of the shear beam knife 144 with the gatherer ram knife 146.

Figure 9:
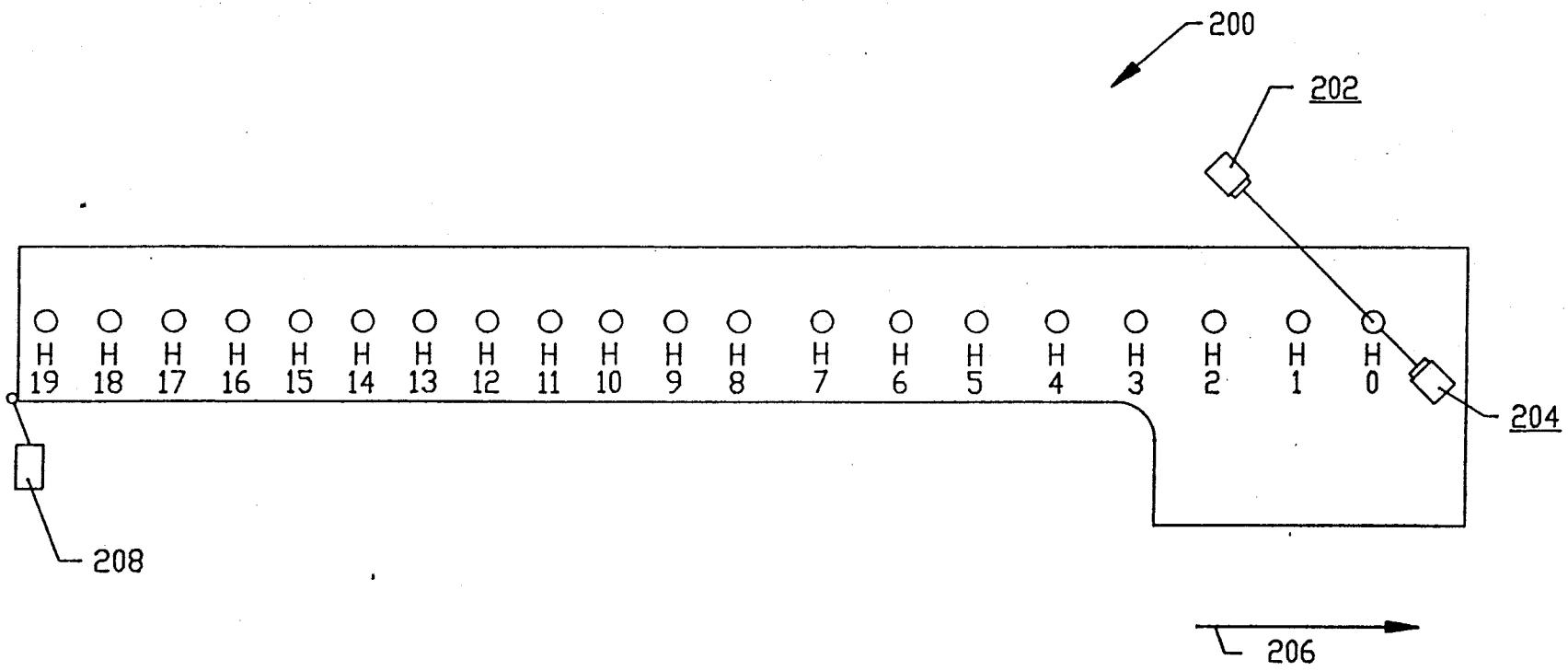
FIG. 9 illustrates a side view of the ram travel template.

FIG. 9 illustrates a side view of the ram travel template 200 which secures to and travels with the gatherer ram 32. Positional information for the ram is sensed by a photoelectric sensor transmitter 202 and receiver 204 and is used by the computer control to condition movement of the ram cylinder 30 with reference to ram location. The photoelectric transmitter 202 and receiver 204 oppose each other on opposing sides of the holed template 200. A plurality of holes, including holes H0 through H19, align with the decreasing spacing along the template 200. The photo sensors 202–204 count holes as the template 200 and ram travel forward in the direction of the arrow 206, as well as in the direction opposite to the arrow 226. Ram position is displayed on the operator's PC in the console 20. A proximity switch 208 verifies the normal retracted position of the ram.

When the ram 32 is operating in the normal auto cycle, the following events occur at specific hole locations. The gathering ram 32 advances in differential until reaching hole H8 or until the hydraulic pressure reaches a level of 1750 psi. Differential is the term used to indicate that the gathering cylinder and ram are advancing or extending because of the differential on opposing surface areas of the gathering cylinder piston in that there is more area on the back of the cylinder than on the front. The hole out of the front head comes around and goes through a valve and back to the rear head along with the pump flow thereby having more speed and less force in the differential mode. As the ram continues, if hole H11 is not reached within 7 seconds of passing hole H9 and the pressure reaches 3000 psi, the intensifier cylinder 33 is activated to stroke to cut obstructions at the knives 68 and 144. Should the ram 32 not reach hole H11 after the intensifier 33 stroke times out at 7 seconds, the intensifier cylinder 33 will reset and forward motion resumed. If H11 is not reached on the second attempt, the stack ram alarm on the operator console 20 will signal. Advancement to hole H11 indicates that the knives 66 and 144 have crossed and the ram continues its forward advancement in differential to hole H16. The ram continues forward motion to the point of over traveling into the bale compression chamber 28 and vents down to 3000 psi at hole H18. Once in the bale compression chamber 28, the ram will reverse direction at hole H19 or will accomplish various short stroke distances based on the last hole sensed and density pressure. After material is gathered to make density pressure between holes H14 and H15, the ram positions on hole H14 and signals the ejector that a bale has been made. Normal retraction (not positioning for ejection) is made with full pump flow hydraulic pressure until hole H1 is reached or to a hole prior to the short stroke limit where valve 306a, valve 304 and valve 308 are sequentially vented for ram reversal. Positioning of the ram for bale ejection only vents valve 304 and valve 308 for precise positioning on hole H14.

Figure 10:
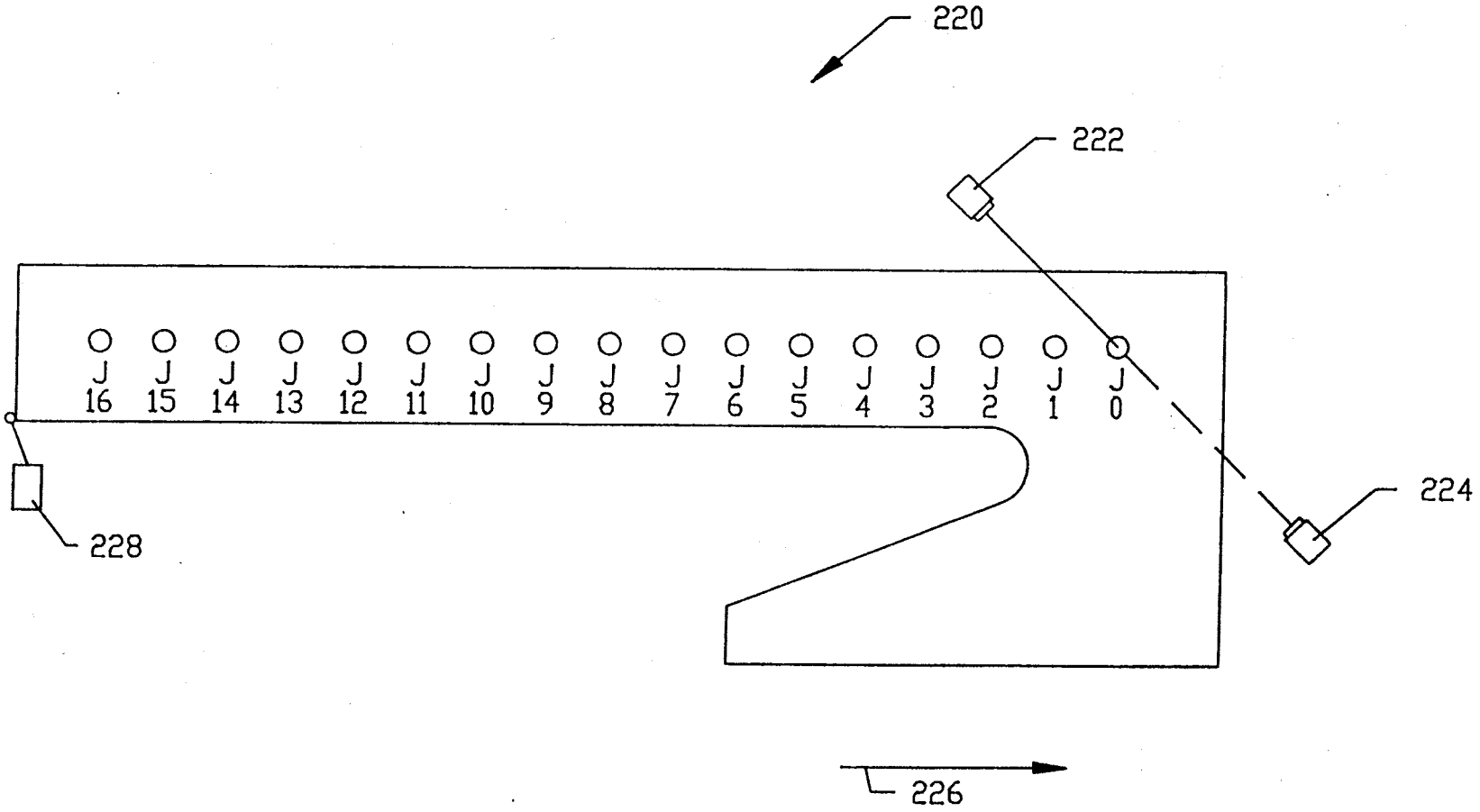
FIG. 10 illustrates a side view of the ejector ram travel template.

FIG. 10 illustrates a side view of the ejector ram travel template 220 which secures to and travels with the ejector ram 34. Positional information for the ejector ram 34 is sensed by a photoelectric sensor transmitter 222 and receiver 224, and is used by the computer to control movement of the ejector ram cylinder 31 and to determine the style of and pattern of banding to be applied around and about a bale. The photoelectric transmitter 222 and receiver oppose each other on opposing sides of the holed template 220. A plurality of holes, including holes J0 through J16 align along the template 200. The photo sensors 222–224 count and sense holes as the template 220 and ejector ram 34 travel forward in the direction of the arrow 22b. The ejector ram position is displayed on the operator's PC in the console 20. A proximity switch 228 and photoelectric sensing of hole J0 verify the normal retracted position of the ejector ram 34. If the template 220 travel exceeds hole J16, the photoelectric sensors 222–224 sense a "hole J17". Strapping in the automatic and semi-automatic mode are signaled by the photoeleotric sensing system seeing selected holes for given strap patterns A, B, C or D. The following chart exhibits "patterns" and "strapping at holes" and "wire numbers".

TABLE 1

| Pattern | Strap @ Holes | |
|---|---|---|
| A | 2, 4, 6, 8, 10, 12, 14 & 16 | 8 wires @ 7 7/8 sp |
| B | 1, 4, 7, 11 & 14 | 5 wires @ 11 13/16 sp |
| C | 1, 5, 8 & 13 | 4 |
| D | 3, 7, 11 & 15 | |

These patterns allow the operator to pick the strapping sequence best suited for a particular grade of the material or density. If the hole "J17" is sensed by the photoelectric system 222–224, the ejector ram 34 is in over travel as used by the hand or manual mode. The strapper is then cycled by a push button.

Figure 11:
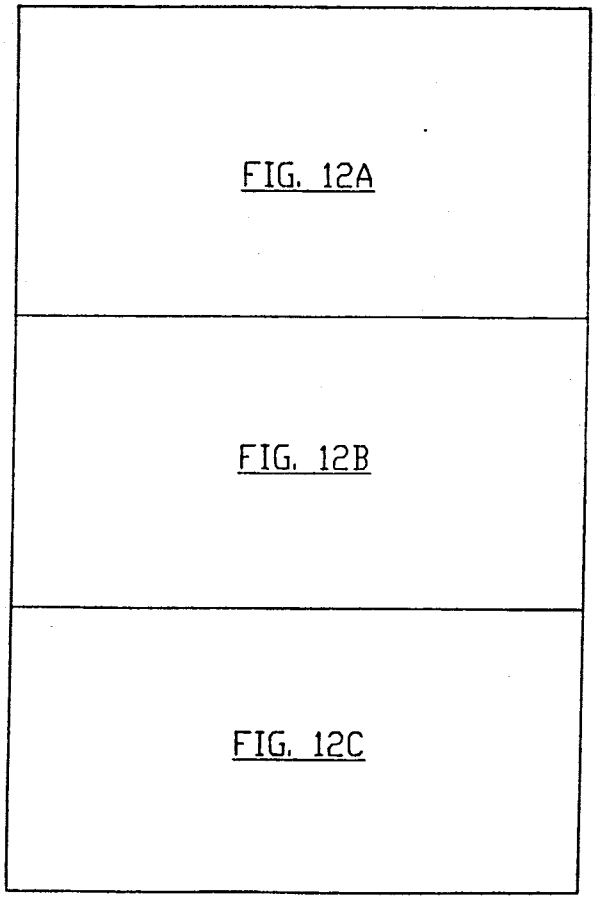
FIG. 11 illustrates the relational positioning of FIGS. 12A, 12B, and 12C.
Figure 12A:
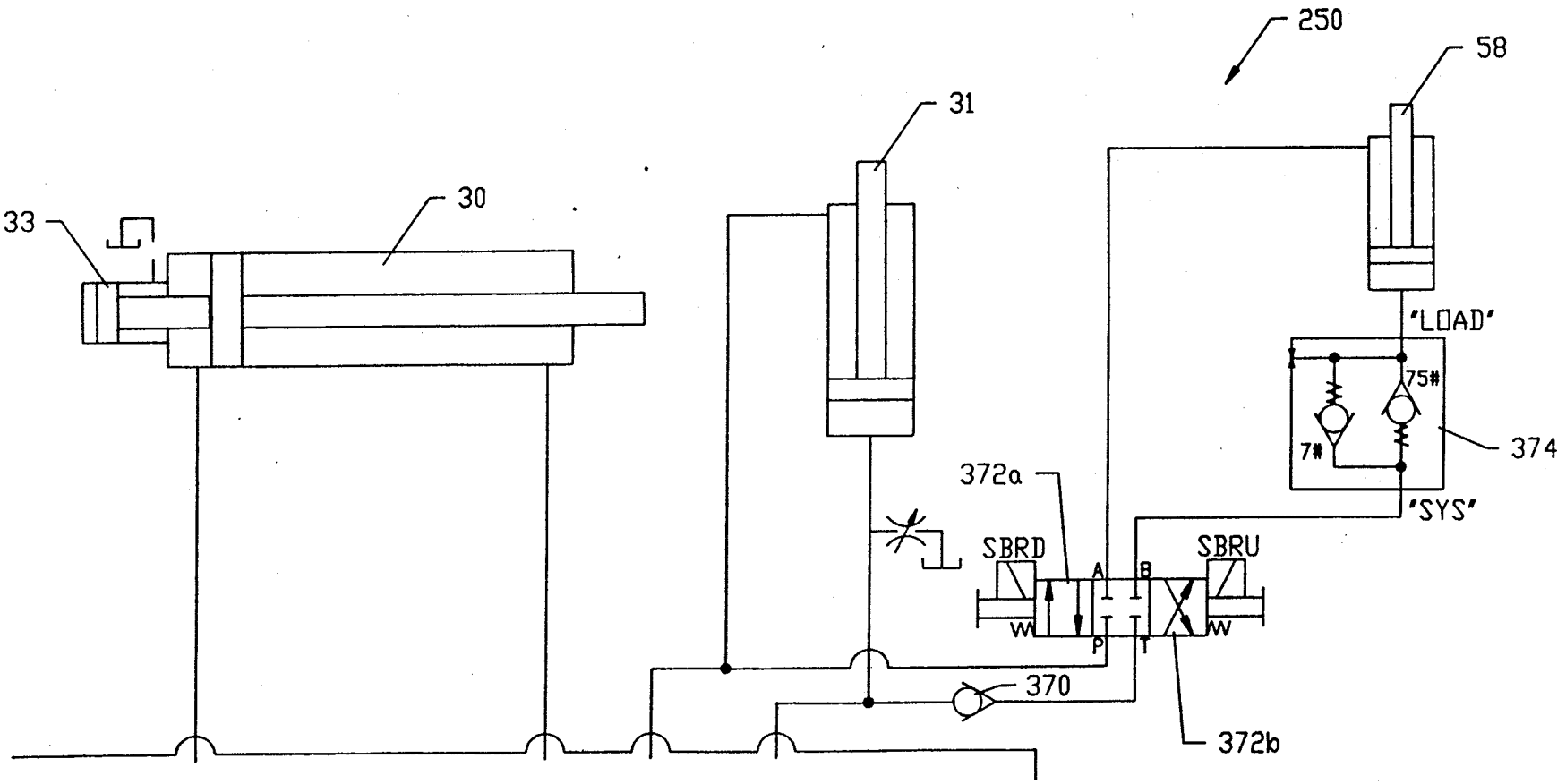
FIGS. 12A-12C illustrate the hydraulic system.
Figure 12B:
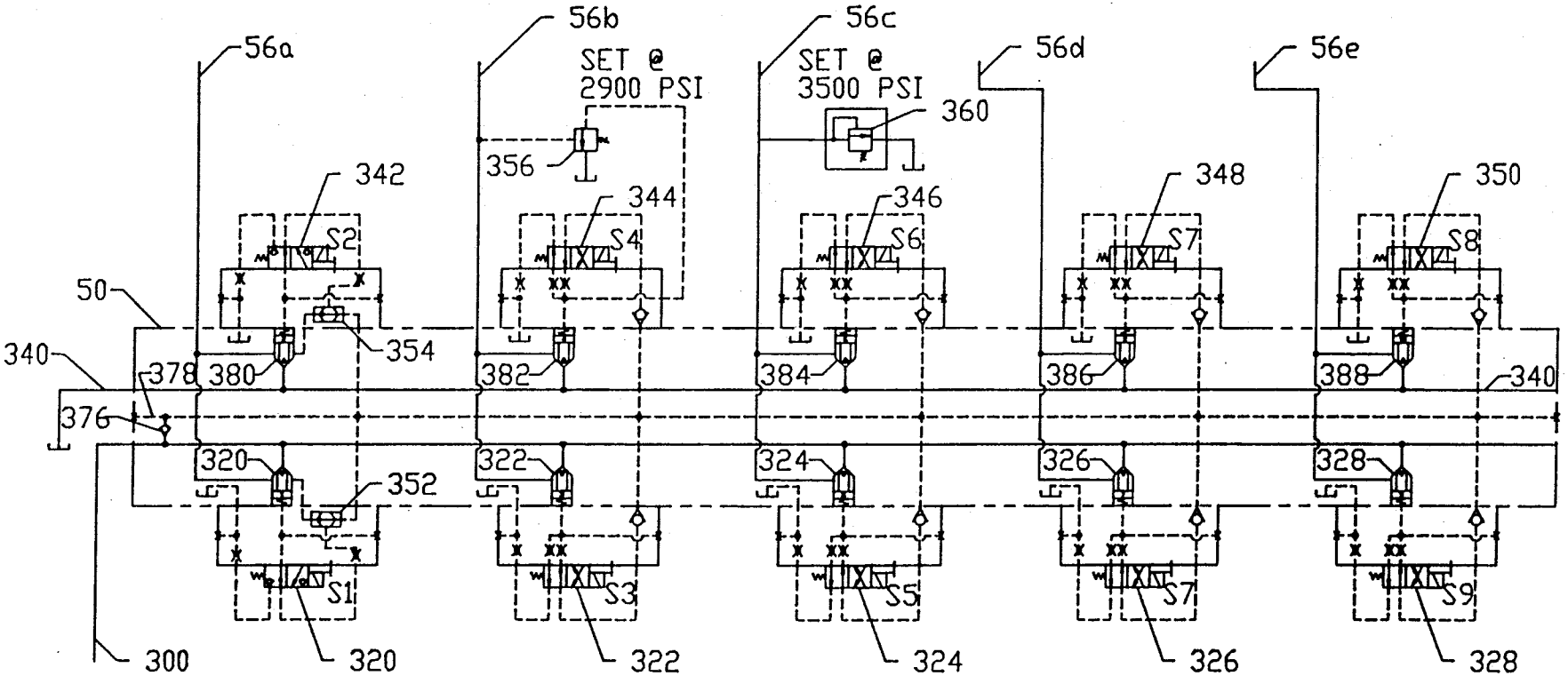
Figure 12C:
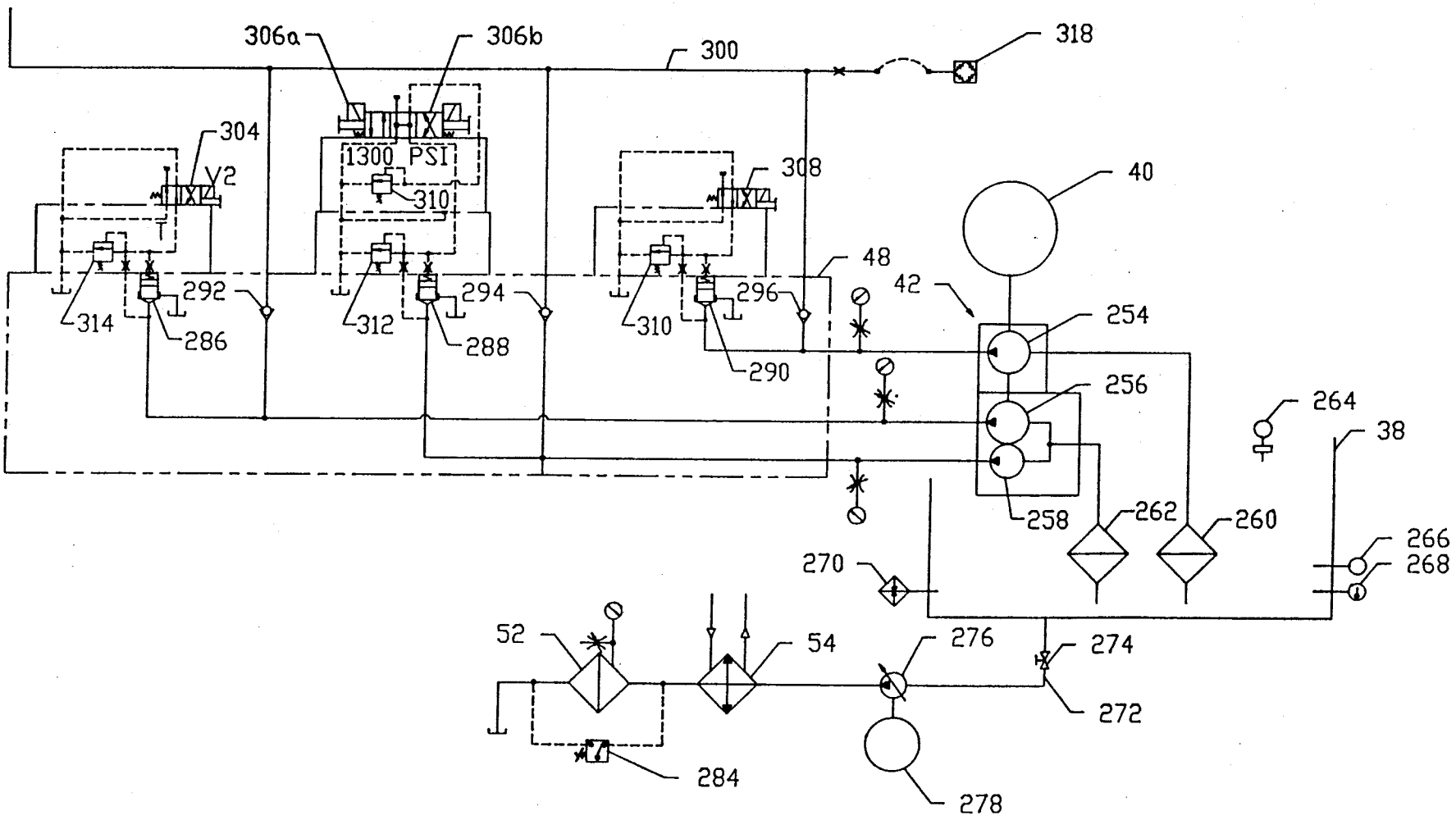

FIG. 11 illustrates the relational positioning of FIGS. 12A, 12B and 12C of the hydraulic system.

FIGS. 12A, 12B and 12C illustrate the hydraulic system 250 where all numerals correspond to those elements previously described. A reservoir 38 provides a hydraulic fluid supply for a 100 gpm pump 254, a 100 gpm pump 256 and a 69 gpm pump 258 which are driven by a motor 40. The reservoir 38 also includes input filters 260 and 262 for the pumps, a float switch 264, a resistive temperature probe 266, thermometer 268 and a heater 270. Tank input piping 272 includes a globe valve 274, a circulation motor and pump 278 and 276, an oil cooler 54, a filter 52 and a differential switch or clogged filter indicator switch 284 across the filter 52 which signals a clogged filter to the computer. Appropriate piping connects the output of the pumps 254, 256 and 258 to their respective poppet valves 286, 288 and 290 and respective check valves 292, 294 and 296 in a manifold 298. Pressurized fluid is out putted from the check valves 292–296 to a common pressure line 300 and routed to a manifold 502. Four way solenoid shut off valves 304, 306a, 306b and 308 are computer controlled and energized to allow flow through poppets 286–290, respectively. Valves 306a and 306b are contained in a common housing. The four way shut off valve 306 is operated by a dual solenoid. Pressure relief at 1300 psi and 3000 psi is provided by pressure relief valves 310 and 312, respectively. A pressure relief valve 314 is associated with poppet 286 and the four way shut off valve 304 for relief at 1800 psi. Another pressure relief valve 316 is associated with poppet 290 and the four way shut off valve 308 for relief at 3050 psi. A system pressure transducer 318 senses system pressure at the pressure line 300, as well as the pressure at any element that is opened to the system, which is sensed by the computer.

A plurality of poppet valves including poppet valves 320, 322, 324, 326 and 328 in manifold 50 connect to the pressure line 300, and in turn, to the gathering cylinder 30, the ejector cylinder 31, the bale release cylinder 58 and the intensifier cylinder 33 as illustrated. Poppet valves 380–388 and controlled by a three way solenoid valve 320 and four way shut off valves 322–328, respectively.

Another plurality of poppet valves, including poppet valves 330, 332, 334, 336 and 338 connect to a tank return line 340 in manifold 50 and to the gathering cylinder 30, the ejector cylinder 31, the bale release cylinder 58 and the intensifier 33 as illustrated. The poppet valves 330–338 are controlled by a three way direct solenoid poppet valves 342 and four way shut off valves 344–350, respectively. Shuttle valves 352 and 354 are also included in conjunction with poppet 320 and 330, respectively. An unloading valve 356 is plumbed to line 56*b* leading to the gathering cylinder 30 and is set at 2900 psi. Another unloading valve 360 is plumbed to line 56*c* leading to the ejector cylinder 31 and bale release cylinder 58. Line 56*a* connects the poppet valves 320 and 330 to the gathering cylinder 30, line 56*b* connects the poppet valves 322 and 332 to the gathering cylinder, line 56*c* connects the poppet valves 324 and 334 to the ejector cylinder 31 and bale release cylinder 58, line 56*d* connects the poppet valves 326 and 336 to the ejector cylinder 31 and bale release cylinder 58, and line 56*e* connects poppet valves 328 and 338 to the intensifier cylinder 33. Line 56*d* includes a check valve 370 and also connects through a common housing four way solenoid operated shut off valves 372*a* and 372*b*, and through a counter balance valve assembly 374 to the bale release cylinder 58. Line 56*c* also connects through the four way solenoid operated counter balance valve 372 to the bale release cylinder 58. A check valve 376 connects between the pressure line 300 and pilot line 378 in the manifold 50.

FIG. 13A is an operations plan indicating solenoid operated valve positioning for hydraulic cylinder movement including solenoids S1–S10 on the corresponding solenoid operated valves as illustrated in FIGS. 12A–12B.

Figure 13B:
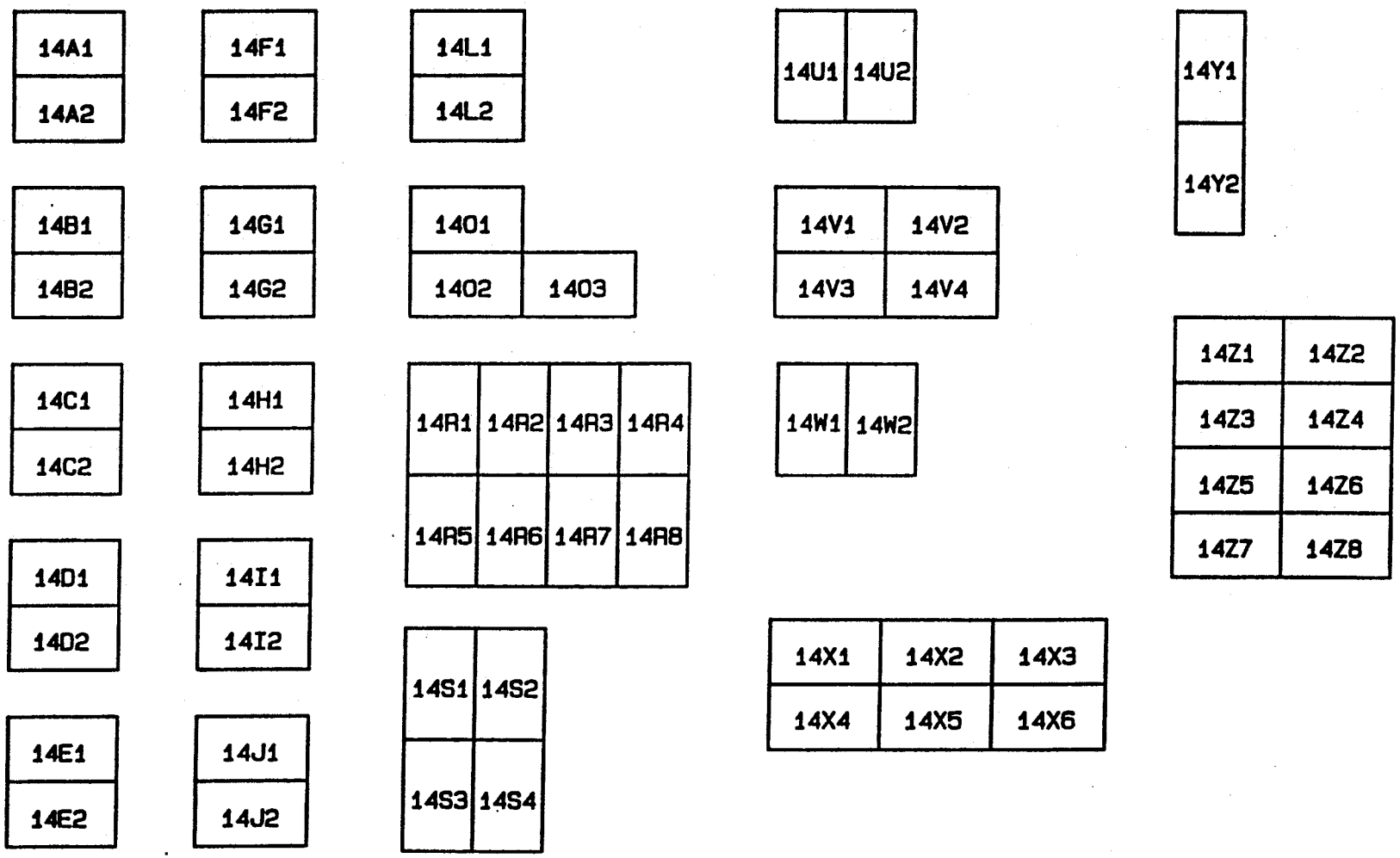
FIG. 13B illustrates the relative positioning of various drawings.
Figure 14K:
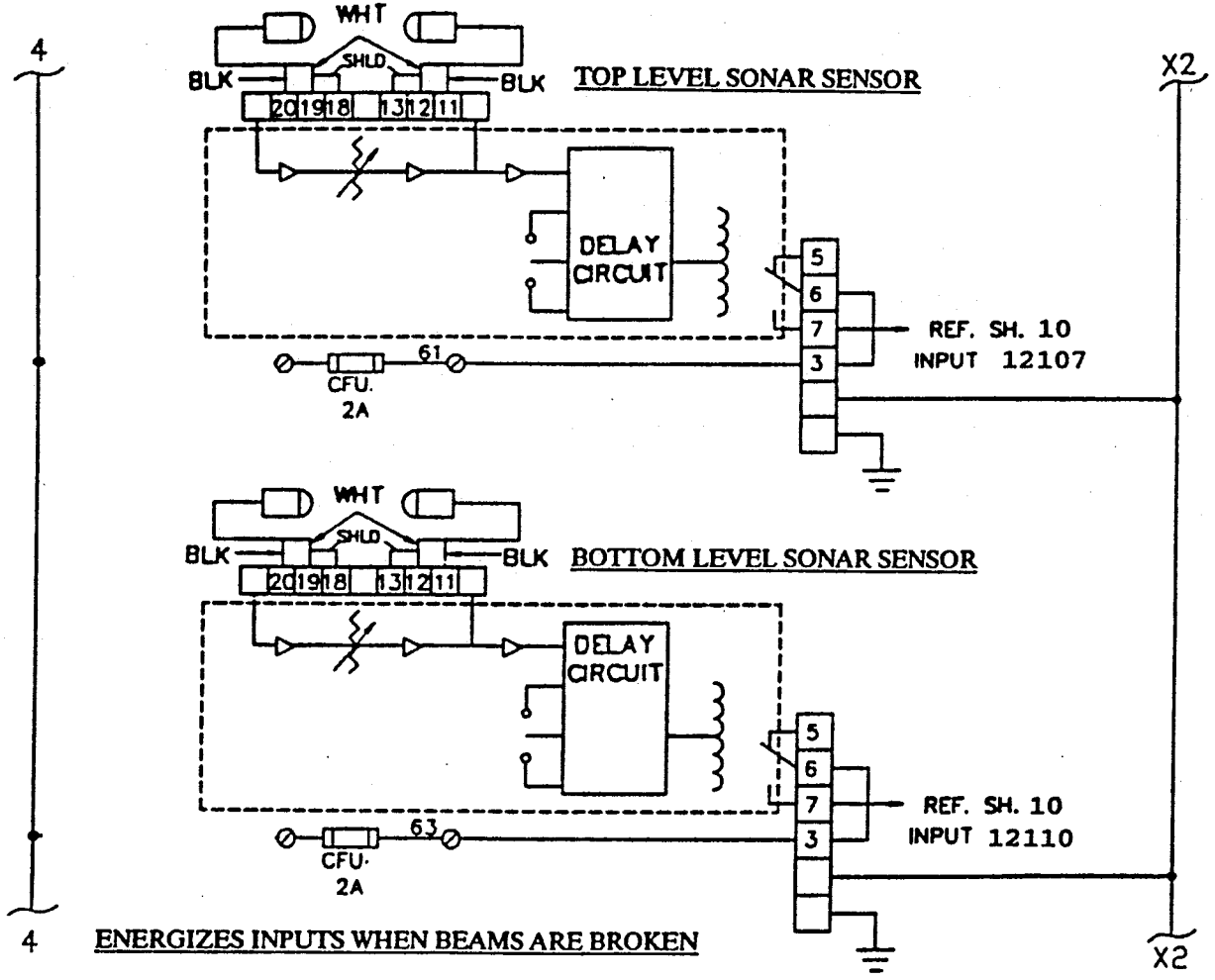
Figure 14N:
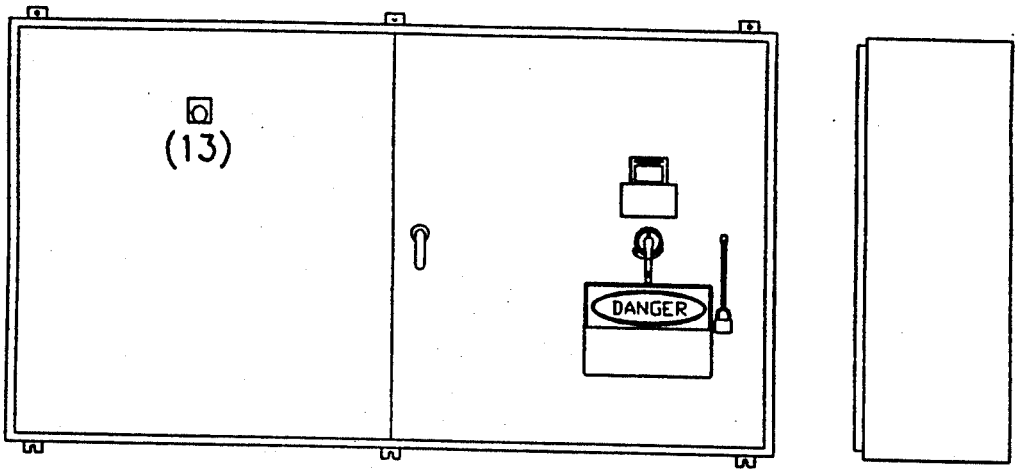
Figure 14N:
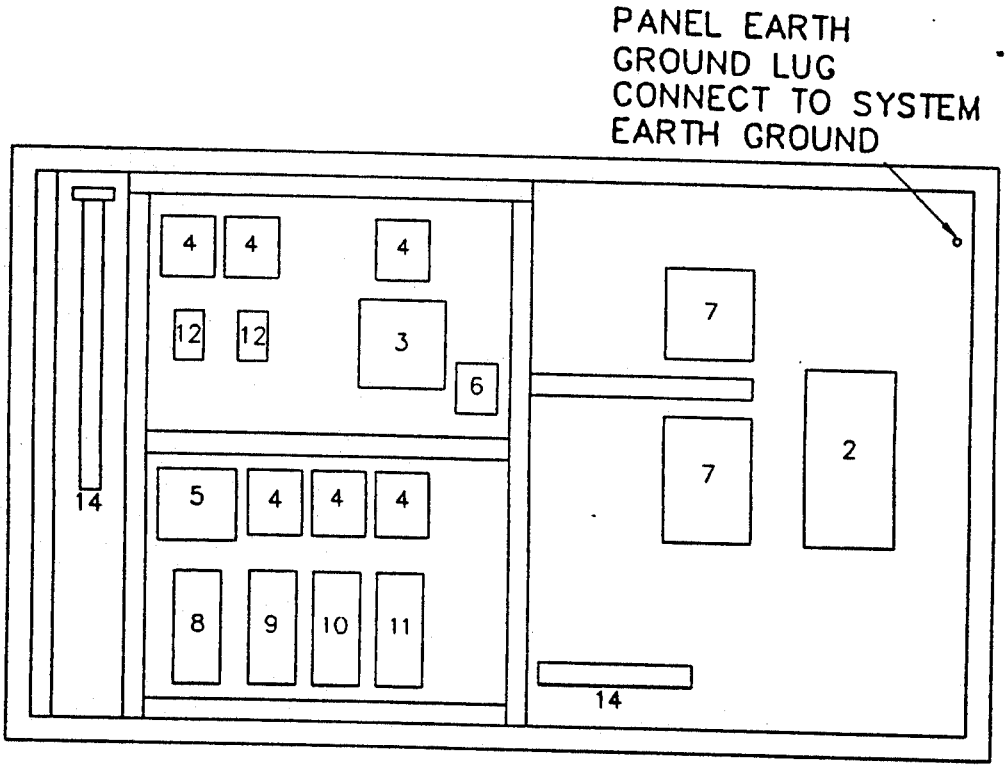
Figure 14Q:
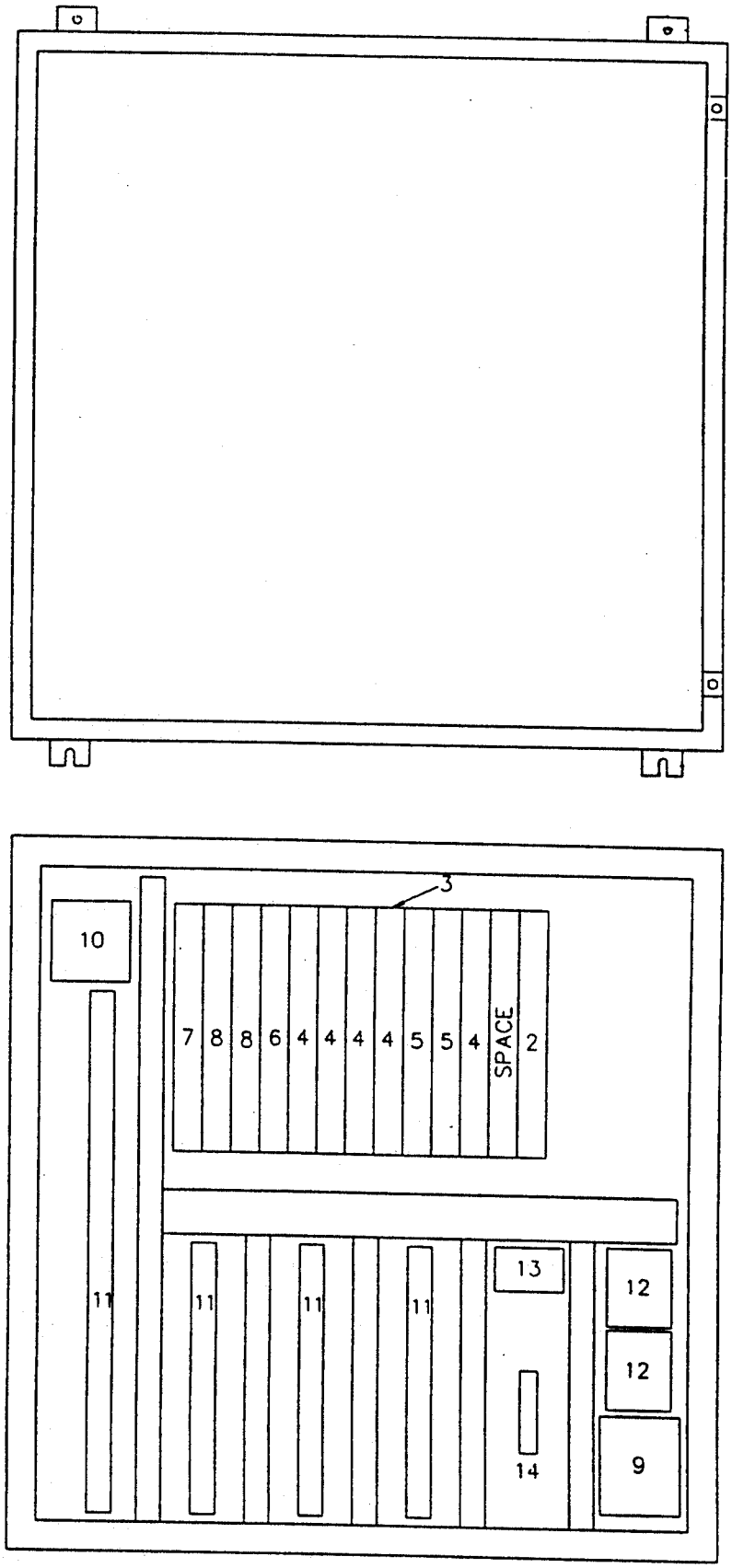

FIG. 13B indicates the relative alignment of various drawing sets which follow.

FIGS. 14A1–14ZZ illustrate the electrical schematics and electrical connections for the baler. Each figure is now described:

BRIEF OUTLINE SUMMARY OF ELECTRICAL CIRCUIT (A–Z) HARDWARE PAGES

| Page | Description |
|---|---|
| 14A1–14A2 | Schematic of main power circuit |
| 14B1–14B2 | Schematic of control circuits, safety interlocks, etc. |
| 14C1–14C2 | Schematic of pressure and temperature transducers connection to input module |
| 14D1–14D2 | Schematic of operator's push button (P.B.) to input module |
| 14E1–14E2 | Schematic of strapper control and warning signal/input module |
| 14F1–14F2 | Schematic of various sensors and switches to input module |
| 14G1–14G2 | Schematic of start/stop for motors to input module |
| 14H1–14H2 | Schematic of output module to motor starters |
| 14I1–14I2 | Schematic of output module to control valve solenoids |
| 14J1–14J2 | Schematic to various inputs, sonic hopper level sensor, etc. to input module |
| K | Schematic to sonic sensors |
| 14L1–14L2 | Schematic to control power connections to power supply |
| M | Components for main panel |
| N | View of main panel and cross reference to Sheet M |
| 14O1–14O3 | Wiring diagram for main panel |
| P | Components for PLC panel |
| Q | View of PLC panel and cross reference to PLC sheet P |
| 14R1–14R8 | Wiring diagram for PLC input and output modules |
| 14S1–14S4 | Wiring terminal strip and devices in PLC panel |
| T | Components for operator's console |
| 14U1–14U2 | General console dimensions and printer cable wiring schematic |
| 14V1–14V4 | Operator console push buttons and legends with cross reference to components |
| 14W1–14W2 | Wiring diagram for P.B. devices in operator's console |
| 14X1–14X6 | Summary of external control devices which wire to the PLC, MCP and console |
| 14Y1–14Y2 | Baler to strapper interconnection chart |
| Z | General outline of auto and semi-auto sequence of operations |
| ZZ | Cable connections and set up for PLC 2/16 processor and two communication modules for programming with computer and interface with console display |

FIGS. 14A1–14ZZ are the sheets of electrical schematics of the Allen Bradley PLC connections of the electrical components and electromechanical components for the baler including sensors such as for the position of the gatherer ram 30 and the ejector ram 31. The position sensors detect the exact position of the rams in the baler and input this data to the PLC on a real time basis. A record of operating time and production is maintained by the PLC. An internal timer maintains a record of total hours spent with motors running and a separate record of hours spent operating in the automatic mode. This timer is accessible through use of a programmer. A record of produced bales is maintained for display on the console, counting until reset by the operator. Also a cumulative record of bales ejected is kept in the PLC which counts the number of bales ejected in individual density modes, i.e., CPO, UBC, etc.

An appendix, on microfiche, is of the software for the Allen Bradley PLC to control electrical functions and operations, electromechanical functions and operations, mechanical functions and operations, and hydraulic functions and operations. Pages 008 to 010 in the PLC-2 software ladder listing refer to hole sensing on the ram travel template 200.

Modes of sequence of operation of the baler are now described.

Baler Automatic Sequence of Operation

1. Be sure all emergency stop lockouts are on.

2. Switch "Control Power" key switch to the "ON" position.

3. Press "Controls On" push button. The start-up horn will sound for 15 seconds to signal machine start-up.

4. Start main pump, circulation pump and the strapper pump. The main pump will cycle "ON" then "OFF" three times if it has not been used for an hour.

5. Switch "Auto/Semi-Auto/Hand" selector switch to the "Hand" position.

6. Manually retract the gatherer and the ejector.

7. "Auto/Semi-Auto/Hand" selector switch to the "Auto" position. Strapper "Auto/Off/Hand" selector switch to the "Auto" position only if a bale is present through the strapper wire track.

8. Go to the material screen to make "Material Selection" for baling.

9. Start the conveyor.

10. When operator sees material falling into hopper, press "Cycle Start".

11. The gatherer will start forward compressing the material into the compression box. After a few compressions, the bale made signal will occur.

12. Gatherer will retract to position. Ejector will start forward to eject bale and start strapping sequence.

13. The ejector will stop at designated positions set by the strap spacing pattern chosen automatically when the material selection was made. The operator can override the strap pattern from the main screen.

14. The ejector will continue forward strapping until it reaches position 16.

15. The ejector retracts to LSER or position zero.

16. The gatherer retracts to LSGR or position zero.

17. When the gatherer reaches LSGR, it will automatically start forward again to repeat another bailing cycle if still in the "Auto" mode.

18. When the gatherer is retracting, the operator may wish to press the "Short Stroke" push button before the gatherer is all the way retracted. This will allow smaller amounts of material to fall into the compression box. There are automatic short strokes programmed based on hydraulic pressure.

Baler Semi-Automatic Sequence of Operation

1. With "Auto/Semi-Auto/Hand" selector switch in the "Semi-Auto" mode, all material compression with the gatherer will be done manually. Using gatherer forward/retract push buttons to compress material, and a "Bale Made" signal is indicated. Press the "Gatherer Position" push button until the gatherer stop moving back. Then press the "Auto Eject & Tie Sequence" push button. The ejector and the strapper will be fully automatic for the rest of the cycle. When the ejector has retracted, manually retract the gatherer.

2. Repeat above for next bale.

This baler has alarm and warning conditions and reference is made to the alarm screen for a listing of the alarms.

1. If baler remains idle for approximately 12 minutes, the baler will shut-down signaling a no production time. A complete start-up sequence will be necessary.

2. If the gatherer should signal an "Oversize Bale", switch baler to "Hand" mode. Raise the bale release. The bale will have to be ejected and strapped manually. If a bale should be too large to be ejected with the bale release up, a portion of the bale may have to be removed by hand. Do this with extreme caution. Switch "Off" the "Control Power" switch and remove the key. The key must remain on the person of the one removing the bale. Also switch "Off" the main breaker at the main control pane and pad lock it.

3. The ejector also has an oversize bale signal. If ejector oversize bale is signaled, switch to "Hand", raise the bale release, and eject the strap bale manually.

4. All alarm or warning conditions are flashed at the bottom of the screen. If one experiences an alarm condition, the screen will change automatically to the alarm list screen for a description of the condition.

5. Should the condition arise that there is not a bale in the baler, the strapper must be switched "Off" until the leading edge of a bale is through the strapper wire track. As the bale starts through the wire track, switch the strapper to "Auto" and strapping should start with the next strap position. If this is not done, the strapper has no way of knowing if a bale is present or not and can cause a strapper malfunction.

MODE OF OPERATION

Prior to or between operations, the hold down members, such as element 88 of FIGS. 5 and 6, are adjusted as previously described for insertion or removal of the shim plates. This provides for proper horizontal movement of the gatherer ram 32. These adjustments are a significant advance over the prior art adjustments, and provide for precise adjustment of the hold down assemblies. Likewise, the shear beam assembly 76 is adjusted by the adjustment gib 156 and the related elements of FIGS. 7 and 8 so that the shear beam properly shears the materials.

The electrical, electromechanical, mechanical and hydraulic functions and operations for the baler are monitored and controlled by an Allen Bradley PLC 2/16 4K processor through the operator's console 20. The Allen Bradley PLC 2/16 4K processor and its associated modules suitably mount in a paneled electrical cabinet enclosures adjacent to the baler. Other electrical and electromechanical components suitably mount in an adjacent paneled electrical cabinet enclosure. Hydraulic power is generated and supplied by the power unit 16 which includes the motor 40, the staged pump 42 in the hydraulic reservoir box 38. Sensors and monitors connect to the PLC to input operational data on a real time basis for the electrical, electromechanical, mechanical and hydraulic components. This data is processed by the stored program and algorithms in the PLC to control the functions and operation of the baler.

Various modifications can be made to the present invention without departing from the apparent scope hereof.

A microprocessor or personal computer with the appropriate interface can be used in lieu of the PLC. Each type of material to be baled is intended to have its own baling algorithm. Likewise, bales designated for a designated recycling processor are intended to have their own algorithms, such as weight of bale, density of the bale, and strapping requirements.

We claim:

1. Baler for baling of material comprising:

a. a hopper for receiving material to be baled;

b. charging box chamber mounted below and open to said hopper for receiving material from the hopper and for holding material to be compressed including a gatherer ram for compressing material;

c. bale compression chamber mounted below and open to said charging box chamber for receiving material from the charging box changer;

d. bale exit chamber adjacent and open to said bale compression chamber for receiving compressed material;

e. ejection ram mounted for movement in said bale compression chamber and said bale exit chamber;

f. operator console, adjacent said hopper, mounted over said gatherer ram in a position where an operator can look downward into the hopper while at the console;

g. hydraulic means adjacent said operator console and over said gatherer ram, in fluid power connection to said gatherer ram and said ejection ram;

h. control means on said operator console in operative connection with said hydraulic means for controlling baling operations from the console;

i. the charging box chamber having a side frame;

j. a movable side frame liner in the charging box chamber adjacent to said side frame;

k. a geometrically configured hold down for the gatherer ram, mounted on the side frame, including a vertical member and a horizontal member extending outwardly therefrom between ends of said vertical member;

l. an adjustment screw extending downwardly through said horizontal member of said hold down and a side frame for holding the horizontal member against said charging box side frame; and, at least one removable shim mounted between said horizontal member of said hold down and said charging box side frame for determining the height of the horizontal member over the side frame.

2. Baler for baling of material comprising:

a. a hopper for receiving material to be baled;

b. charging box chamber mounted below and open to said hopper for receiving material from the hopper and for holding material to be compressed including a gatherer ram for compressing material;

c. bale compression chamber mounted below and open to said charging box chamber for receiving material from the charging box changer;

d. bale exit chamber adjacent and open to said bale compression chamber for receiving compressed material;

e. ejection ram mounted for movement in said bale compression chamber and said bale exit chamber;

f. operator console, adjacent said hopper, mounted over said gatherer ram in a position where an operator can look downward into the hopper while at the console;

g. hydraulic means adjacent said operator console and over said gatherer ram, in fluid power connection to said gatherer ram and said ejection ram;

h. control means on said operator console in operative connection with said hydraulic means for controlling baling operations from the console;

i. a shear beam mounted adjacent a baler frame;

j. a shear knife affixed to said shear beam;

k. a beam adjustment screw extending up through said frame and secured thereto with a lock nut;

l. a geometrically configured pin mounted between vertical frame members and adjacent said shear beam;

m. a geometrically configured gib and shim positioned between said gib and a horizontal surface of said shim; and, n. gib adjustment screw extending through said gib and engaging a vertical surface of said shear beam for securing adjustment of said shear beam with respect to said gib.

3. In a material baler having a charging box chamber, a hopper for feeding material to the charging box chamber, a bale compression chamber for receiving material from the charging box chamber for forming bales under ram pressure, a ram for compressing material in the charging box chamber and the bale compression chamber, a hold adjustment for a ram hold down for holding down the ram comprising:

a. the charging box having a side frame;

b. a side frame liner in said charging box against said side frame;

c. a geometrically configured hold down mounted on the side frame including a vertical member and a horizontal member extending outwardly therefrom between ends of said vertical member;

d. an adjustment cap screw extending downwardly through said horizontal member of said hold down for adjusting the height of the hold down; and, e. at least one movable shim between said horizontal member of said hold down and said charging box side frame for determining the height of the hold down over the side frame.

4. In a material baler for compressing material, an improved adjustable hold-down system comprising:

a. a charging box having a side frame;

b. a flange mounted on the side frame;

c. a ram mounted for horizontal movement with the charging box; and, d. a hold down mounted on the flange for holding down the ram as it moves including a first member extending downward into the charging box for contacting the ram in a slidable relationship, a second member adjustably mounted on the flange, an adjustable fastener for attaching the second member to the flange at varying distances from the flange, and a removable shim positioned between the flange and the second member so that the height of the first member above the flange is determined by the thickness of the shim.

5. The hold down of claim 4 wherein the fastener is a cap screw extending through the second member and the flange.

6. The hold down of claim 4 further comprising removable multiple shims for varying spacing between the flange and the second member.

7. The hold down of claim 4 further comprising a hold down liner attaching to a lower end of the first member and extending above the ram for slidably engaging the ram as it moves in the charging box.

8. The hold down of claim 7 further comprising multiple hold downs for holding the hold down liner.

* * * * *